US009227415B2

(12) United States Patent
Nagashima et al.

(10) Patent No.: US 9,227,415 B2
(45) Date of Patent: Jan. 5, 2016

(54) LIQUID CONTAINING BODY

(71) Applicant: SEIKO EPSON CORPORATION, Tokyo (JP)

(72) Inventors: Takumi Nagashima, Nagano (JP); Taku Ishizawa, Nagano (JP); Yuji Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/487,509

(22) Filed: Sep. 16, 2014

(65) Prior Publication Data

US 2015/0077483 A1 Mar. 19, 2015

(30) Foreign Application Priority Data

Sep. 17, 2013 (JP) ..... 2013-191455

(51) Int. Cl.
*B41J 2/175* (2006.01)

(52) U.S. Cl.
CPC ..... *B41J 2/17523* (2013.01); *B41J 2/1752* (2013.01); *B41J 2/1753* (2013.01); *B41J 2/17513* (2013.01); *B41J 2/17553* (2013.01)

(58) Field of Classification Search
CPC .. B41J 2/1752; B41J 2/17523; B41J 2/17503; B41J 2/17513
USPC ..... 347/86
See application file for complete search history.

(56) References Cited

U.S. PATENT DOCUMENTS

| | | | | |
|---|---|---|---|---|
| 6,926,826 | B2 * | 8/2005 | Reid | 210/232 |
| 7,165,833 | B2 * | 1/2007 | Graham et al. | 347/84 |
| 8,353,585 | B2 * | 1/2013 | Harada | 347/90 |
| 8,454,143 | B2 * | 6/2013 | Takeuchi | 347/86 |
| 2006/0139420 | A1 * | 6/2006 | Muranaka et al. | 347/86 |
| 2009/0213159 | A1 | 8/2009 | Aoki et al. | |

FOREIGN PATENT DOCUMENTS

JP 2009-220564 A 10/2009

* cited by examiner

*Primary Examiner* — Alessandro Amari
*Assistant Examiner* — Michael Konczal
(74) *Attorney, Agent, or Firm* — Global IP Counselors, LLP

(57) ABSTRACT

A liquid containing body includes a liquid containing vessel, and a casing member. The liquid containing vessel contains a liquid, and includes a supply member with a liquid supply opening that supplies the liquid to a liquid consumption apparatus. The casing member supports at least the supply member. The supply member has a cylindrical flow path section that defines the liquid supply opening. The casing member has a through hole forming section with a through hole. The cylindrical flow path section is insertable in the through hole. The casing member further has an engaging section that engages with the supply member to regulate movement of the cylindrical flow path section in an opposite direction to an insertion direction while the cylindrical flow path section is rotated with the insertion direction as an axial line in a state where the cylindrical flow path section is inserted in the through hole.

7 Claims, 33 Drawing Sheets

81
81A
82
64 (60F)
67 (60D)
66
64H
69
61
81F
+Z
+Y
-X
+X
-Z 61
66
C
D
D
81
82
81A
86
85
C
+Z
-Y
+Y
-Z 61
67
69
64 (60F)
64b
64a
67a
66
64H
62
93
82F
82
82a
63
81A
81
85
87
88
89
94
81K
+Z
-Y
-X
+X
+Y

LIQUID CONTAINING BODY

CROSS-REFERENCE TO RELATED APPLICATIONS

This application claims priority to Japanese Patent Application No. 2013-191455 filed on Sep. 17, 2013. The entire disclosure of Japanese Patent Application No. 2013-191455 is hereby incorporated herein by reference.

BACKGROUND

1. Technical Field

The present invention relates to a liquid containing body having a liquid containing vessel with a liquid containing chamber, which can contain liquid, inside a casing member.

2. Related Art

In the prior art, an ink cartridge (a liquid containing body) is known where an ink vessel (a liquid containing vessel) with an ink chamber (a liquid containing chamber), where it is possible for ink, which is supplied to an ink jet printer (a liquid consumption apparatus) which consumes ink (a liquid) by ejecting the ink, to be contained, is provided inside a casing member. There is a structure in the ink cartridge where the ink vessel with an ink pack, where it is possible for a relatively large amount of ink to be contained, as the ink chamber is positionally aligned using the casing member.

In detail, there is a structure in the ink cartridge in the prior art where the ink vessel (the ink pack), which is provided with a supply member (an ink guiding member) where a liquid supply opening where it is possible for ink to be discharged from the ink chamber to the outside, is supported inside the casing member (inside a bag containing section) in a state of being positionally aligned using a plurality of members (see JP-A-2009-220564 (Patent Literature 1), for example).

SUMMARY

However, in the ink cartridge which has the configuration described above, there are times when each of the plurality of members moves in a case where a shock or vibration is applied due to being dropped or the like since the ink vessel is positionally aligned by being supported inside the casing member with a complex structure using the plurality of members. As a result, there are cases where positional alignment of the ink vessel is not possible inside the casing member and there is a state where it is difficult to suppress movement of the ink vessel inside the casing member. In this case, for example, the liquid supply opening moves to accompany movement of the ink vessel inside the casing member and it is possible for leaking to occur from the liquid supply opening where ink, which is supplied to a printer, moves.

Here, these circumstances are typically shared in liquid containing bodies which are provided with a liquid containing vessel, where it is possible for a liquid to be contained and which is provided with a supply member which is provided with a liquid supply opening where it is possible for the liquid which is contained to be discharged to the outside, and a casing member which is able to support the liquid containing vessel.

The present invention is conceived in light of these circumstances. An advantage of the present invention is to provide a liquid containing body with which a supply member can be supported in a state of being positionally aligned using a casing member with a simple structure.

The means for solving the problem and operational effects thereof will be described below.

A liquid containing body which solves the problem is provided with a liquid containing vessel configured to contain a liquid, and including a supply member with a liquid supply opening that is configured to supply the liquid contained to a liquid consumption apparatus, and a casing member supporting at least the supply member of the liquid containing vessel, the supply member having a cylindrical flow path section that defines the liquid supply opening, the casing member having a through hole forming section with a through hole, the cylindrical flow path section of the supply member being insertable in the through hole, and the casing member further having an engaging section that engages with the supply member to regulate movement of the cylindrical flow path section in an opposite direction to an insertion direction while the cylindrical flow path section is rotated with the insertion direction as an axial line in a state where the cylindrical flow path section is inserted in the through hole.

According to this configuration, since the liquid containing vessel is positionally aligned by engaging with the casing member due to the cylindrical flow path section being rotated with the insertion direction as the axial line in a state where the cylindrical flow path section of the supply member is inserted in the through hole in the casing member, it is possible for the supply member of the liquid containing vessel to be supported in a state of being positionally aligned with regard to the casing member using a simple structure (and with fewer processes). As a result, it is possible to obtain the liquid containing body where movement of the liquid containing vessel is suppressed even when a shock is applied due to being dropped or the like.

In the liquid containing body described above, it is preferable that the casing member further has a fastening section that regulates rotating of the cylindrical flow path section by fastening the supply member in a state where the cylindrical flow path section is inserted.

According to this configuration, since the supply member is fastened using the fastening section which regulates rotating in a state of engaging so that movement of the cylindrical flow path section in the opposite direction to the insertion direction into the through hole forming section is regulated, it is possible to maintain a state where the supply member is supported in a state of being positionally aligned with regard to the casing member.

In the liquid containing body described above, it is preferable that the supply member further has a fastened section that is fastened by the fastening section, and the fastened member further has a claw section that is deformable while the fastened member is fastened by the fastening section.

According to this configuration, since it is possible for a state where the fastened section of the supply member is fastened by the fastening section of the casing member to be visually recognized due to the claw section changing shape, a state where the supply member is reliably supported by the casing member is possible.

In the liquid containing body described above, it is preferable that the fastening section is arranged such that a position, where the cylindrical flow path section is rotated by 90 degrees about the axial line from a position of being inserted in the through hole, is a position where the supply member is fastened by the fastening section.

According to this configuration, when the support member is attached to the casing member, it is easy for a rotation angle of 90 degree to be a guide and assembly is easy.

In the liquid containing body described above, it is preferable that the engaging section is provided in the through hole forming section of the casing member, and that the cylindrical flow path section of the supply member further has an engaged section that is engageable with the engaging section of the through hole forming section and whose movement in the opposite direction to the insertion direction is regulated while engaging with the engaging section.

According to this configuration, since the supply member falling out in the opposite direction to the insertion direction in a state of being supported by the casing member is suppressed due to the state of the engaged section of the cylindrical flow path section being engaged with regard to the engaging section of the through hole forming section, a state where the support member is firmly positionally aligned and supported in the casing member is possible.

In the liquid containing body described above, it is preferable that the through hole forming section further has an abutting section that is abuttable with the cylindrical flow path section in the insertion direction.

According to this configuration, due to the supply member rotating in a state where movement of the cylindrical flow path section is restricted in the insertion direction, it is possible for the supply member to be easily and reliably supported by the casing member.

In the liquid containing body described above, it is preferable that the supply member is formed in an asymmetrical manner when viewed from the insertion direction.

According to this configuration, it is possible to suppress mistakes with the insertion posturing of the supply member when the cylindrical flow path section is inserted in the through hole when the supply member is supported by the casing member.

BRIEF DESCRIPTION OF THE DRAWINGS

Referring now to the attached drawings which form a part of this original disclosure:

FIG. 6A is a planar diagram, FIG. 6B is a cross sectional diagram along a line A-A in FIG. 6A, and FIG. 6C is an enlarged diagram of a portion which is shown with an arrow 6*c* in FIG. 6B;

FIG. 10A is a partial planar diagram and FIG. 10B is a cross sectional diagram along a line B-B in FIG. 10A;

FIG. 17A is a side surface diagram of an ink vessel, FIG. 17B is a cross sectional diagram along a line C-C in FIG. 17A, and FIG. 17C is a cross sectional diagram along a line D-D in FIG. 17A;

FIG. 18A is a planar of an ink vessel and FIG. 18B is a cross sectional diagram along a line E-E in FIG. 18A;

FIG. 21A is a diagram of a state prior to a supply member being inserted in a through hole in a casing member, FIG. 21B is a diagram of a state where a supply member is inserted in a through hole.

FIGS. 22A to 22C are diagrams of state which correspond to FIGS. 21A to 21C and are diagrams illustrating a state where a casing member of an ink cartridge is partially cut away;

FIG. 28A is a side surface diagram of a mounting section, FIG. 28B is a cross sectional diagram along a line G-G in FIG. 28A, and FIG. 28C is a cross sectional diagram along a line H-H in FIG. 28A;

FIG. 29A is a side surface diagram of a mounting section, FIG. 29B is a cross sectional diagram along a line I-I in FIG. 29A, and FIG. 29C is a cross sectional diagram along a line J-J in FIG. 29A;

FIG. 30A is a side surface diagram of a mounting section, FIG. 30B is a cross sectional diagram along a line K-K in FIG. 30A, and FIG. 30C is a cross sectional diagram along a line L-L in FIG. 30A;

DETAILED DESCRIPTION OF EMBODIMENTS

An embodiment of an ink jet printer which is an example of a liquid consumption apparatus will be described below with reference to the drawings. The printer of the present embodiment performs printing on a sheet P by forming an image or the like due to ink, which is an example of a liquid, being ejected, that is, consumed, on the sheet P which is an example of a target which is transported in one direction.

<Printer Configuration>

Figure 1:
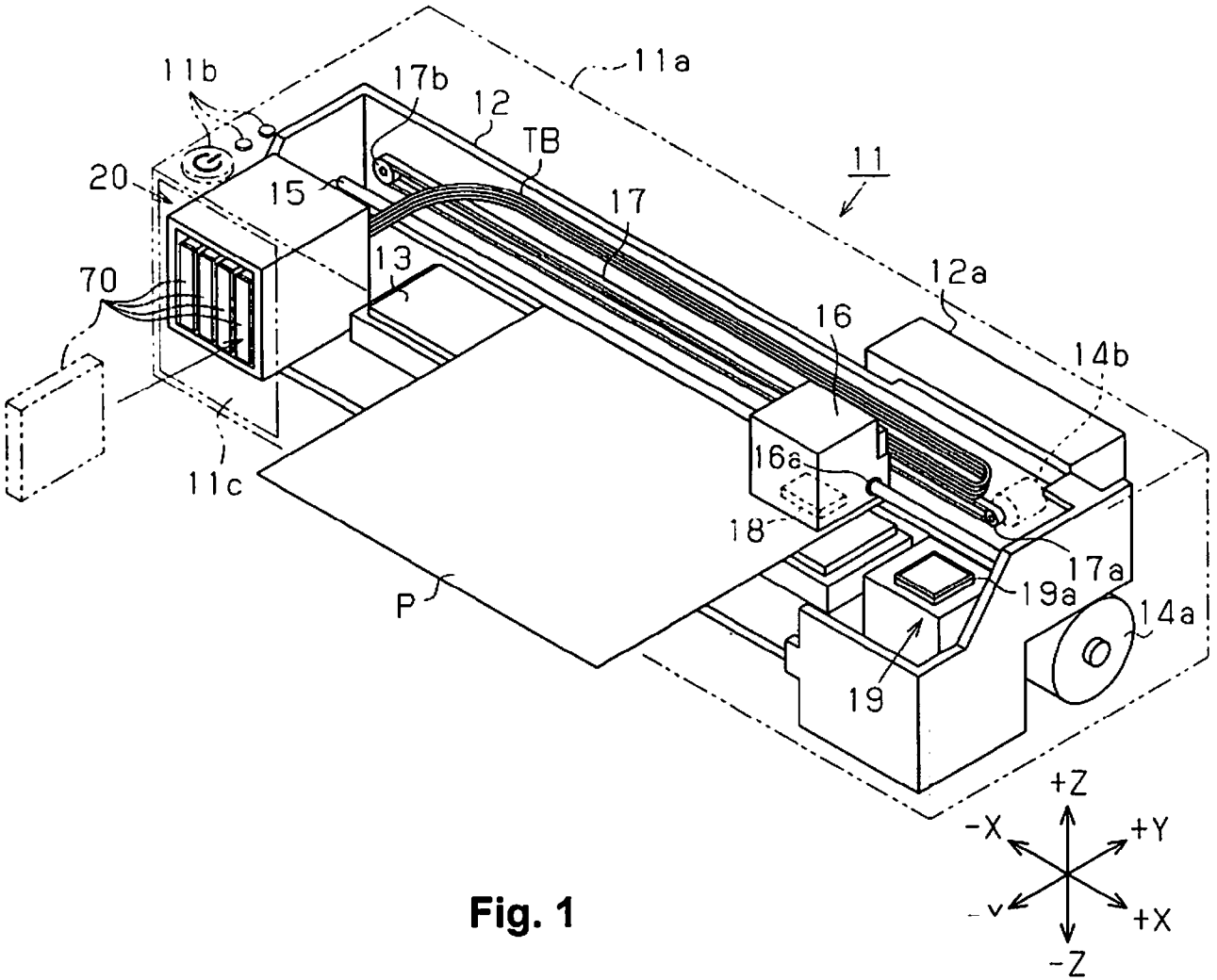
FIG. 1 is a perspective diagram illustrating an outline of an embodiment of a printer which is an example of a liquid consumption apparatus.

As shown in FIG. 1, a printer 11 of the present embodiment is provided with a casing 11*a* with substantially a rectangular cube shape with a portion thereof indicated by a two-dot chain line and operation buttons 11*b* such as a power button for driving the printer 11 are provided on an upper surface on the +Z direction side which is upward in the vertical direction. In addition, a cover 11*c* which is able to open and close is provided in a front surface of the casing 11*a* which is on the −Y direction side which is the direction in which the sheet P is transported. It is possible for the user to gain access inside the casing 11*a* in a state where the cover 11*c* is open.

A support platform 13, where the ±X direction which is orthogonal to the −Y direction is the longitudinal direction, is provided to extend substantially in the horizontal direction at a lower section on the gravity direction side, that is, the −Z direction side in a frame 12 with a substantially rectangular box shape which contains an internal space which is covered by the casing 11*a*, and a sheet feeding motor 14*a* is provided at a lower section of the frame 12 on the rear side which is the opposite side to the transport direction (the −Y direction). That is, the sheet P is supplied in the −Y direction on the support platform 13 using a sheet feeding mechanism which is operated by driving of the paper feeding motor 14*a*.

In addition, a guide shaft 15 is provided to span above the support platform 13 in the frame 12 along the longitudinal direction of the support platform 13. A carriage 16 is supported on the guide shaft 15 so as to be able to move back and forth in the shaft direction of the guide shaft 15, that is, the ±X direction. In detail, a support hole 16*a* is formed in the carriage 16 to pass through in the ±X direction and the guide shaft 15 passes through the support hole 16*a*. Here, viewed from the −Y direction side, a direction to the right is the +X direction and a direction to the left is the −X direction.

A drive pulley 17*a* and a driven pulley 17*b* are respectively supported to rotate freely at positions at an inner surface of the rear wall of the frame 12 in the vicinity of both ends of the guide shaft 15. The output shaft of the carriage motor 14*b* is linked with the drive pulley 17*a* and an endless timing belt 17 where a portion thereof is linked with the carriage 16 is wound around between the drive pulley 17*a* and the driven pulley 17*b*. Then, the carriage 16 is moved back and forth in the ±X direction which is the scanning direction while being guided by the guide shaft 15 through the timing belt 17 due to driving of the carriage motor 14*b*.

A liquid ejecting head 18 which is an example of a liquid ejecting section is provided on the lower side of the carriage 16 and an image is printed on the sheet P by ink which is supplied with regard to the liquid ejecting head 18 being ejected from the liquid ejecting head 18. Supplying of ink to the liquid ejecting head 18 is performed using an ink cartridge 70 which is an example of a liquid containing body which is mounted so as to be able to be inserted and extracted in a mounting section 20 which is provided inside the casing 11*a*. That is, the mounting section 20, in which the ink cartridge 70 is mounted, is provided to be arranged to the −X direction side of the casing 11*a* and an ink supply tube TB where it is possible for ink to flow links between the mounting section 20 and the carriage 16. Supplying of ink from the ink cartridge 70 which is mounted in the mounting section 20 to the ink ejecting head 18 is performed through the ink supply tube TB.

In the present embodiment, it is possible for four of the ink cartridges 70 (refer to FIG. 12) to be mounted in the mounting section 20 with ink vessels 80 respectively in casing members 73, where the ink vessels are examples of a liquid containing vessel where ink of each color of, for example, cyan, magenta, yellow, and black with tones which are different to each other are respectively contained. Each of the ink cartridges 70 are able to be inserted and extracted with regard to the mounting section 20 through the cover 11*c* which is open as is shown for one of the ink cartridges 70 by the two-dot chain line in FIG. 1.

In addition, a maintenance apparatus 19 with a cap 19*a* with a shape of a box with a bottom which opens upward, a suction pump which is not shown in the diagrams, and the like is provided at a region inside the frame 12 more to the +X direction side than the support platform 13, that is, at a home position region which is not used during printing. Then, a maintenance operation where maintenance is carried out so that ink is ejected stably from the ink ejecting head 18 is performed in the printer 11 by the maintenance apparatus 19 after the carriage 16 is moved to the home position region.

Various operations which are performed in the printer 11 are controlled using a control section. In the present embodiment, the control section is configured using a circuit board where electronic elements such as a CPU, a RAM, and a ROM are installed and is provided to be arranged in a box body 12*a* which is provided at, for example, the rear of the frame 12.

Furthermore, the control section performs communication of designated liquid information (for example, identification data for the ink cartridges 70 and data such as the remaining amount of ink in the ink vessels 80) with a storage element 36 (refer to FIG. 10B) which is an example of a storage apparatus which are provided in the ink cartridges 70 in a case where ink is supplied from the ink cartridges 70. In detail, communication of liquid information is performed by electronically connecting between an electrical connection section which is provided in the mounting section 20 and an electrical connection section which is provided in the ink cartridges 70. Here, the respective electrical connection sections in the mounting section 20 and the ink cartridges 70 will be described later.

<Configuration of Mounting Section for Ink Cartridges>

Next, the configuration of the mounting section 20 will be described.

Figure 2:
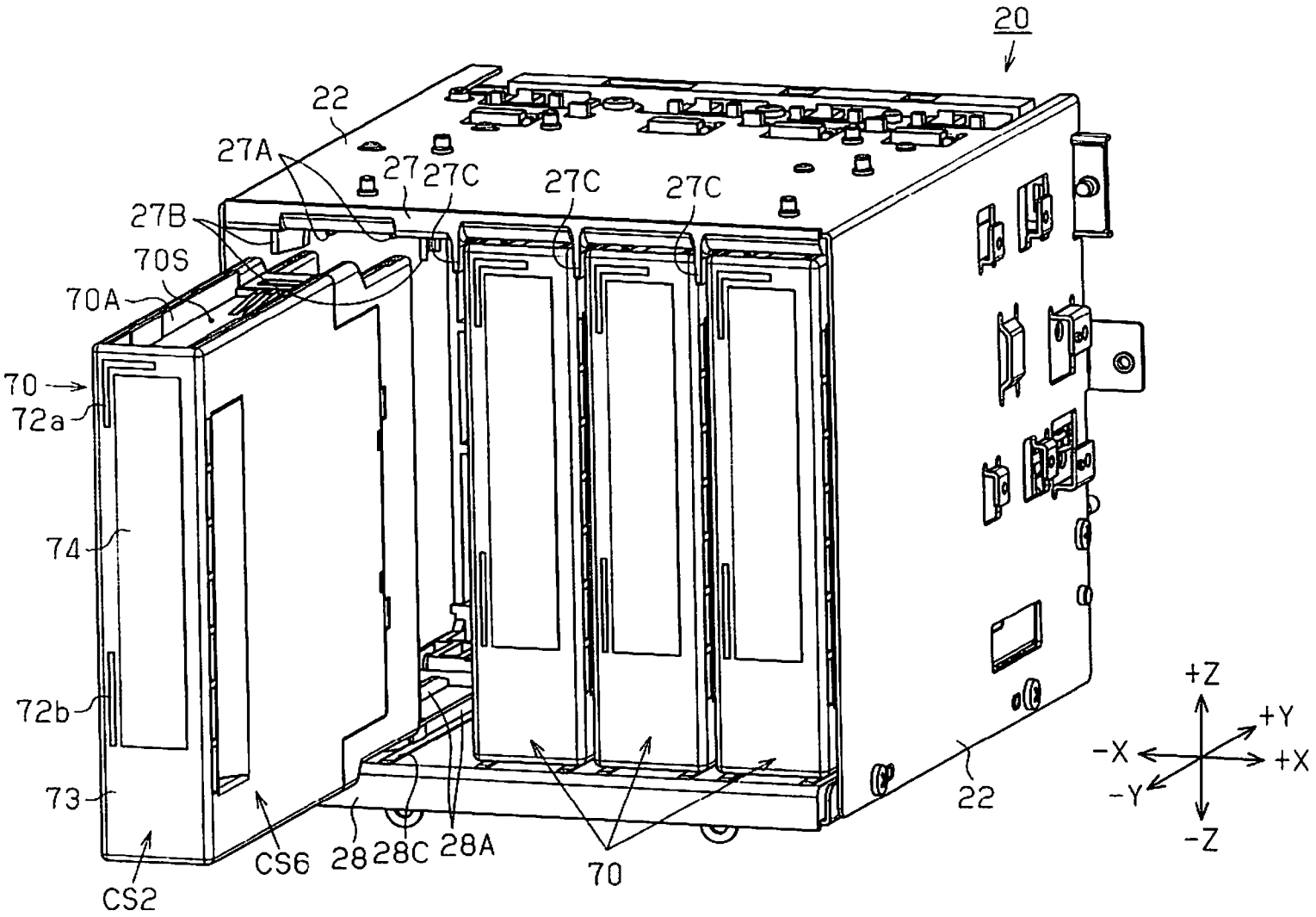
FIG. 2 is a perspective diagram illustrating a mounting section for an ink cartridge which is provided in a printer.
Figure 3:
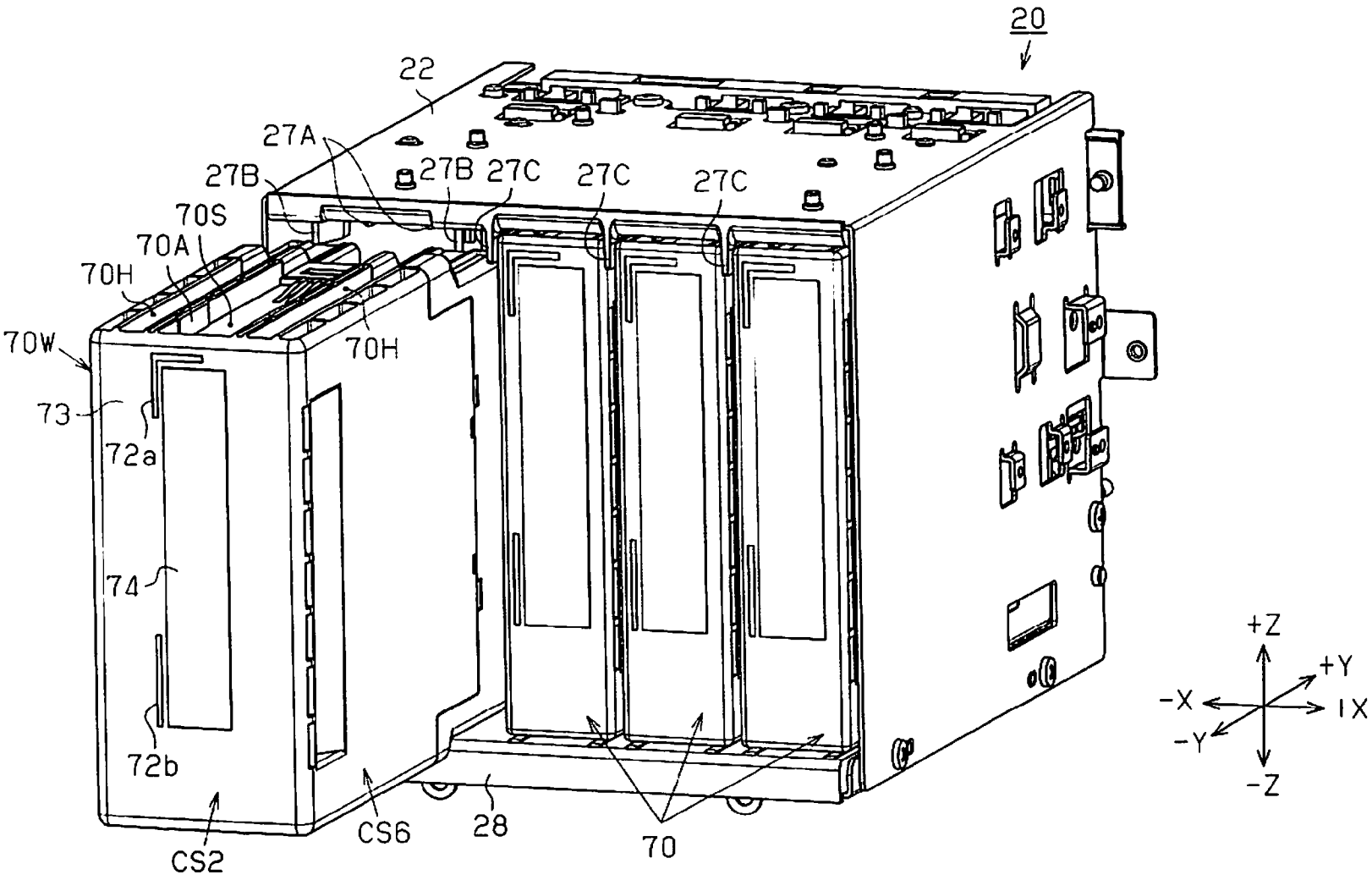
FIG. 3 is a perspective diagram illustrating a state where an ink cartridge with a larger width is mounted in a mounting section.
Figure 4:
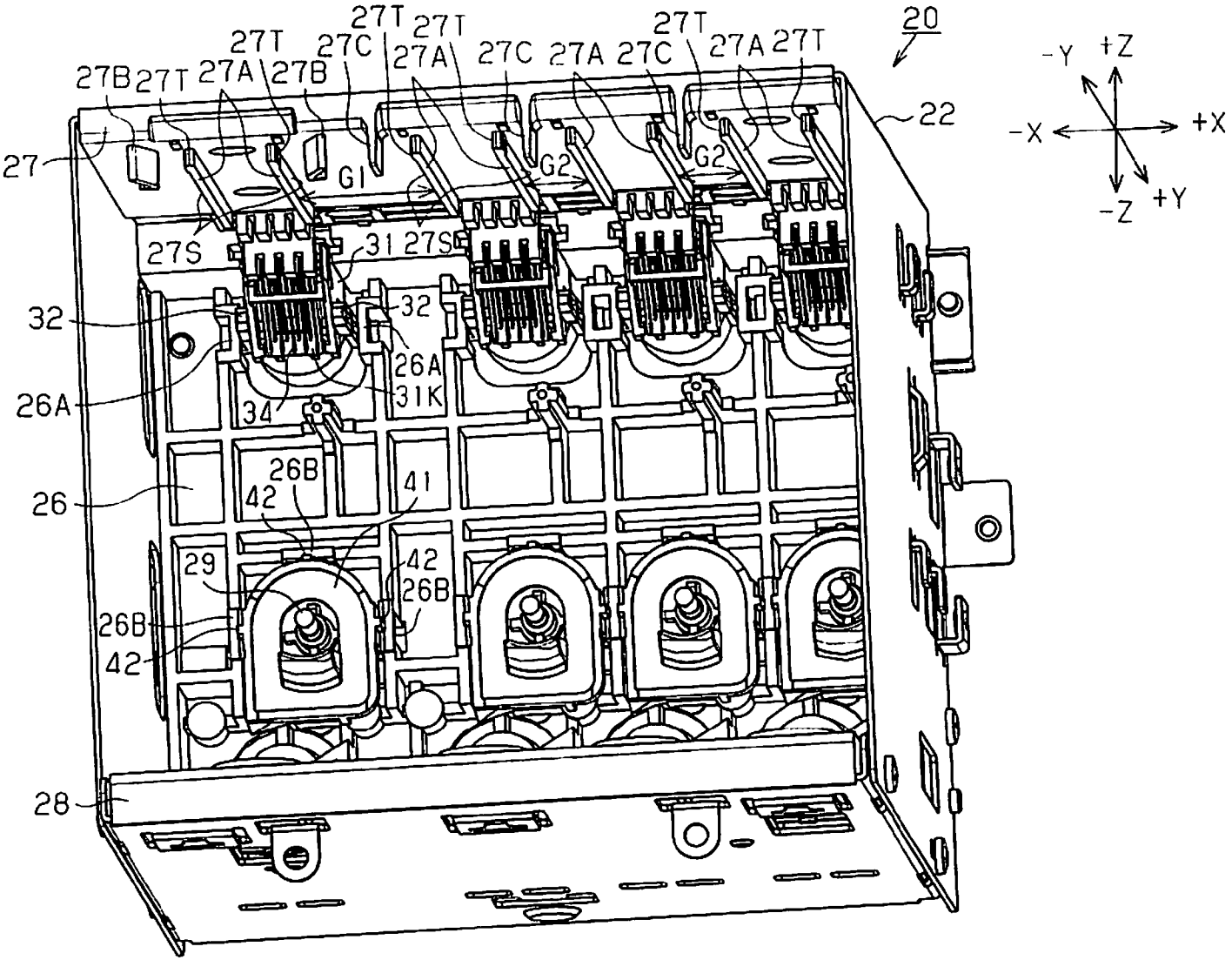
FIG. 4 is a perspective diagram illustrating a mounting section where an ink cartridge is mounted so as to be able to be inserted and extracted.

As shown in FIG. 2, FIG. 3, and FIG. 4, the mounting section 20 of the present embodiment is configured to be able to hold four of the ink cartridges 70 with substantially a rectangular cube shape in cartridge holding bodies 22 with substantially a box shape which is open on the −Y direction side so that the ink cartridges 70 line up along the ±X direction. Then, the mounting section 20 has a configuration where it is possible to hold the ink cartridges 70, where at least one of four of the ink cartridges 70 has different width dimensions in the ±X direction, in the cartridge holding bodies 22.

In detail, the mounting section 20 of the present embodiment is configured so that an ink cartridge 70W with a wider width than the ink cartridge 70 is able to be inserted and extracted in place of one of the ink cartridges 70, which is held in the cartridge holding body 22 farthest to the −X direction side, out of four ink cartridges 70.

That is, a top member 27 is attached to an inner top surface which is positioned at the inner side of the cartridge holding body 22 on the +Z direction side. Upper guide ribs 27A, which are a pair of guide rails which are provided to bulge downward along the +Y direction which is the insertion direction for the ink cartridges 70, are provided in the top member 27 to have designated intervals in the ±X direction according to the respective insertion positions of the ink cartridges 70 to be inserted in the cartridge holding bodies 22.

The upper guide ribs 27A are provided to extend in the +Y direction and are provided to be a pair in the ±X direction with regard to one of the ink cartridges 70. On the other hand, the ink cartridge 70 has a concave section 70S which is provided to extend in the +Y direction in an upper surface of the ink cartridge 70, and upper side inner walls 70A which are a pair of inner side surfaces which oppose each other in the ±X direction are formed in the concave section 70S. Furthermore, each of the pair of upper guide ribs 27A have a rib side surface 27S which oppose each other with a gap on the inner side of the concave sections 70S of the ink cartridge 70. The rib side surfaces 27S function as guiding surfaces for the ink cartridge 70. That is, in the ink cartridge 70 which is inserted in the mounting section 20, the upper side surface is positionally aligned in the cartridge holding body 22 in the ±X direction and movement in the +Y direction is guided due to the upper side inner walls 70A which are opposing surfaces abutting with regard to the rib side surfaces 27S of the upper guide rib 27A. Here, as shown in FIG. 4, rib sections 27T, which each protrude toward the outer side in the ±X direction and are thicker than elsewhere, are formed to have a specific length in the +Y direction in each of the pairs of the upper guide ribs 27A at an edge section in the opposite direction to the insertion direction, that is, the −Y direction. The function of the rib sections 27T of the upper guide ribs 27A will be described later.

As shown in FIG. 4, the upper guide ribs 27A, which correspond to the ink cartridge 70 which is held in the cartridge holding body 22 farthest to the −X direction side, are provided in the top member 27 so that the interval between the adjacent upper guide ribs 27A is wider than the upper guide ribs 27A which correspond to the three other ink cartridges 70. That is, in the present embodiment, a gap G1 between the pair of upper guide ribs 27A, which correspond to the ink cartridge 70 which is held farthest to the −X direction side, and the adjacent pair of upper guide ribs 27A is set to be larger than a gap G2 between the three other pairs of upper guide ribs 27A. Accordingly, due to the gap G1 being set to be larger than the gap G2 in this manner, it is possible to insert the ink cartridge 70W with a larger width as shown in FIG. 3 at an insertion position for the ink cartridge 70 which is held in the cartridge holding body 22 farthest to the −X direction side. In other words, the gap G1 is set to have an interval so that it is possible to insert the ink cartridge 70W with a larger width.

Figure 5:
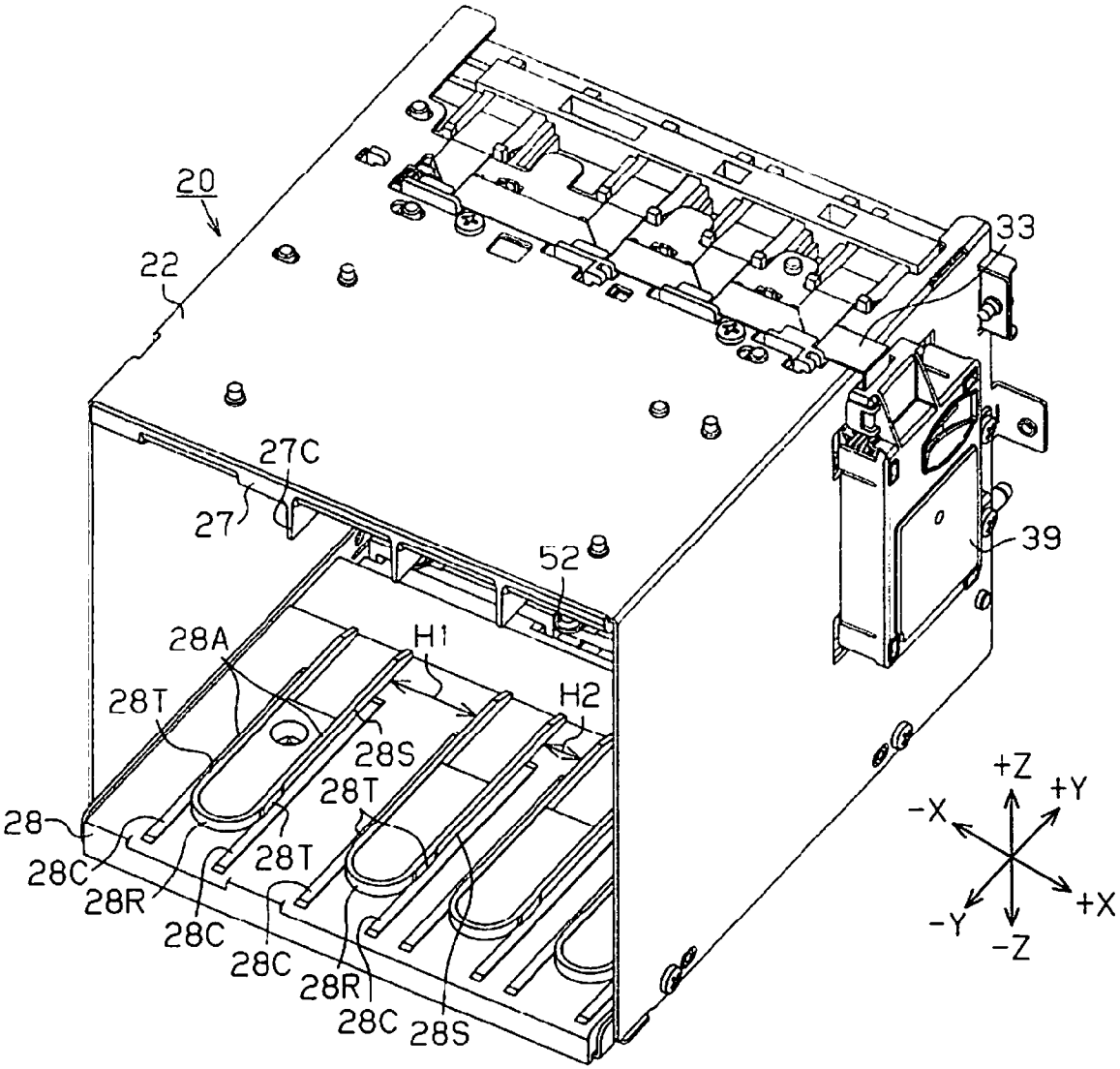
FIG. 5 is a perspective diagram of a mounting section viewed from a direction which is different to FIG. 4.

In addition, as shown in FIG. 2 and FIG. 5, a bottom member 28 is attached in the cartridge holding body 22 with substantially a box shape to an inner bottom surface which is positioned at the inner side on the −Z direction side which is the gravity direction side. Pairs of lower guide ribs 28A which are guide rails are provided in the bottom member 28 so as to protrude upward along the +Y direction which is the insertion direction for the ink cartridge 70 at specific intervals in the ±X direction which is the scanning direction. The pairs of lower guide ribs 28A are provided according to the insertion positions for each of the ink cartridges 70 in the cartridge holding bodies 22 in the ±X direction. In the present embodiment, each of the pairs of the lower guide ribs 28A are provided in positions to substantially oppose the respective pairs of upper guide ribs 27A.

The pair of lower guide ribs 28A have substantially a U shape where the opposite direction side to the +Y direction which is the insertion direction for the ink cartridges 70 is linked using ribs 28R with a semicircle arc shape. Then, the pair of lower guide ribs 28A have rib side surfaces 28S, which function as guide surfaces which guide inserting of the ink cartridge 70, at an outer side in the ±X direction. On the other hand, pairs of lower side convex sections 70D are provided in the bottom surface of the ink cartridge 70 at both end sections in the ±X direction, and the pairs of lower side convex sections 70D have lower side inner walls 70B (refer to FIG. 7B and FIG. 9B) which are inner wall surfaces which oppose each other in the ±X direction. Furthermore, the rib side surfaces 28S of the lower guide ribs 28A are provided so as to oppose the lower side inner walls 70B of the lower side convex section 70D of the ink cartridge 70 with a gap. In the ink cartridge 70 which is inserted in the mounting section 20, the upper side surface is positionally aligned in the cartridge holding body 22 in the ±X direction and movement in the +Y direction which is the insertion direction is guided due to the lower side inner walls 70B of the lower side convex sections 70D abutting with the rib side surfaces 28S of the lower guide ribs 28A.

Figure 6A:
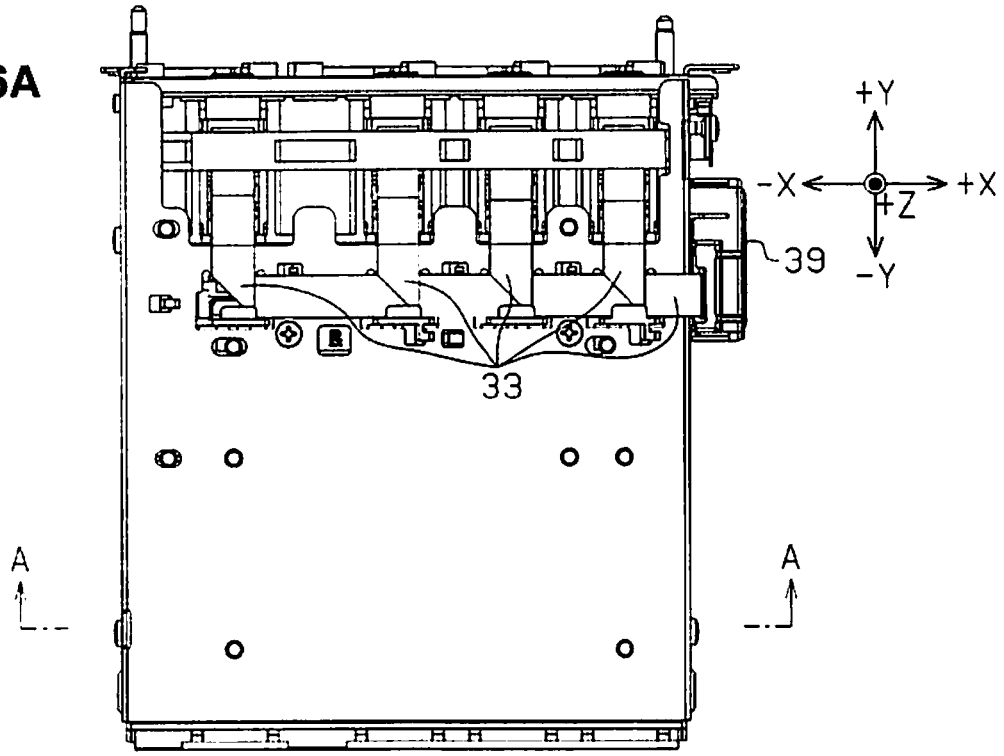
FIGS. 6A to 6C are diagrams illustrating a mounting section.
Figure 6B:
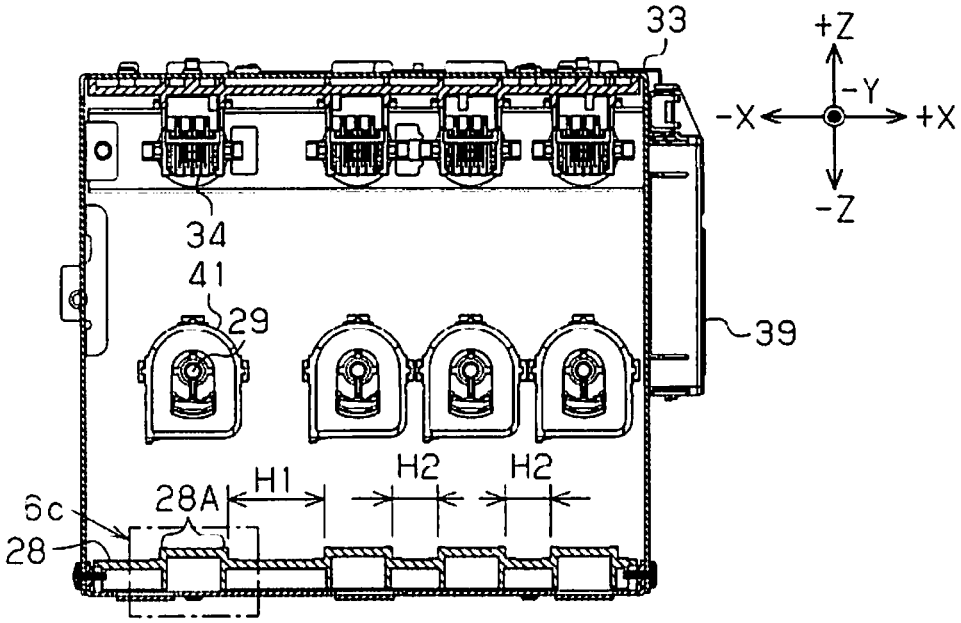
Figure 6C:
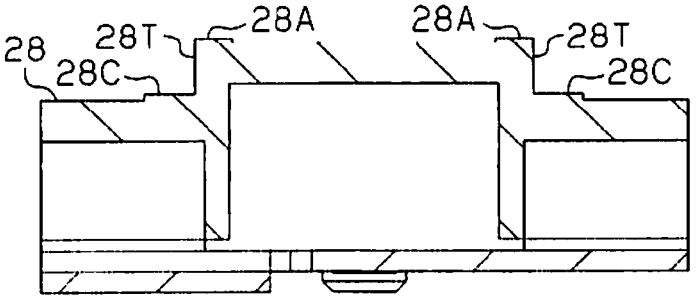

In addition, as shown in FIG. 5 and FIG. 6C, the lower guide ribs 28A with the U shape have pairs of rib sections 28T which are adjacent to the arc shaped ribs 28R in the +Y direction and are provided with specific lengths in the +Y direction. The rib sections 28T are formed to each protrude toward the outer side in the ±X direction and to be thicker than other portions. In addition, stripe shaped rail surfaces 28C, which extend along the +Y direction, are formed as surfaces which protrude from the bottom surface of the bottom member 28 to be adjacent to the outer side of the lower guide ribs 28A in the ±X direction. The function of the rib sections 28T and the stripe shaped rail surfaces 28C of the lower guide ribs 28A will be described later.

Then, as shown in FIG. 5 and FIG. 6B, the lower guide ribs 28A, which correspond to the ink cartridge 70 which is held in the cartridge holding body 22 farthest to the −X direction side, is provided in the bottom member 28 so that the interval with the adjacent lower guide rib 28A is wider than the interval with the lower guide ribs 28A which correspond to the three other ink cartridges 70. That is, in the present embodiment, a gap H1 between the lower guide ribs 28A, which correspond to the ink cartridge 70 which is held farthest to the −X direction side, and the adjacent lower guide ribs 28A is set to be larger than a gap H2 between the three other lower guide ribs 28A. Accordingly, due to the gap H1 being set to be larger than the gap H2 in this manner, it is possible to insert the ink cartridge 70W with a larger width as shown in FIG. 3 at an insertion position for the ink cartridge 70 which is held in the cartridge holding body 22 farthest to the −X direction side. In other words, the gap H1 is set to have an interval so that it is possible to insert the ink cartridge 70W with a larger width.

In addition, as shown in FIG. 3 and FIG. 4, the ink cartridge 70 and the ink cartridge 70W with a larger width are inserted with regard to the cartridge holding body 22 while being positionally aligned in the ±X direction. That is, each of the ink cartridge 70 and the ink cartridge 70W with a larger width are normally positionally aligned in the ±X direction due to an insertion guiding section 27C which is a guiding protuberance which protrudes downward from the top member 27 at an end section of the cartridge holding body 22 on the opening side of the cartridge holding body 22 which is the −Y direction side which is the opposite direction to the +Y direction side of the ink cartridge 70.

On the other hand, as shown in FIG. 2 and FIG. 4, when the ink cartridge 70 is inserted in the cartridge holding body 22 instead of the ink cartridge 70W with a larger width, positionally alignment in the ±X direction using the insertion guiding section 27C is difficult since the width of the ink cartridge 70 in the ±X direction is narrower than the ink cartridge 70W. Therefore, in the present embodiment, guide sections 27B which are a pair of guiding protuberances, which perform positionally alignment of the ink cartridge 70 in the ±X direction by engaging with an upper section on the +Y direction side which is the insertion direction for the ink cartridge 70, are provided in the upper guide ribs 27A. In detail, the upper guide ribs 27A guide the ink cartridge 70 in the cartridge holding body 22 so as to be positioned in the concave sections 70S in the ink cartridges 70. The guide sections 27B are formed in the top member 27 as ribs which protrude downward at end sections on the open side of the cartridge holding body 22 on both sides with regard to the upper guide ribs 27A in the ±X direction which intersects with the +Y direction which is the insertion direction for the ink cartridge 70. The guide sections 27B are provided so that the interval between each of the guide sections 27B in the ±X direction becomes narrower toward the +Y direction. As a result, as shown in FIG. 3, concave grooves 70H, where it is possible for the guide section 27B to be inserted when being inserted in the cartridge holding body 22, is formed in the ink cartridge 70W with a larger width on both sides of the concave section 70S in the ±X direction.

<Configuration of Ink Cartridge>

Next, the configurations of the ink cartridge 70 and the ink cartridge 70W will be described in detail. Here, the configuration of the ink cartridge 70 will be described first, and after this, only the differences with the configuration of the ink cartridge 70 will be described with regard to the ink cartridge 70W with a larger width.

Figure 7B:
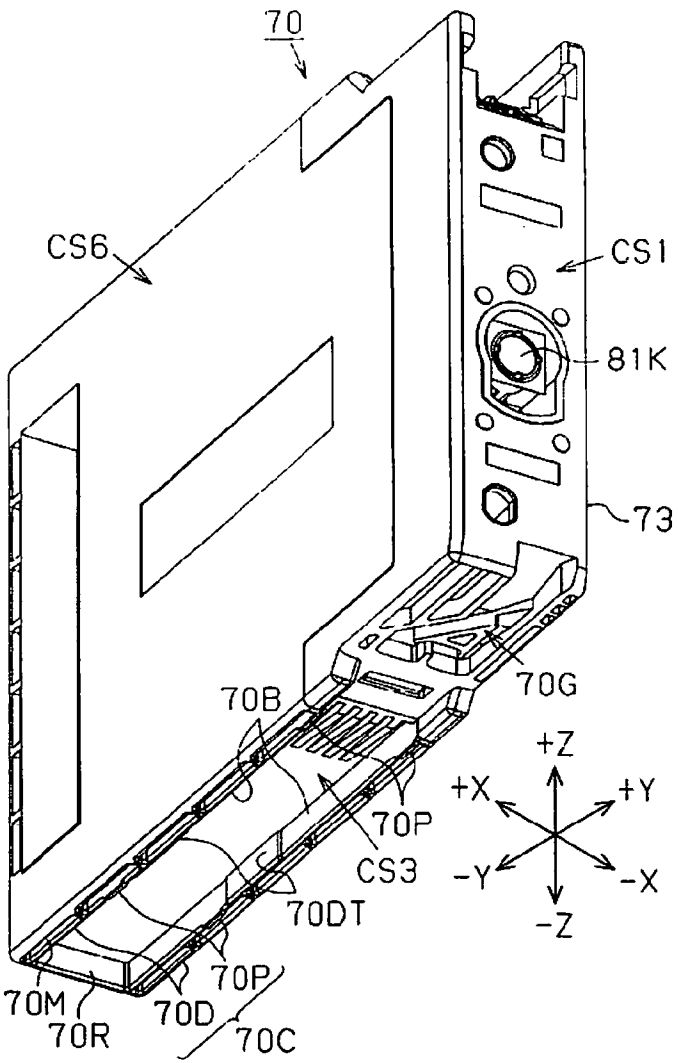
FIGS. 7A and 7B are perspective diagrams illustrating the shape of an ink cartridge.
Figure 7A:
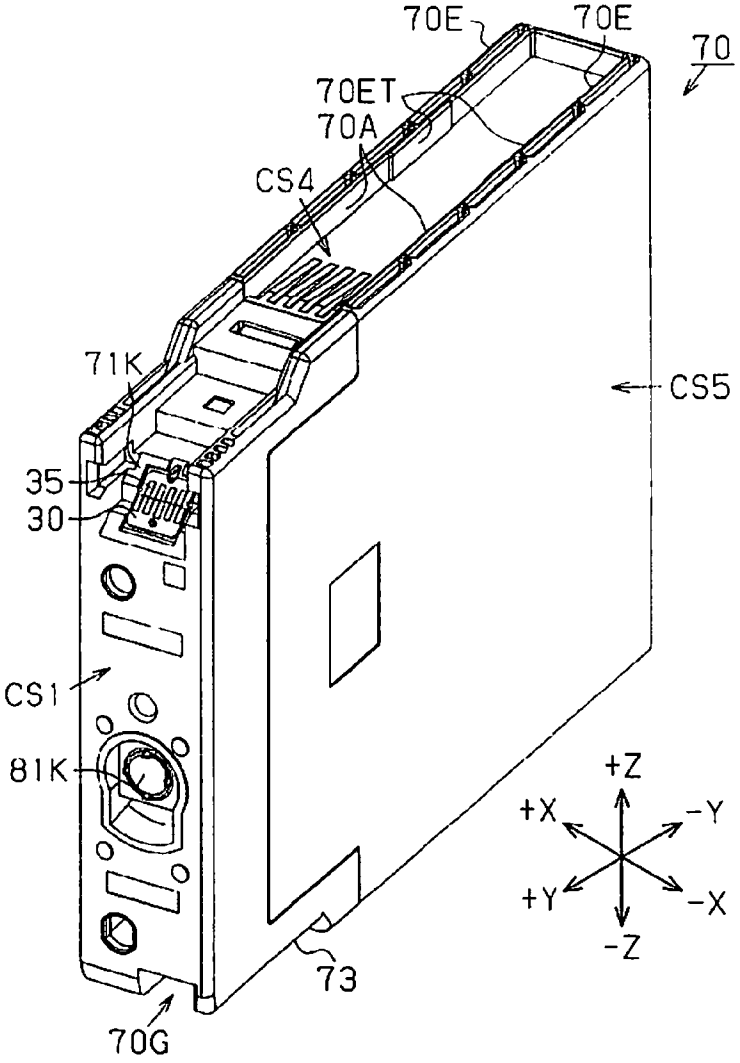

As shown in FIG. 2 and FIGS. 7A and 7B, the ink cartridge 70 has substantially a rectangular cube shape which is formed of six surfaces. That is, the ink cartridge 70 has a first surface CS1 which is the +Y direction side which is the insertion direction into the mounting section 20 and a second surface CS2 which opposes the first surface CS1. Furthermore, the ink cartridge 70 has a third surface CS3 which intersects with the first surface CS1 and the second surface CS2 and which is the gravity direction side in a state of being mounted in the mounting section 20, a fourth surface CS4 which opposes the third surface CS3, a fifth surface CS5 which is an extending surface which extends in a direction which intersects with the first surface CS1, the second surface CS2, and the third surface CS3, and a sixth surface CS6 which is a similar extending surface which opposes the fifth surface CS5. In the present embodiment, the extending surface on the −X direction side viewed from the second surface CS2 side is the fifth surface CS5 and the extending surface on the +X direction side viewed from the second surface CS2 side is the sixth surface CS6.

Figures 8A, 8B, 8C, 8D, 8E:
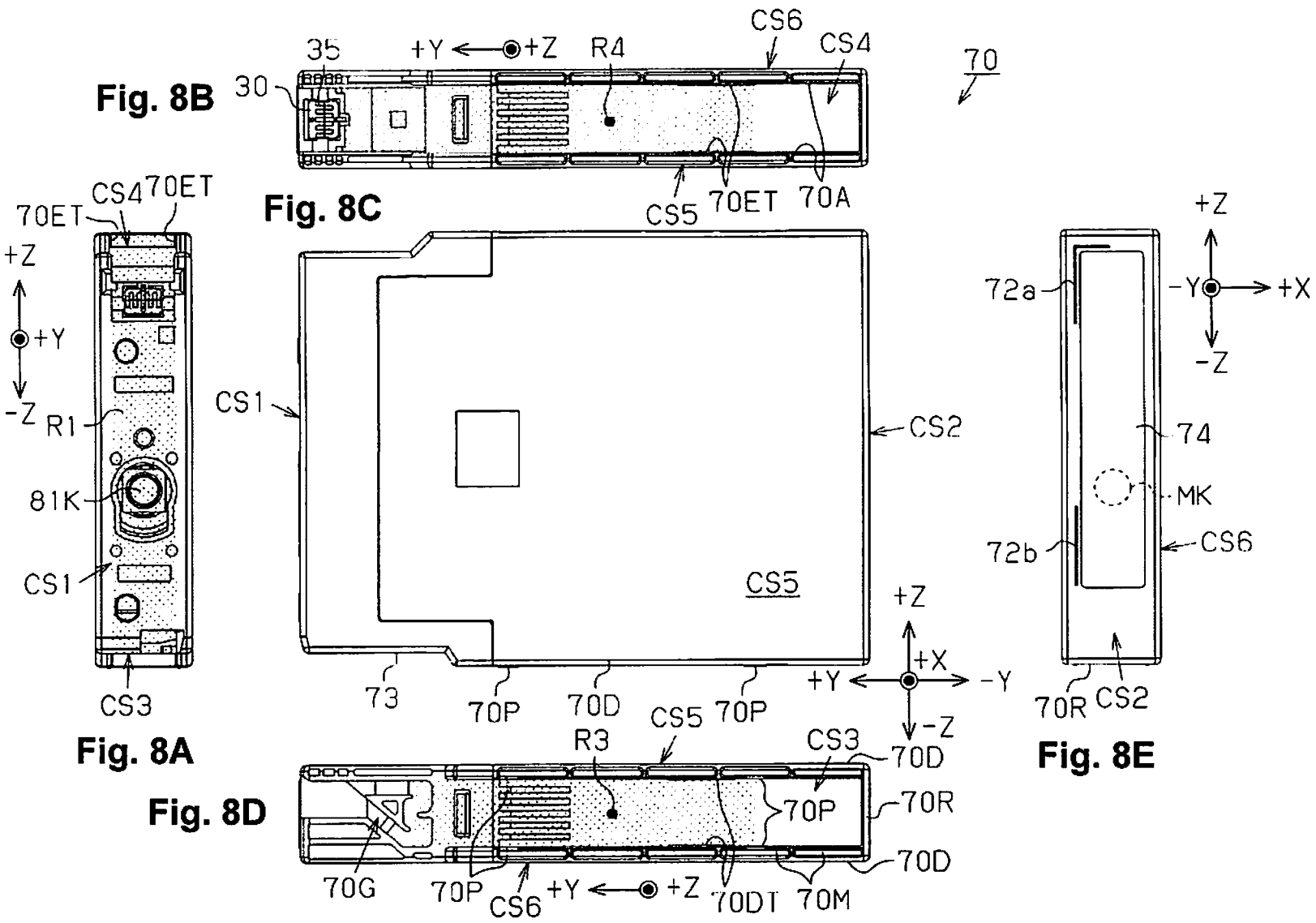
FIGS. 8A to 8E are diagrams illustrating each surface of an ink cartridge.

As shown in FIG. 7A and FIG. 8B, a pair of upper side convex sections 70E are provided in the ink cartridge 70 in the +Y direction at both end sections of the fourth surface CS4, which is the upper surface when mounted in the mounting section 20, in the ±X direction. A pair of upper side inner walls 70A are formed at the inner side of the pair of upper side convex sections 70E in the ±X direction. Furthermore, the pair of upper side convex sections 70E are each provided to extend in the +Y direction on the fifth surface CS5 side and the sixth surface CS6 side. That is, in the present embodiment, the outer side surfaces of the pair of upper side convex sections 70E in the ±X direction are formed as respective portions of the fifth surface CS5 and the sixth surface CS6. Upper convex wall sections 70ET which protrude toward the inner side are each formed in the respective upper side convex sections 70E at positions in the upper side inner walls 70A which oppose each other with specific lengths in the +Y direction. The function of the upper convex wall sections 70ET will be described later.

Then, as shown by the shaded region in FIG. 8B, a circuit board 30, where a first electrode 35 is provided as an electrical connection section which performs electrical connection with the printer 11 (the mounting section 20), is attached to an extending region R4 in the +Y direction in a surface region which is interposed by two of the upper convex wall sections 70ET which oppose each other. In addition, the circuit board 30 is attached with forward and downward inclined posturing toward the +Y direction so as to be closer to the third surface CS3 side and is in a state of being inclined with regard to the +Y direction.

As shown by FIG. 7B and FIG. 8B, the pair of lower side convex sections 70D described above are provided in the third surface CS3, which is the bottom surface when mounted in the mounting section 20, to extend in the +Y direction on the fifth surface CS5 side and the sixth surface CS6 side respectively. In the present embodiment, the lower side inner walls 70B which extend along the +Y direction are configured at the inner side surfaces of the pair of lower side convex sections 70D in the ±X direction. On the other hand, the outer side surfaces of the pair of lower side convex sections 70D in the ±X direction are formed as respective portions of the fifth surface CS5 and the sixth surface CS6. Lower convex wall sections 70DT which protrude toward the inner side are each formed in the respective lower side convex sections 70B at positions which oppose each either with specific lengths in the +Y direction. The function of the upper convex wall sections 70DT will be described later.

Then, as shown by the shaded region in FIG. 8D, a groove section 70G, which is able to engage with a moveable fastening section which is provided in the printer 11 (the mounting section 20), is formed in an extending region R3 in the +Y direction in a surface region which is interposed by two of the lower convex wall sections 70DT which oppose each other.

In addition, as shown by FIGS. 8C and 8D, protuberance sections 70P, where a portion thereof further protrudes from the third surface CS3 to the −Z direction which is the gravity direction, are provided in the third surface CS3 at the respective lower side convex sections 70D which are provided on the fifth surface CS5 side and the sixth surface CS6 side. In the present embodiment, a total of four of the protuberance sections 70P are formed on the bottom surface due to two of the protuberance sections 70P being provided to be spaced with an interval in the +Y direction. In other words, convex sections 70C are configured by the pair of lower side convex sections 70D which are provided to extend along the +Y direction and the protuberance sections 70P which are provided in the lower side convex sections 70D. Then, as will be described later, the convex sections 70C come into contact with the mounting section 20 due to sliding on the stripe shaped rail surfaces 28C which are provided in the bottom member 28.

Here, in the present embodiment, a plurality of rectangular grooves 70M are formed in the lower side convex sections 70D in order to, for example, prevent pulling during molding, and the protuberance sections 70P are provided at portions which are positioned farthest to the inner side of the lower side convex sections 70D, where the rectangular grooves 70M are formed, in the width direction. In addition, the first electrode 35, which is provided in the circuit board 30 which is attached to the fourth surface CS4, is formed so to be positioned between the protuberance sections 70P (the convex sections 70C) which are respectively provided on the fifth surface CS5 side and the sixth surface CS6 side when viewed from the +Y direction in a state where the ink cartridge 70 is mounted in the mounting section 20. The circuit board 30 where the first electrode 35 is provided functions as an electrical connection section which is able to electrically connect with a connector which is provided on the printer 11 side.

Furthermore, as shown in FIG. 7B and FIGS. 8D and 8E, a linking rib 70R which links two of the lower side convex sections 70D is formed in the ink cartridge 70 of the present embodiment as a second convex section, when the convex section 70C which is provided on the third surface CS3 is a first convex section, which is positioned between first convex sections viewed from the +Y direction. The linking rib 70R is provided in the third surface CS3 on the second surface CS2 side in the opposite direction to the +Y direction. Here, in the present embodiment, the linking rib 70R is formed to protrude so that the height from the third surface CS3 is the same height as the lower side convex section 70D and is provided so as to configure a portion of the second surface CS2.

As shown in FIGS. 7A and 7B and FIGS. 8A, 8B, and 8D, a liquid supply opening 81K, where it is possible for ink to flow to the outside from an ink chamber IS (refer to FIG. 12) which is an example of a liquid containing chamber which is provided in the ink cartridge 70, is provided to be arranged in the first surface CS1 of the ink cartridge 70 in a surface region R1 which intersects with the extending region R3 and the extending region R4. That is, as shown by the shaded region in FIG. 8A, the surface region R1 in the first surface CS1 is a region which is continuous with the extending region R3 and the extending region R4 and the liquid supply opening 81K is provided in the surface region R1 at a position which is closer to the third surface CS3 than the fourth surface CS4. Here, in the present embodiment, the liquid supply opening 81K is provided at the center of the surface region R1 in the width direction and in substantially the center between the fifth surface CS5 and the sixth surface CS6.

As shown in FIG. 2 and FIG. 8E, positioning marks 72*a* and 72*b*, which indicate the positions for adhering a label 74 which is for identifying the ink cartridge 70, are formed in the second surface CS2 on the −Y direction side. The positioning marks 72*a* and 72*b* are formed with a convex shape or a concave shape with regard to the surface of the second surface CS2 and it is possible for a user to easily adhere the label 74 at an appropriate position on the second surface CS2 with the positioning marks 72*a* and 72*b* as markers.

In addition, although omitted from the diagram, it is possible for a mark MK, which indicates the position for a user to press when inserting the ink cartridge 70 in the mounting section 20, such as the letters for "press", to be written on the label 74 which is adhered to the second surface CS2. Here, it is preferable for the mark MK to be written in the label 74 which is adhered to the second surface CS2 at a position which opposes the liquid supply opening 81K which is provided in the first surface CS1 as shown by the dashed line circle in FIG. 8E.

Figure 9B:
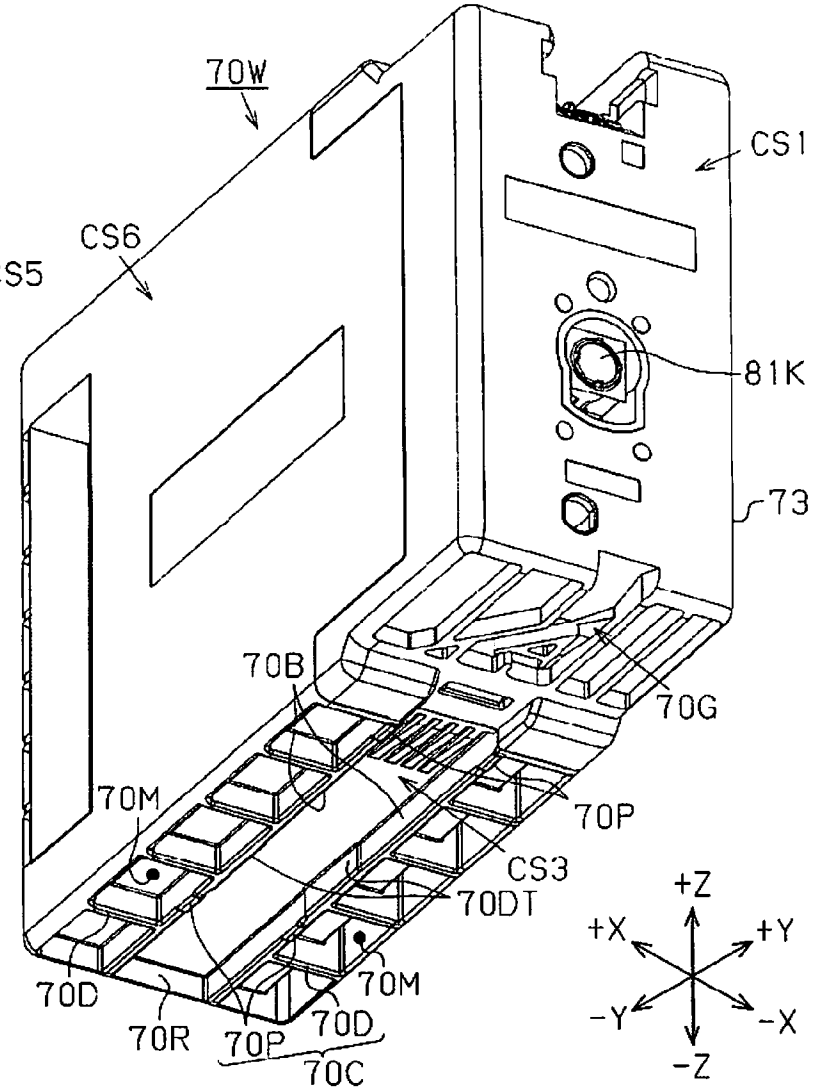
FIGS. 9A and 9B are perspective diagrams illustrating the shape of an ink cartridge with a larger width.
Figure 9A:
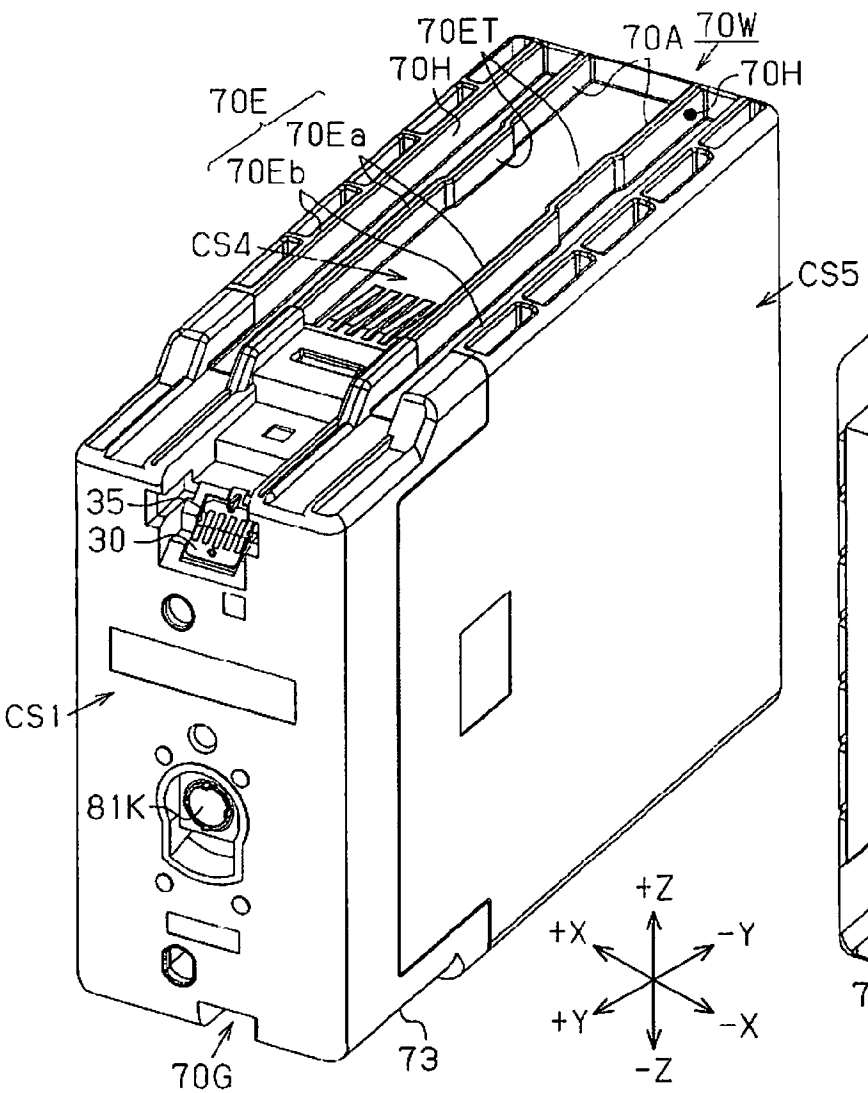

Next, as shown in FIG. 3 and FIGS. 9A and 9B, the liquid supply opening 81K, the groove section 70G, the circuit board 30, and the label 74 in the ink cartridge 70W with a larger width have the same shape with regard to the ink cartridge 70, and the ink cartridge 70W with a larger width is a shape where the casing member 73 is wide in the width direction (the ±X direction). Accordingly, the shapes of the fifth surface CS5 and the sixth surface CS6 of the ink cartridge 70W with a larger width is the same shape as the ink cartridge 70 and the shapes of the first surface CS1, the second surface CS2, the third surface CS3, and the fourth surface CS4 of the ink cartridge 70W with a larger width are different to the ink cartridge 70.

In the present embodiment, the first surface CS1 where the liquid supply opening 81K is provided and the second surface CS where the label 74 is adhered are shapes where the casing member 73 is provided to extend with a length which is equal at both sides in the width direction. In addition, the third surface CS3 is a shape where the width of the lower side convex sections 70D are wider. In the lower side convex sections 70D which are wider, the protuberance sections 70P are provided at portions which are positioned farthest to the inner side in the width direction and are at the same positions as in the ink cartridge 70.

The fourth surface CS4 is different to the third surface CS3, and the pair of upper side convex sections 70E are configured using two substantially parallel convex sections of an inner side convex section 70Ea and an outer side convex section 70Eb which have a gap from each other in the ±X direction which is the width direction. Out of the two of the inner side convex section 70Ea and the outer side convex section 70Eb, the upper convex wall sections 70ET is provided in the inner side convex section 70Ea which is positioned on the inner side in the width direction with regard to the outer side convex section 70Eb and is provided to extend with the same positioning and shape as in the ink cartridge 70. In addition, the gap between the inner side convex section 70Ea and the outer side convex section 70Eb is a concave groove 70H which is a groove section which extends along the +Y direction. The concave groove 70H is provided as a groove where it is possible for the guide section 27B which is a guiding protuberance to be inserted when inserting in the cartridge holding body 22. In addition, the inner side convex section 70Ea is configured so that it is possible to be inserted between the upper guide rib 27A and the guide section 27B and the upper side inner wall 70A is guided by the upper guide rib 27A. In this manner, in the present embodiment, the upper side convex section 70E and the concave groove 70H are provided in the ink cartridge 70W in the fourth surface CS4 which is one of the side surfaces.

<Configuration of Mechanisms for Mounting Ink Cartridge in Mounting Section>

Here, an electrode connecting mechanism which transfers, for example, information data such as data which accompanies the consumption of ink with regard to the first electrode 35, which is provided in the ink cartridge 70 (70W) which is inserted, through an electrode connection section which are connected, and a flow path connecting mechanism, where ink flows from the liquid supply opening 81K of the ink cartridge 70 (70W) which is inserted, are provided in the mounting section 20 of the present embodiment. In addition, a holding mechanism is provided which holds the ink cartridge 70 (70W) which is inserted so as to not fall out from the cartridge holding body 22. Next, the electrode connecting mechanism, the flow path connecting mechanism, and the holding mechanism will be described with reference to the drawings with a case where the ink cartridge 70 is mounted as an example. It is obvious that the case where the ink cartridge 70W is mounted is the same.

First, the configuration of the electrode connecting mechanism will be described.

Figure 10A:
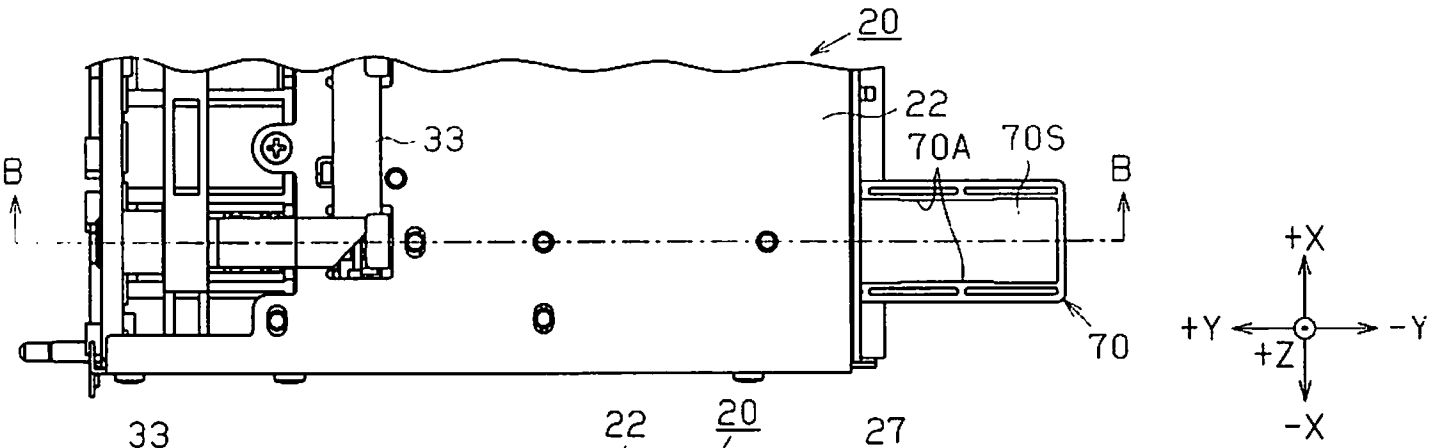
FIGS. 10A and 10B are diagrams illustrating a state where an ink cartridge is partially inserted in a mounting section.
Figure 10B:
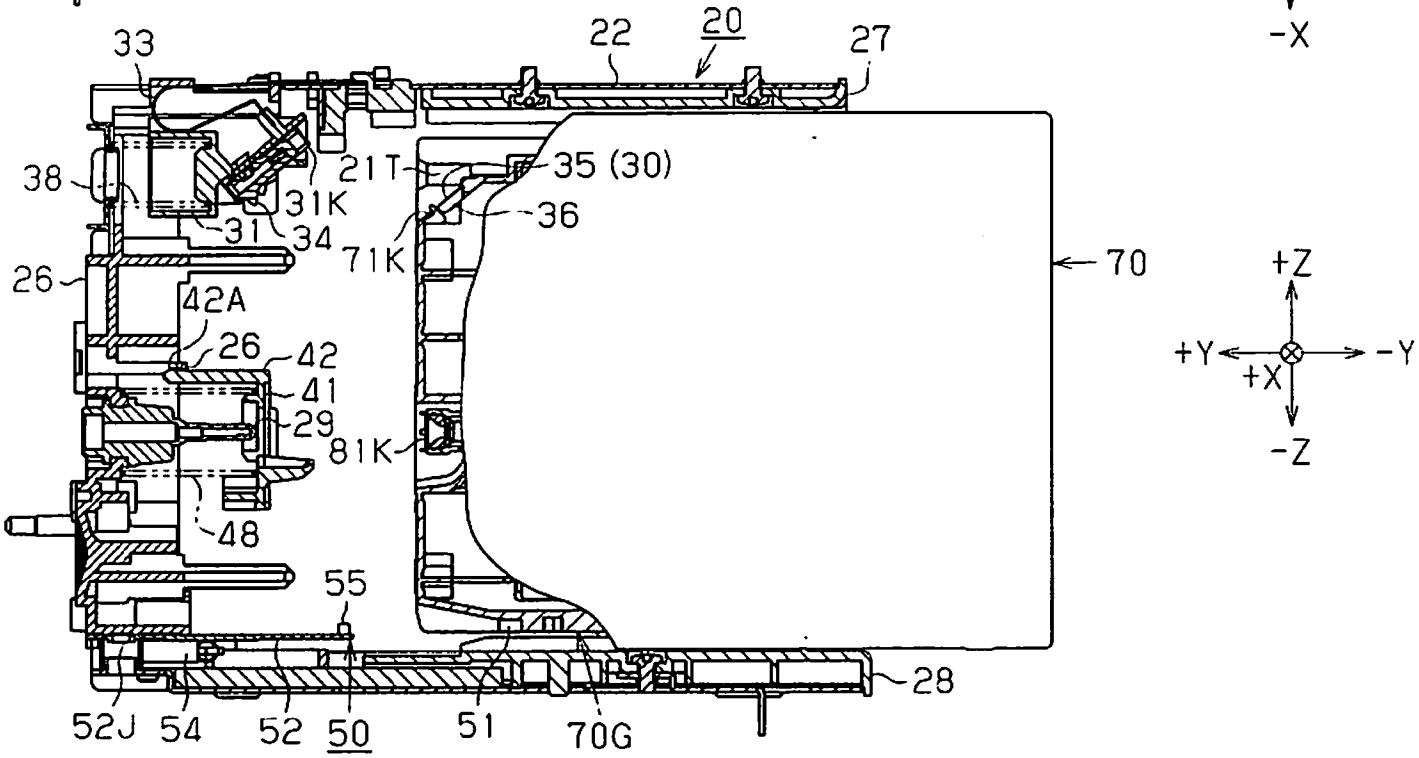

As shown in FIG. 4 and FIGS. 10A and 10B, a wall member 26 which extends in a direction which is orthogonal to the +Y direction is formed on an inner far side (the +Y direction side), which is opposite to the opening side of the cartridge holding body 22 with a box shape, as a portion which configures a far wall surface of the cartridge holding body 22, and a second electrode 34 is provided as an electrical connection section on the mounting section 20 side on the side of the wall member 26. The first electrode 35 which is the electrical connection section which is provided in the ink cartridge 70 electrically connects by abutting with regard to the second electrode 34. Then, due to the electrical connection between the first electrode 35 and the second electrode 34, information data, which is sent from a wiring board 33 such as a flexible board through the second electrode 34, is stored by being transferred to the storage element 36 which is the storage apparatus which is provided in the ink cartridge 70 through the first electrode 35.

In detail, as shown in FIG. 4, a moveable member 31 which is able to move by sliding along the +Y direction is provided in the wall member 26 of the cartridge holding body 22. That is, a pair of slide guide sections 26A with a guide hole (which is not shown in the diagrams) which are provided along the +Y direction are formed in the wall member 26 so as to correspond with each of the ink cartridges 70. A pair of slide sections 32, where a portion is formed as a sliding section (which is not shown in the diagram) which slides in the guide hole, are provided in the moveable member 31. Accordingly, a sliding mechanism is configured by the slide sections 32 moving along the slide guide sections 26A (the guide holes), and the moveable member 31 moves along the +Y direction. Here, the moveable member 31 regulates movement to the +Y direction side due to the rear end sections of the slide sections 32 abutting with the slide guide sections 26A.

In addition, in the present embodiment, an inclined surface 71K, which is inclined so as to intersect with regard to the +Y direction, is formed in the ink cartridge 70 as shown in FIG. 4, FIG. 7A, and FIGS. 10A and 10B at an end section of the fourth surface CS4 on the +Y direction side toward the cartridge holding body 22. The first electrode 35 is provided on the inclined surface 71K. In addition, an opposing section 31K, which opposes the first electrode 35 when the ink cartridge 70 is inserted in the cartridge holding body 22, is formed on the front side (in the opposite direction to the +Y direction) of the moveable member 31. Furthermore, the second electrode 34 is provided on the opposing section 31K. Then, the moveable section 31 is provided at a position where it is possible for the second electrode 34 to abut with regard to the first electrode 35 when moved by sliding along the +Y direction on the wall member 26.

Here, in the present embodiment, the first electrode 35 which is the electrical connection section is a metal pattern which is formed on the circuit board 30, where the board surface is provided to be arranged along the inclined surface 71K of the ink cartridge 70, in more detail, is formed on the board surface. Then, a memory which is an IC chip which is provided on the circuit board 30 functions as the storage element 36. In addition, the second electrode 34 is a metal plate which is attached to the opposing section 31K of the moveable member 31 in a state of one end being held and it is possible for the connection portion (abutting portion) with the first electrode 35 to be slightly displaced so that the metal plate reliably abuts with the first electrode 35.

In addition, the area of the board surface along the inclined surface 71K in the circuit board 30, which is provided on the inclined surface 71K which is inclined with regard to the +Y direction, is large compared with the projection area of the inclined surface 71K in the +Y direction. Accordingly, it is possible to form a plurality of metal patterns on the board surface of the circuit board 30.

The moveable member 31 of the present embodiment presses the opposing section 31K in a direction to be closer to the first electrode 35 of the ink cartridge 70 (here, the opposite direction to the +Y direction). That is, a second pressing member 38, which presses the moveable member 31 in the −Y direction, that is, in a direction where the opposing section 31K is closer to the first electrode 35, is provided in the wall member 26. Here, in the present embodiment, a compressed coil spring is used as the second pressing member 38 and the moveable member 31 is in a state of being pressed by the second pressing member 38 in a state where movement to the front direction is regulated.

Here, as shown in FIG. 5 and FIGS. 6A and 6B, the wiring board 33 performs communication of specific information with the control section which is provided in the printer 11 through a relay device 39 which is attached to one of the side surfaces of the cartridge holding body 22. The electrode connecting mechanism is configured in this manner.

Next, the configuration of the flow path connecting mechanism will be described.

As shown in FIG. 4, due a supply needle 29 which is provided in the wall member 26 being inserted in the liquid supply opening 81K which is provided in the ink cartridge 70, ink which is contained in the ink chamber IS in the ink cartridge 70 flows into the inside of the supply needle 29. Ink which flows into the inside of the supply needle 29 is supplied to the liquid ejecting head 18 using a liquid supply mechanism which is not shown in the diagrams through a flow path (which is not shown in the diagrams) which is formed in the wall member 26.

In addition, as shown in FIG. 4 and FIG. 10B, a moving body 41, which is provided to be arranged to surround the supply needle 29 and is able to move along the +Y direction, and a first pressing member 48, which is a first surface pressing member which presses the moving body 41 in the −Y direction, are provided in the mounting section 20. In the present embodiment, the first pressing member 48 uses a compressed coil spring and is provided to be arranged in the wall member 26 so that the supply needle 29 is positioned at the inner side of the coil shape.

Accordingly, the first pressing member 48 functions as the first surface pressing member which presses the first surface CS1 of the ink cartridge 70 due to the moving body 41 abutting with regard to the ink cartridge 70 which is inserted. Then, a portion, which is centered on the liquid supply opening 81K in the first surface CS1 which abuts with the moving body 41, functions as a first surface pressed member. Here, in the present embodiment, the liquid supply opening 81K is provided in the first surface CS1 at a position which is closer to the third surface CS3 than the fourth surface CS4. Accordingly, the first surface pressed member is positioned in the first surface CS1 in the same manner at a position which is closer to the third surface CS3 than the fourth surface CS4.

Here, in the present embodiment, three protruding sections 42 which are provided along the +Y direction are formed in the moving body 41 and the moving body 41 moves along the +Y direction due to each of the protruding sections 42 moving along three groove sections 26B which are provided in the wall member 26. In addition, the moving body 41 regulates movement to the +Y direction side due to rear end sections 42A of each of the protruding sections 42 abutting with the wall member 26. The flow path connecting mechanism is configured in this manner.

Next, the configuration of the holding mechanism will be described.

After the ink cartridge 70 which is inserted in the cartridge holding body 22 abuts with the moving body 41, a pressing force is generated in the mounting section 20 of the present embodiment in the −Y direction in order for the first pressing member 48 to be compressed to accompany the movement of the ink cartridge 70 in the +Y direction. The pressing force which is generated acts as a force to press back the ink cartridge 70 through the moving body 41. As a result, it is difficult for the ink cartridge 70 to be held in the cartridge holding body 22 in a state of being pushed against the pressing force of the first pressing member 48. Therefore, in the present embodiment, the holding mechanism is provided so that the ink cartridge 70, which is pushed in the cartridge holding body 22, does not fall out.

Figure 11A:
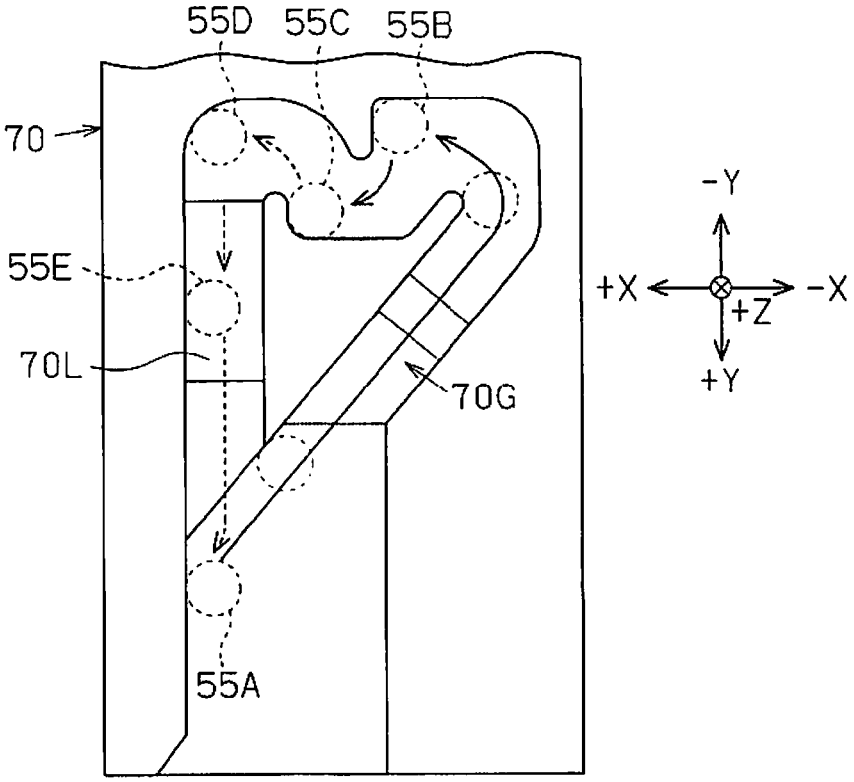
FIG. 11A is a partial bottom surface diagram illustrating a groove section of an ink cartridge which is engaged with a moveable fastening section and FIG. 11B is a schematic diagram illustrating a configuration of a lever member which functions as a movable fastening section which is provided in a mounting section.
Figure 11B:
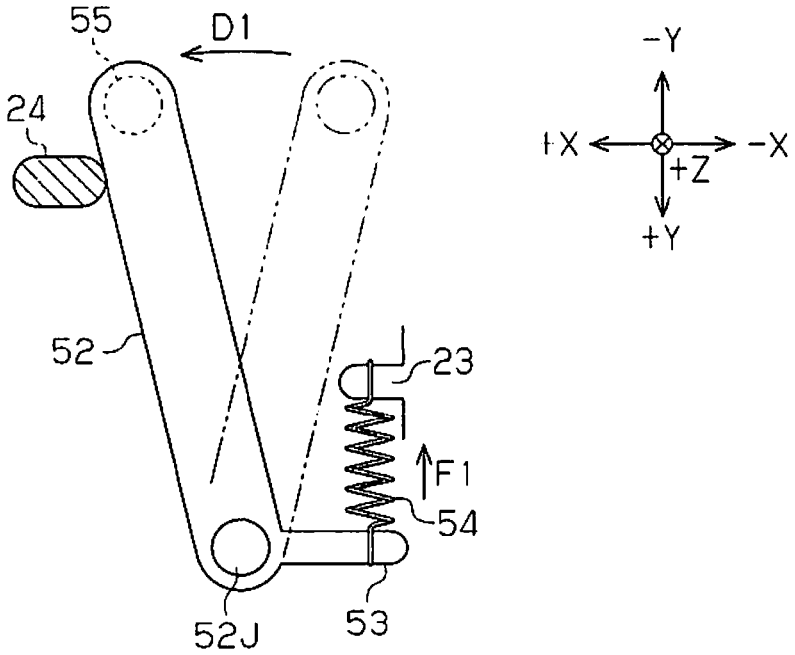

As shown in FIG. 10B and FIGS. 11A and 11B, the holding mechanism is configured using the groove section 70G which is provided in the third surface CS3 (the bottom surface) of the ink cartridge 70 and a lever member 52 which is the moveable fastening section which is pivotally supported by the cartridge holding body 22 (the bottom member 28) to rotate freely. That is, the groove section 70G of the ink cartridge 70 has a cam shape and the ink cartridge 70 is held by being fastening with the mounting section 20 by the groove section 70G which has the cam shape engaging with regard to the lever member 52.

The lever member 52 rotates centered on a shaft section 52J which has an axis which is orthogonal to the inner bottom surface of the cartridge holding body 22 where a base end side of the lever member 52 is formed, and a pin 55, which is formed on the upper side at a front end side which is opposite to the base end side of the lever member 52, swings. Then, the lever member 52 is normally pressed so as to swing in one direction D1 (here, a counterclockwise direction viewed from below) centered on the shaft section 52J due to a tension force F1 of a spring 54 which is provided to span between a hanger section 53 which is formed on the lever member 52 and a hanger section 23 which is provided on the cartridge holding body 22. As a result, the pin 55 which is formed in the lever member 52 is normally pressed to swing in the one direction D1. Here, rotating of the lever member 52 in the one direction D1 is regulated using a regulating section 24 which is provided in the cartridge holding body 22.

In the holding mechanism which is configured in this manner, the pin 55 moves in the order of a path which is set by the groove section 70G with a cam shape to accompany the inserting of the ink cartridge 70 in the cartridge holding body 22 as shown by the dashed line circles in FIG. 11A. In other words, the groove section 70G in the ink cartridge 70 functions as a cam and the pin 55 in the lever member 52 functions as a cam follower.

That is, the pin 55 in the ink cartridge 70 is in a state of moving from a start position which is indicated by the reference numeral 55A to a position which is indicated by the reference numeral 55B by moving as shown by the solid line arrows in FIG. 11A when the ink cartridge 70 is pushed in the cartridge holding body 22 against the pressing force of the first pressing member 48. Then, when pushing is terminated in this state, the ink cartridge 70 is slightly pressed back to the front by the first pressing member 48, and the pin 55 moves along the cam shape of the groove section 70G by swinging in the one direction D1 and moves to a position which is indicated by the reference numeral 55C. This position is a regulating position where movement of the pin 55 is regulated by the groove section 70G, and due to the pin 55 moving to the regulating position, the ink cartridge 70 is held in the regulated state, where movement in an extraction direction (here, the −Y direction) which is opposite to the +Y direction is regulated due to the pressing force of the first pressing member 48. That is, due to the pin 55 moving to the regulating position, the groove section 70G is fastened with the pin 55 in the lever member 52 and the ink cartridge 70 is in a holding state where movement in the extraction direction from the mounting section 20 is regulated.

In the present embodiment, the holding state of the ink cartridge 70 is a mounting state of the ink cartridge 70 in the mounting section 20, and in the mounting state, the lever member 52 generates a pressing force on the ink cartridge 70 which pushes up the pin 55 in the groove section 70G. That is, the lever member 52 is configured so that the lever member 52 abuts in a state of being pressurized with regard to the groove section 70G so that reliable movement is possible along the cam shape of the groove section 70G. Accordingly, the lever member 52 functions as a moveable fastening section and also functions as a third surface pressing member which presses the third surface. Then, the groove section 70G functions as the third surface pressed section which is pressed by the lever member 52.

After this, when the ink cartridge 70 which is in the mounting state is again pushed in the +Y direction in the cartridge holding body 22 against the pressing force of the first pressing member 48, restricting with regard to the movement of the pin 55 in the groove section 70G is terminated and the pin 55 moves from the restricting position to a position which is indicated by the reference numeral 55D in FIG. 11A. Then, when pushing of the ink cartridge 70 is terminated with movement to the position which is indicated by the reference numeral 55D, the ink cartridge 70 is pressed back in the extraction direction (the −Y direction) by the first pressing member 48 and the pin 55 moves from the position which is indicated by the reference numeral 55D to a position which is indicated by the reference numeral 55E. Furthermore, to accompany the ink cartridge 70 moving in the extraction direction due to the pressing force of the first pressing member 48, the pin 55 moves to an inclined section 70L while being pressed downward along the inclined section 70L which is formed with a cam shape and returns from the position which is indicated by the reference numeral 55E to the start position which is indicated by the reference numeral 55A as shown by the dashed line arrows in FIG. 11A. In this manner, the pin 55 repeatedly moves between the start position and the restricting position in the holding mechanism to accompany the operation of the ink cartridge 70 being pressed. The holding mechanism is configured in this manner.

<Configuration of Members in Ink Cartridge>

Next, the configuration of the ink cartridge 70 and the ink cartridge 70W with a larger width will be described.

Figure 12:
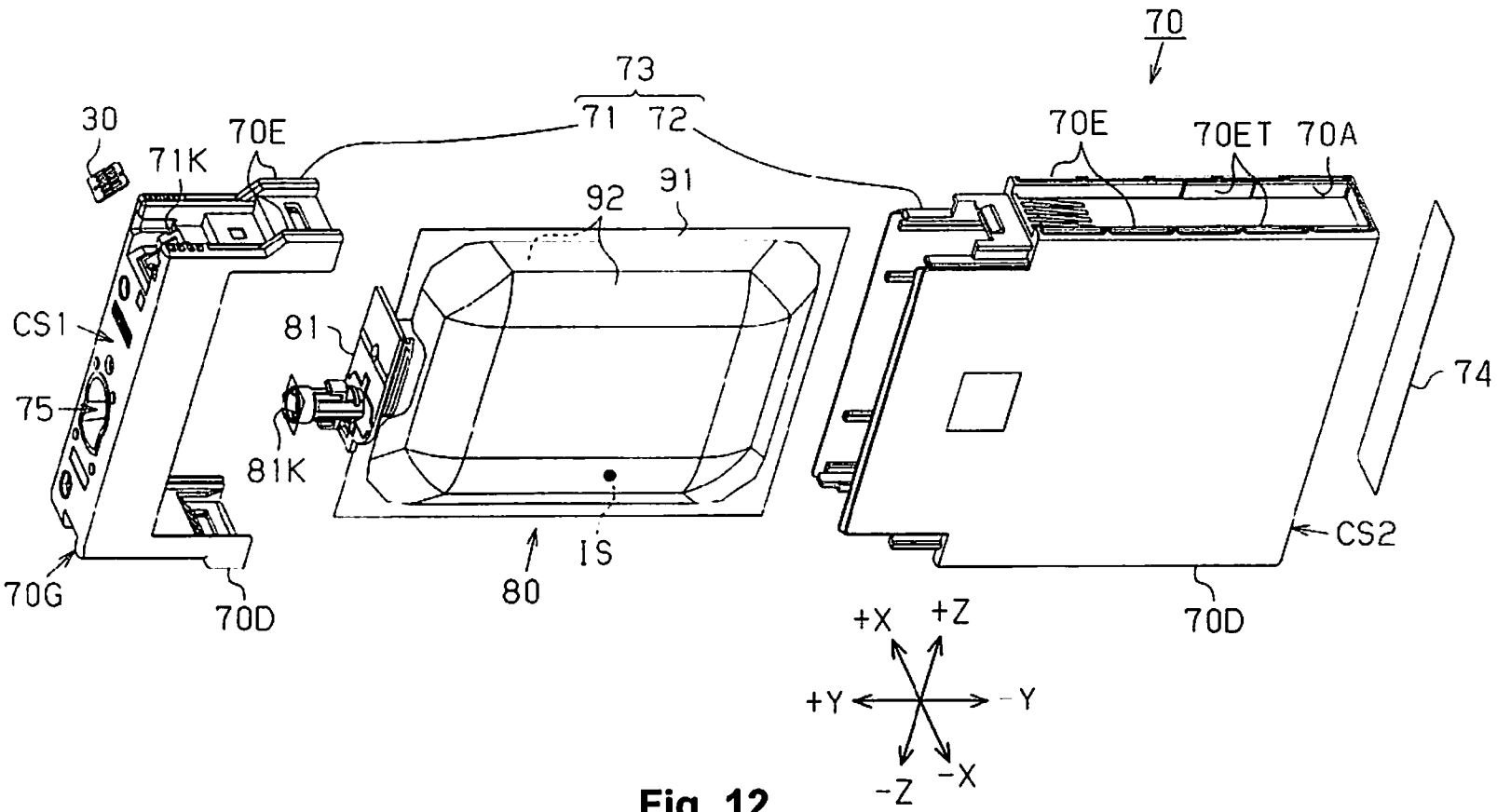
FIG. 12 is an exploded perspective diagram illustrating a configuration of an ink cartridge.

As shown in FIG. 12, the ink vessel 80 which is the liquid containing vessel is contained in the ink cartridge 70 in the casing member 73 where two members of a first casing member 71 on the +Y direction side and a second casing member 72 on the opposite direction side to the +Y direction are combined. The inclined surface 71K, where it is possible for the circuit board 30 to be attached at an end section on the +Y direction side, is provided in the first casing member 71 on the upper surface side which is the +Z direction side when mounted in the mounting section 20, and the groove section 70G is provided in the first casing member 71 on the lower surface side. In addition, the liquid supply opening 81K is provided in the surface of the first casing member 71 on the +Y direction side, that is, the first surface CS1, through a through hole 75H (refer to FIG. 21A and FIG. 22A) in a through hole forming section 75 which is provided in the first casing member 71 due to a first supply member 81 which is a supply member which is provided with the liquid supply opening 81K being supporting by being combined with the first casing member 71. The label 74 is adhered in the second casing member 72 on a surface on the opposite direction side to the +Y direction, that is, on the second surface CS2 which opposes the first surface CS1. The ink cartridge 70 is completed by the second casing member 72 being combined with regard to the first casing member 71 which supports the ink vessel 80 by being moved by sliding in the +Y direction.

The ink vessel 80 is formed in a state of a so-called ink pack where the opening side of a pack body 91 with a bag shape which is an example of a containing chamber member is joined with regard to the first supply member 81, and the inside of the ink vessel 80 is the ink chamber IS which is an example of the liquid containing chamber which it is possible for ink to be contained. In the present embodiment, the pack body 91 is formed using film which is an example of a flexible member and two pack members 92 with a rectangular thin plate shape, which extend in a direction which intersects with the ±X direction, are formed initially in a bag shape by fusing three of the four outer sides. Then, the inside of the pack body 91 becomes the ink chamber IS by the pack body 91 being joined with the first supply member 81 due to one side on the opening side being fused together with the first supply member 81 in a state where the first supply member 81 is inserted in the opening side of the bag which is formed. Accordingly, the pack body 91 which has flexibility changes shape so that the gap with the two pack members 92 which oppose each other in the ±X direction is reduced to accompany a reduction in the volume of the ink chamber IS due to ink flowing out.

Figure 13:
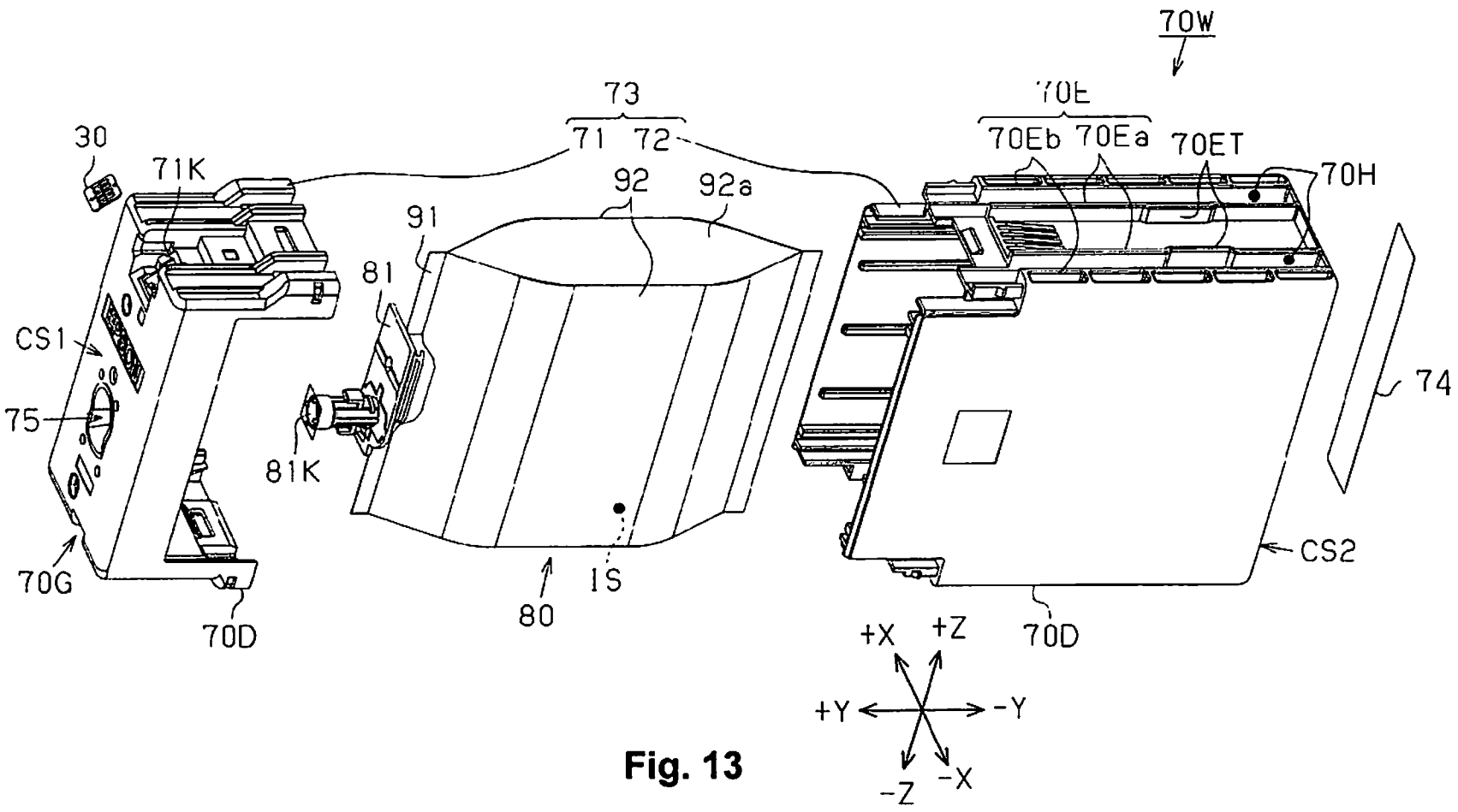
FIG. 13 is an exploded perspective diagram illustrating a configuration of an ink cartridge with a larger width.

As shown in FIG. 13, the ink vessel 80 which is the liquid containing vessel is contained in the ink cartridge 70W with a larger width in the same manner as in the ink cartridge 70 in the casing member 73 where the two members of the first casing member 71 on the +Y direction side and the second casing member 72 on the opposite direction side to the +Y direction are combined. The first casing member 71 and the second casing member 72 in the ink cartridge 70W are configured in the same manner as the first casing member 71 and the second casing member 72 in the ink cartridge 70 except for the respective widths being different. Then, out of the configuration of the ink vessel 80, the shape of the pack body 91 is configured to be different to the shape in the ink cartridge 70 to correspond to the width which is larger.

That is, in the pack body 91 which is formed in the ink vessel 80 of the ink cartridge 70W, the pack members 92 are a cylindrical shape with a matching portion 92*a*, which is folded in the up and down direction which intersects with the +Y direction, which passes through in the +Y direction. Then, after the pack members 92 with the cylindrical shape are formed in a bag shape by the opposite side to the +Y direction side being fusing, the remaining opening side in the +Y direction is joined by fusing with regard to the first supply member 81. Accordingly, the ink chamber IS is formed so that the pack bag 91 of the ink cartridge 70W has a relatively large volume by the matching portion 92*a* being extended in a state where ink is contained in the ink chamber IS. In addition, since the matching portion 92*a* shrinks to return to the state of being folded to accompany the reduction in volume of the ink chamber IS due to ink flowing out, there is a change in shape in the pack body 91 so as to reduce the gap between the pack members 92 which oppose each other in the ±X direction.

<Configuration of Members in Ink Vessel>

Next, the configuration of the members in the ink vessel 80 will be described. Here, in the present embodiment, only the pack body 91 is different in the ink cartridge 70 and the ink cartridge 70W and the configuration of the other members is the same.

Figure 14A:
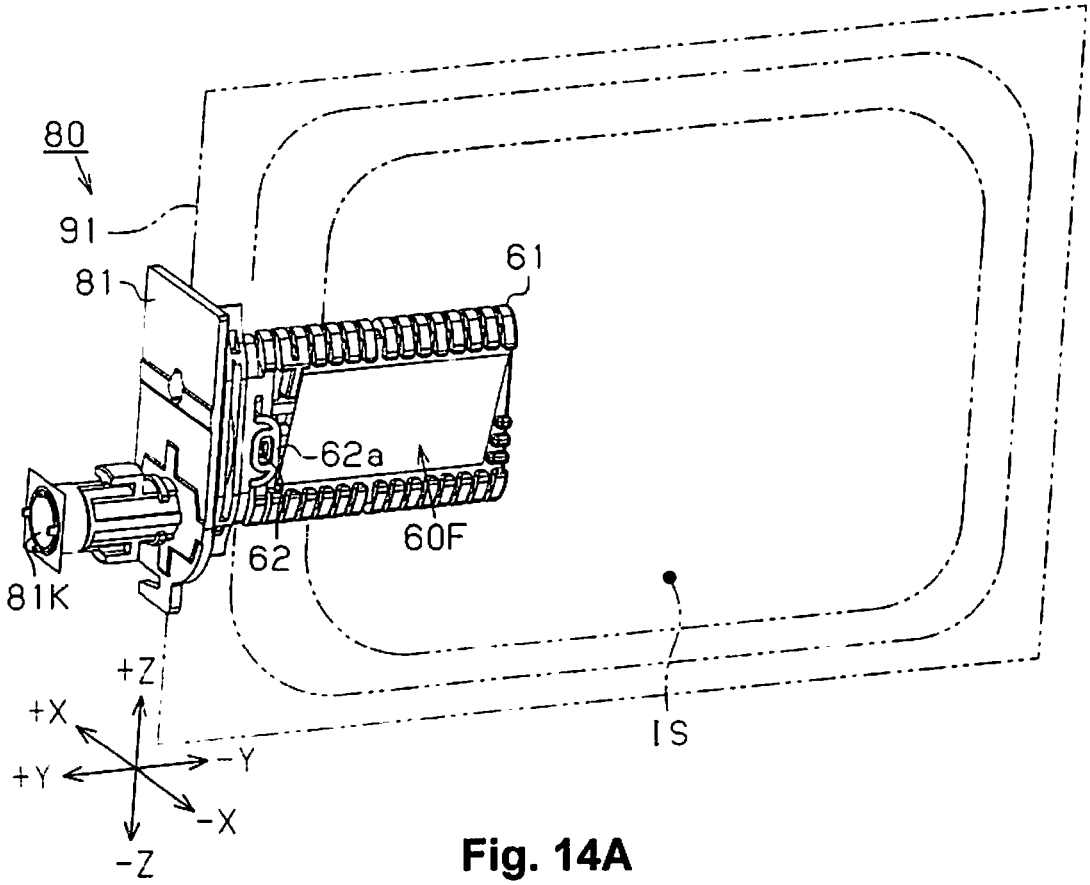
FIGS. 14A and 14B are diagrams illustrating an ink vessel which is provided inside an ink cartridge and FIGS. 14A and 14B are perspective diagrams of an ink vessel viewed in states which are the reverse of each other.
Figure 14B:
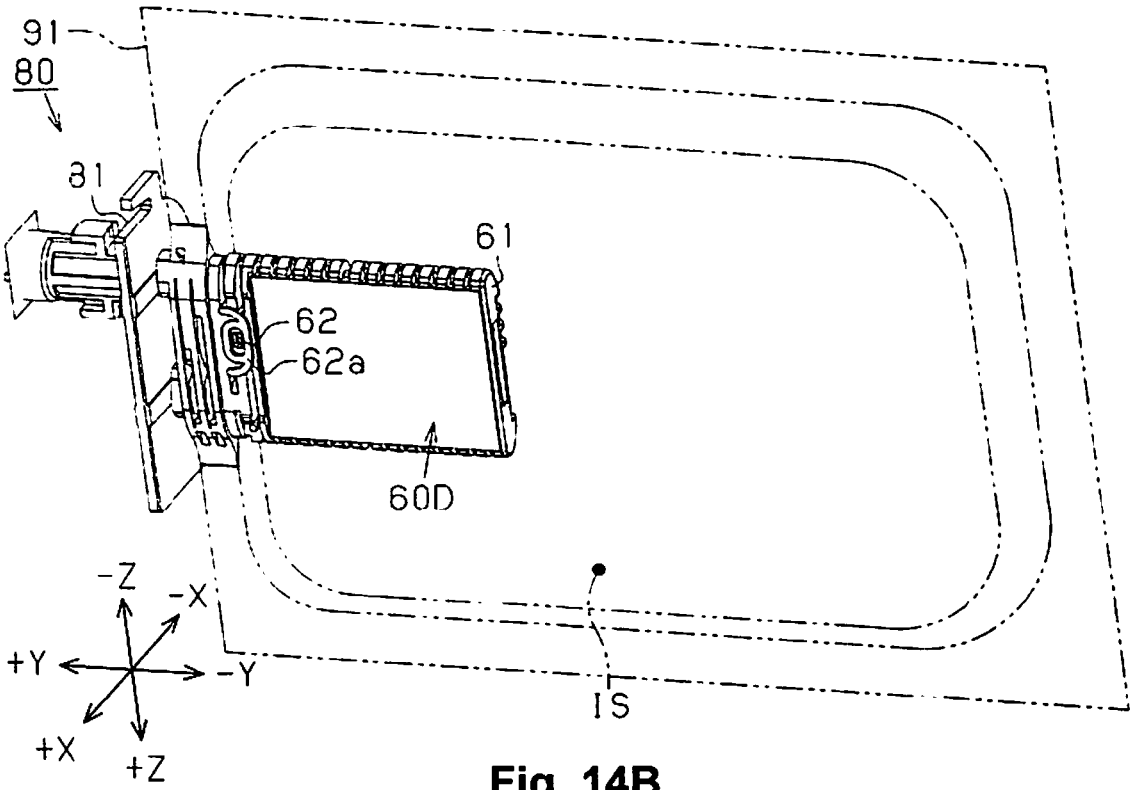

As shown in FIGS. 14A and 14B, the ink vessel 80 is provided with a filter chamber 60F and a low pressure chamber 60D in the ink chamber IS which is a space for containing ink which is formed with the first supply member 81 where the liquid supply opening 81K is formed and the pack body 91 which is joined to the first supply member 81. In the present embodiment, the filter chamber 60F and the low pressure chamber 60D are formed in a second supply member 61 which is configured to be able to be connected with the first supply member 81 and are provided to be arranged at positions which overlap when viewed from a direction which is the ±X direction when mounted in the mounting section 20, that is, positions with a front and back relationship to each other.

An injection opening 62 where ink is injected in the ink chamber IS and an annular rib 62*a* which surrounds the injection opening 62 are provided in the second supply member 61. After injecting of ink, the injection opening 62 is blocked off so that communication with the ink chamber IS is impeded by the pack body 91 (the pack members 92) being joined (fused) with the annular rib 62*a*.

Next, the first supply member 81 and the second supply member 61 will be described with reference to the drawings. Here the drawings which are referenced are shown with the pack body 91 being omitted.

Figure 15A:
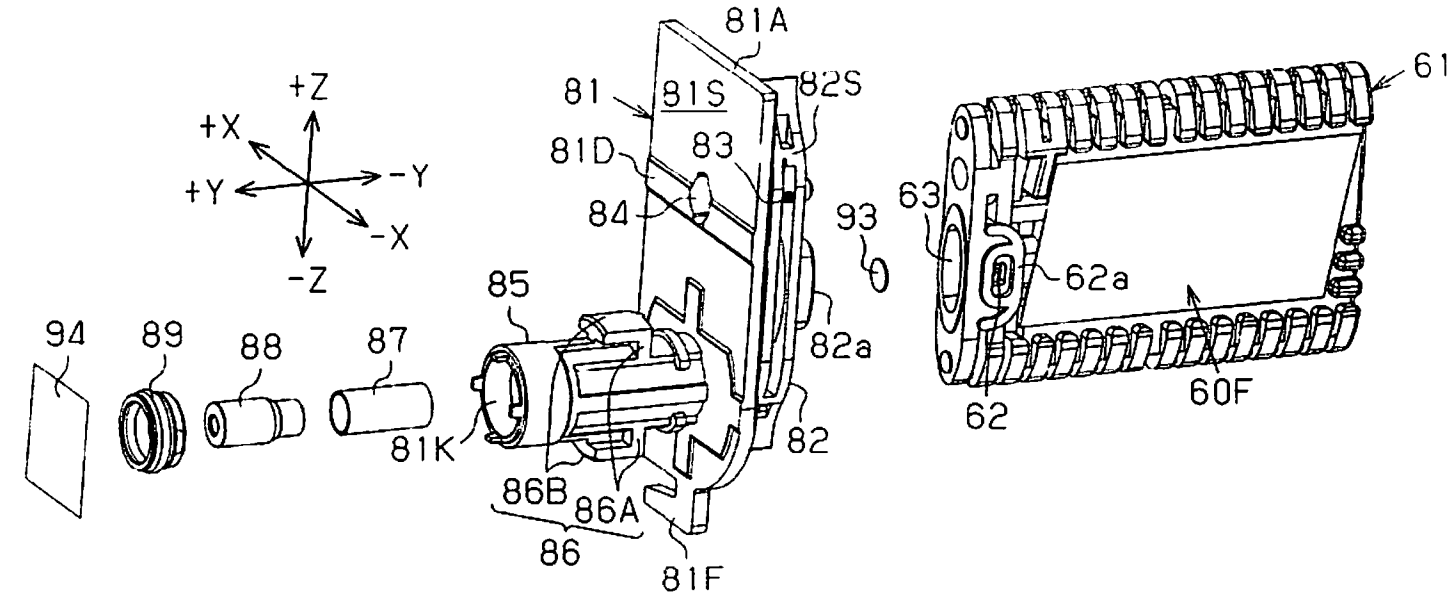
FIGS. 15A and 15B are exploded diagrams illustrating a configuration of an ink vessel and FIGS. 15A and 15B are perspective diagrams viewed from the same respective directions as FIGS. 14A and 14B.
Figure 15B:
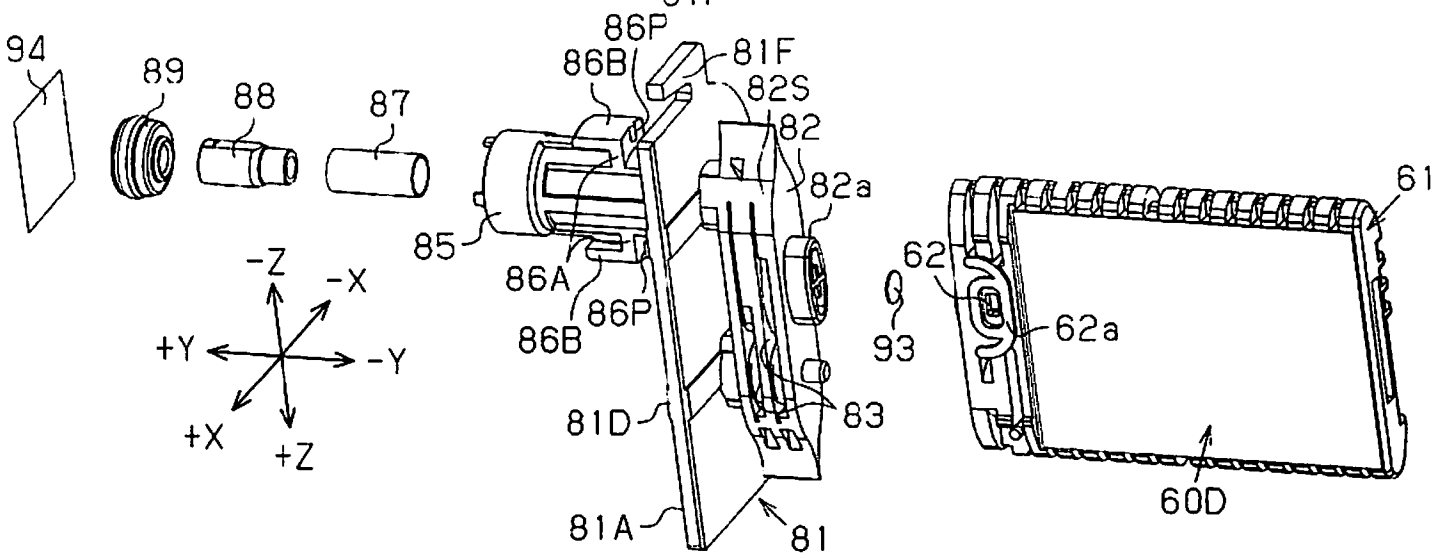

As shown in FIGS. 15A and 15B, the first supply member 81 has a connecting section 82*a* where the cross section is an oval pillar shape and the second supply member 61 has a connected section 63 where the cross section is a hole with an oval shape. The first supply member 81 and the second supply member 61 are connected by the connecting section 82*a* being inserted with regard to the connected section 63 after being inserted in a valve 93 (a check valve). Here, in the present embodiment, the first supply member 81 and the second supply member 61 are connected by the connecting section 82*a* and the connected section 83 so as to be able to be attached and detached.

The portion where the connecting section 82*a* is formed in the first supply member 81 is a long boat shape in one direction where the boat shape is formed at both ends in the longitudinal direction viewed from the +Y direction. The side surface of the boat shape is a joining surface 82S where the pack body 91 is joined by fusing or the like. Accordingly, a portion of the boat shape is a joining section 82 of the pack body 91. Here, the longitudinal direction of the joining section 82 is a direction along the vertical direction when mounted in the mounting section 20.

In addition, a base section 81A with substantially a rectangular plate shape, where the +Y direction is a plate thickness direction and the longitudinal direction is in the same direction as the longitudinal direction of the joining section 82, is formed in the first supply member 81 on the +Y direction side of the joining section 82 toward the mounting section 20. In the present embodiment, the base section 81A is formed to be asymmetrical when viewed from the +Y direction. In detail, one end in the longitudinal direction is rectangular while the other end in the longitudinal direction is formed as substantially an L shape section 81F with an L shape.

A cylindrical flow path section 85, where the liquid supply opening 81K is formed at the front end, is provided in the base section 81A in the first supply member 81. The cylindrical flow path section 85 is provided to protrude toward the +Y direction side which is the plate thickness direction of the base section 81A at a position which is closer to the other end side where the L shape section 81F is formed. An engaged section 86, which is able to be engaged with the first casing member 71 when fixed in the first casing member 71 and which regulates movement in the opposite direction to the +Y direction when engaged with, is provided in the cylindrical flow path section 85. The engaged section 86 is formed in the cylindrical flow path section 85 on both sides in a direction along the longitudinal direction of the base section 81A. The engaged section 86 is configured by a first engaged section 86A, which protrudes to have a plate shape which is substantially parallel to the base section 81A, and a second engaged section 86B which is provided from the front end of the first engaged section 86A toward the +Y direction side so as to be substantially at right angles with the first engaged section 86A. Here, a circular pillar 86P is provided in the first engaged section 86A to slightly protrude so as to form a circular pillar side surface on the upper surface of the body on the base section 81A side.

In addition, a supply opening spring 87, a supply opening spring seat 88, and a supply opening rubber seal 89 are inserted in this order in the cylindrical flow path section 85 from the liquid supply opening 81K side which is formed at the front end of the cylindrical flow path section 85, and last of all, a supply opening film 94 is joined to the front end of the cylindrical flow path section 85 by fusing or the like. The liquid supply opening 81K is in a state of being sealed due to being joined with the supply opening film 94. Then, here, although omitted from the drawings, due to the supply needle 29 being inserted with regard to the liquid supply opening 81K which is formed at the front end of the cylindrical flow path section 85, the seal of the supply opening film 94 is broken and the supply opening spring seat 88, which blocks off the ink flow path by abutting with the supply opening rubber seal 89, is pushed so as to separate from the supply opening rubber seal 89. As a result, a gap is formed so that a flow of ink is possible in the liquid supply opening 81K and ink flows in with regard to the supply needle 29 from the gap which is formed.

On the other hand, the second supply member 61 which is connected with regard to the joining section 82 of the first supply member 81 has substantially a rectangular cube shape where the outer shape is long in the +Y direction. The shape of the first supply member 81 on the connecting side is an oval shape where the longitudinal direction is the same direction as the longitudinal direction of the boat shape of the joining section 82 and both ends in the longitudinal direction are a semicircular shape or a semielliptical shape. Then, the oval shape of the second supply member 61 on the connecting side is a shape which fits into the boat shape of the joining section 82 when viewed from the +Y direction.

Figure 16A:
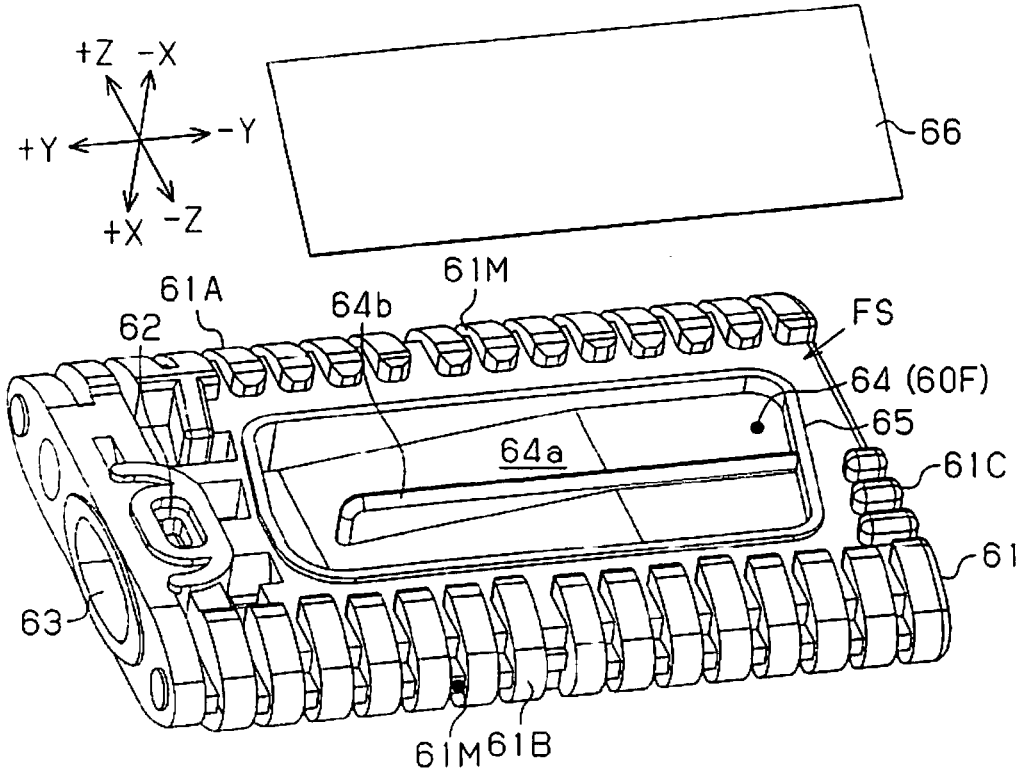
FIG. 16A is an exploded perspective diagram illustrating a configuration of a filter chamber inside an ink vessel and FIG. 16B is an exploded perspective diagram illustrating a configuration of a low pressure chamber inside an ink vessel.
Figure 16B:
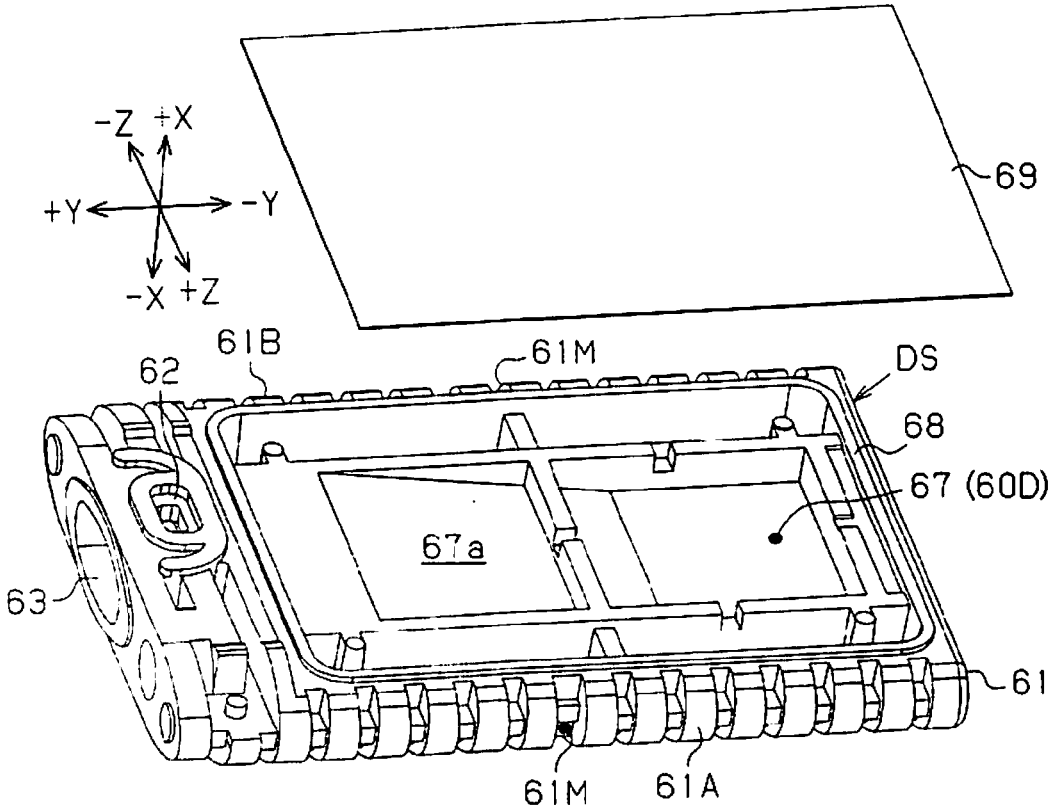

As shown in FIGS. 16A and 16B, out of the two flat surface where the area, which is positioned to oppose both sides in the ±X direction, is maximized in the rectangular cube shape of the second supply member 61, the filter chamber 60F is formed on a first flat surface FS side and the low pressure chamber 60D is formed on a second flat surface DS. Then, in the present embodiment, at least a portion of the second supply member 61 is a shared member which forms the filter chamber 60F and the low pressure chamber 60D.

The filter chamber 60F is configured as shown in FIG. 16A. That is, a first concave region 64, which has a first opening section 65 with substantially a parallelogram shape which is long in the +Y direction and short in a direction which intersects with the +Y direction, is provided in the second supply member 61 on the first flat surface FS side. Then, an inclined surface 64*a*, which is inclined toward the connected section 63 side which is connected with the connecting section 82*a*, is provided in the bottom surface of the first concave region 64. The inclined surface 64*a* is inclined so that the bottom surface of the connected section 63 is positioned more to the X direction side than the bottom surface on the first opening section 65 side. Furthermore, a filter 66, where it is possible for ink to permeate and permeating of foreign matter is suppressed, has an outer shape which is substantially a parallelogram shape with the +Y direction as the long side. The filter chamber 60F is formed due to the filter 66 being attached to the second supply member 61 so that the first opening section 65 in the first concave region 64 is blocked off. That is, the filter chamber 60F is configured on the first flat surface FS side of the second supply member 61 due to the first concave region 64 functioning as a liquid inflow region where it is possible for ink to flow in through the first opening section 65 by passing through the filter 66.

In the present embodiment, a rib 64*b* is provided along the +Y direction in the first concave region 64 which becomes the filter chamber 60F. The rib 64*b* functions as an abutting section which abuts with the filter 66 in a case where the filter 66 changes shape toward the inner side of the filter chamber 60F and it is possible to suppress the filter 66 from changing shape.

In addition, in the present embodiment, the filter 66 is formed by cutting a sheet, where fibers are weaved into a base material, and is designed so that the cut surface is inclined with regard to the weave direction of the fibers in the base material due to the outer shape being a parallelogram shape so that the weaved fibers in the base material do not unravel.

The low pressure chamber 60D is configured as shown in FIG. 16B. That is, a second concave region 67, which has a second opening section 68 with substantially a rectangular shape which is long in the +Y direction and short in a direction which intersects with the +Y direction, is provided in the second supply member 61 on the second flat surface DS side. An inclined surface 67*a* is provided in the second concave region 67 at a position which substantially overlaps with the inclined surface 64*a* of the first concave region 64 when viewed from the scanning direction. The inclined surface 67*a* is inclined so that the bottom surface on the opposite direction side to the +Y direction is separated from the second opening section 68 more than the bottom surface on the connected section 63 side.

In addition, in the present embodiment, the second concave region 67 is formed so that the projection area, where the ±X direction is the projection direction, is maximized. The first concave region 64 which functions as the filter chamber 60F is formed so as to be positioned inside the second concave region 67 when viewed from the projection direction, that is, the ±X direction.

Then, the second concave region 67 is a tightly sealed space and a low pressure space with a pressure which is lower than atmospheric pressure due to a film 69 being adhered to the second supply member 61 in a low pressure environment so that the second opening section 68 is blocked off. The film 69 is a film which has the properties where it is possible for gas which is dissolved in the ink or bubbles which are generated in the ink to pass through. Due to this, the second concave region 67 configures the low pressure chamber 60D inside the second supply member 61 on the second flat surface DS side of the second supply member 61 becoming the inside of the second supply member 61. Here, it is sufficient if the second concave region 67 is a low pressure space with a pressure which is lower than atmospheric pressure and it is not necessary for the second concave region 67 to be a tightly sealed space.

Additionally, as shown in FIGS. 16A and 16B, a plurality of convex sections 61A, 61B, and 61C are provided in the second supply member 61. In the present embodiment, the convex sections 61A and 61B are formed at both end sections of the second supply member 61 in the latitudinal direction (the vertical direction Z) which intersects with the +Y direction so as to interpose the filter 66. The shape is a convex section which extends along the latitudinal direction of the second supply member 61. The convex section is a semicircular shape or a semielliptical shape when viewed from the +Y direction. That is, the convex sections 61A and 61B are formed in the second supply member 61 so that a plurality of portions, with substantially the same semicircular shape or semielliptical shape as the oval shape of the connecting side of the first supply member 81, extend to line up along the +Y direction. Then, gaps are formed between the convex sections of each of the convex sections 61A, 61B, and 61C and the gaps between each of the convex sections of the convex sections 61A and 61B are provided as grooves 61M which reach from the film 69 in the low pressure chamber 60D to the filter 66 in the filter chamber 60F.

Accordingly, the grooves 61M, which are provided, for example, between the convex sections in each of the convex sections 61A and 61B, are formed as gaps where it is possible for ink to pass through in a case where the pack members 92 come into contact with the convex sections 61A, 61B, and 61C due to the pack body 61 changing shape so as to reduce the gap between the pack members 92 which oppose each other in the ±X direction. Accordingly, it is possible for ink in the ink chamber IS to flow into the filter 66 through the grooves 61M.

Figures 17A, 17B, 17C:
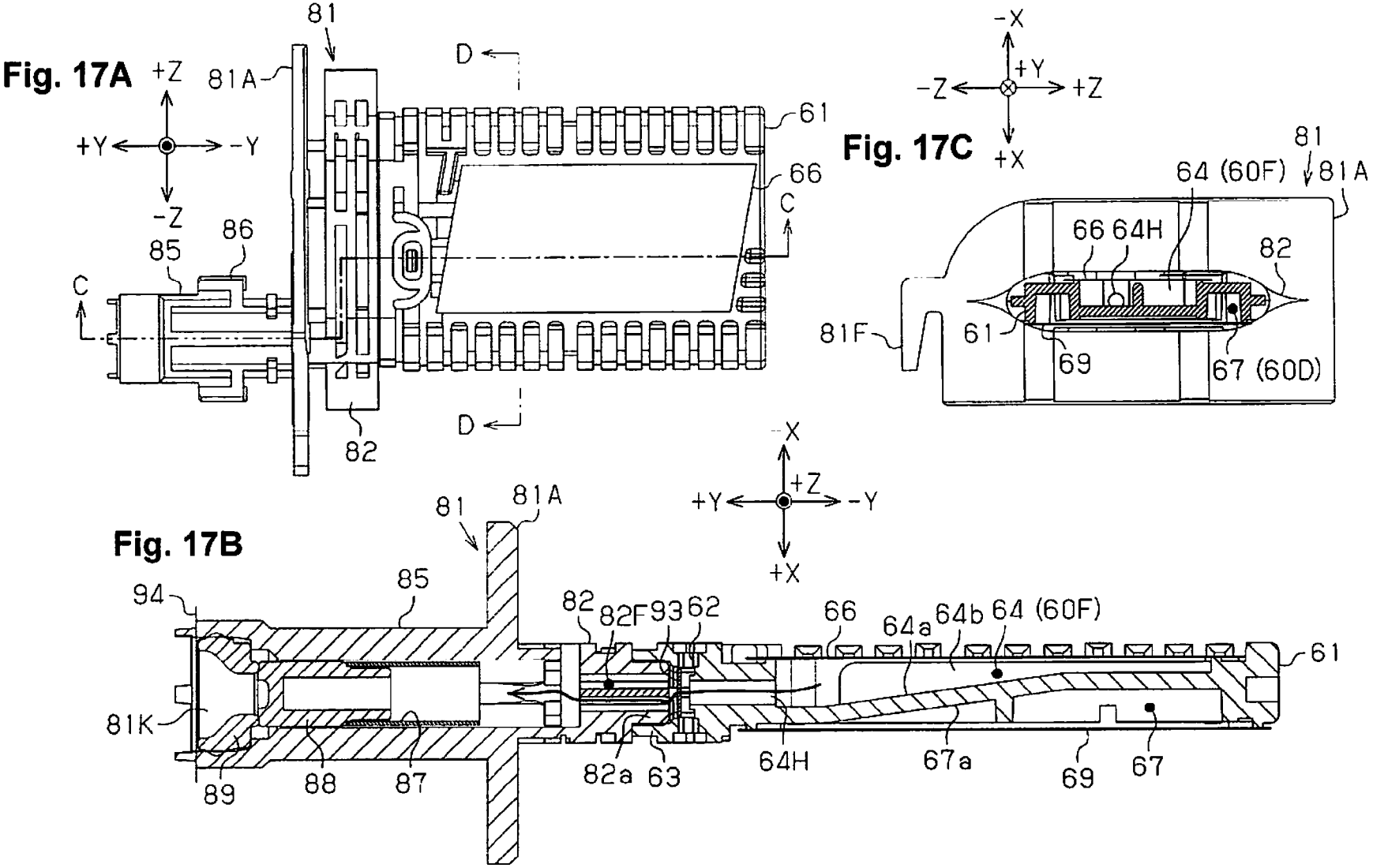
FIGS. 17A to 17C are diagrams illustrating a configuration of a filter chamber and a low pressure chamber.
Figure 18A:
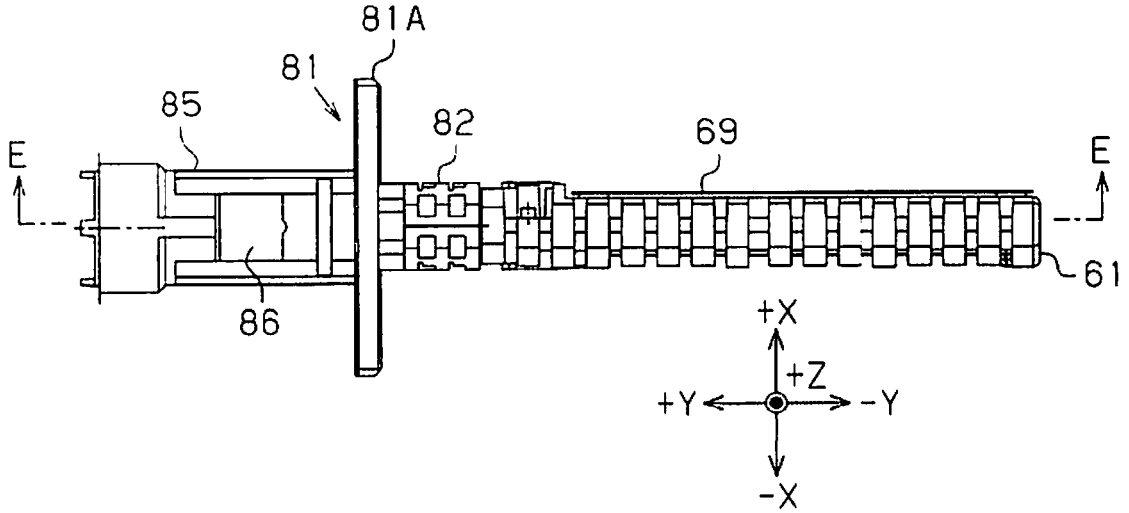
FIGS. 18A and 18B are diagrams illustrating an ink flow path which is provided in a supply member.
Figure 18B:
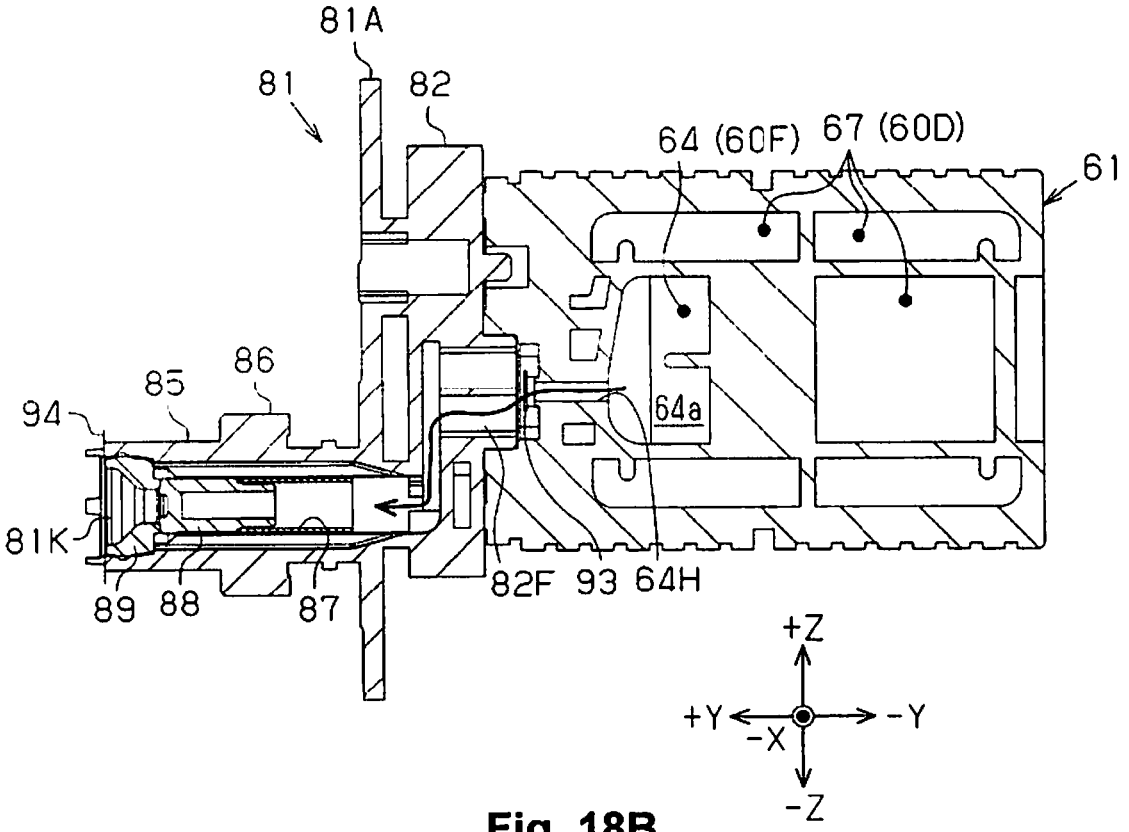

In addition, as shown in FIGS. 17B and 17C and FIG. 18B, the filter chamber 60F is provided to be arranged so as to surround the low pressure chamber 60D due to the configuration where the filter chamber 60F and the low pressure chamber 60D are respectively formed on the first flat surface FS side and the second flat surface DS side which are both sides of the second supply member 61. That is, the filter chamber 60F overlaps with the low pressure chamber 60D in the ±X direction and is provided at both sides in the vertical direction at positions which interpose the low pressure chamber 60D. In this manner, the second supply member 61 is configured so that it is possible to form the low pressure chamber 60D at a position where it is possible for the proportion of gas which is dissolved in the ink in the filter chamber 60F to be reduced.

In addition, as shown in FIG. 16A and FIGS. 17A, 17B, and 17C, the inclined surface 64*a*, which is inclined so that the bottom surface of the connected section 63 is positioned more to the X direction side than the bottom surface on the first opening section 65 side, is formed in the filter chamber 60F. Then, an ink outflow opening 64H where ink flows out is provided in the first concave region 64 on the first supply member 81 side. Accordingly, a flow path is formed in the filter chamber 60F for ink which flows to the first supply member 81 side. In addition, the cross sectional area of the flow path at a first position on the downstream side which is close to the first supply member 81 is larger than the cross sectional area of the flow path at a second position on the upstream side which is further from the first supply member 81 than the first position. Due to this flow path, it is possible for ink which flows into the filter chamber 60F to flow out from the liquid supply opening 81K in a state where loss of pressure is suppressed from becoming high, that is, in a state where the flow speed is suppressed from being high.

In this manner, ink which is contained in the ink chamber IS, where the filter chamber 60F and the low pressure chamber 60D which configure the second supply member 61 are provided, flows to the liquid supply opening 81K through the ink outflow opening 64H in the filter chamber 60F. Then, ink, which flows to the liquid supply opening 81K, flows out to the supply needle 29 side, and after this, is supplied to the liquid ejecting head 18.

That is, as shown by the solid arrow lines in FIG. 17B and FIG. 18B, ink which flows in from the ink chamber IS into the filter chamber 60F flows through a relay flow path 82F which is formed in the joining section 82 by passing through the valve 93 after flowing into the ink outflow opening 64H and flows into the cylindrical flow path section 85 which communicates with the relay flow path 82F. In this manner, ink in the ink chamber IS is led to the liquid supply opening 81K through the filter 66. Here, the valve 93 functions as a check valve which permits the flow of ink from the ink chamber IS side to the liquid supply opening 81K side and regulates the reverse flow of ink from the liquid supply opening 81K side to the ink chamber IS side.

As shown in FIGS. 15A and 15B and FIGS. 19A and 19B, a plurality of grooves are formed in the joining section 82, which is joined with the pack body 91 by fusing or the like, along the longitudinal direction in a side surface of the boat shape which is the joining surface 82S. A space 83 is provided due to the plurality of grooves in a state where the pack body 91 is joined (fused) to the joining surface 82S. The space 83 is configured to communicate with air which is an example of a noncontaining space (other than the ink chamber IS) where ink is not contained (no communication with the ink chamber IS).

Figure 19B:
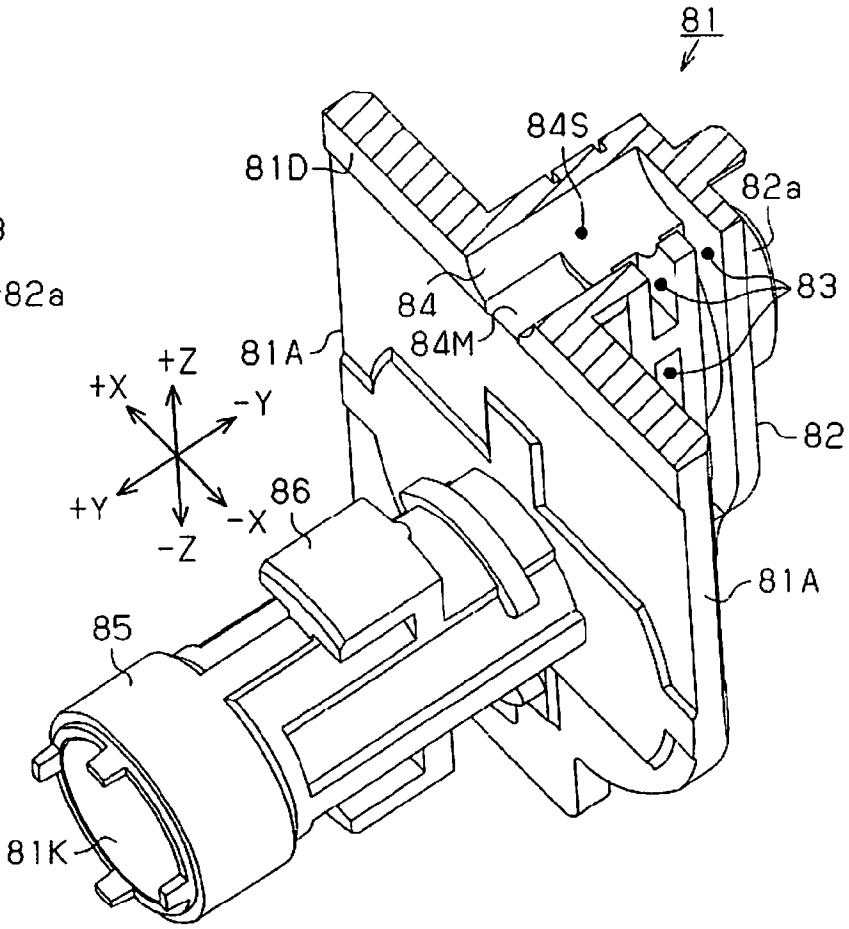
FIG. 19A is a perspective diagram illustrating a supply member and FIG. 19B is a cross sectional perspective diagram where a supply member is cut at a position which intersects with a communication opening.
Figure 19A:
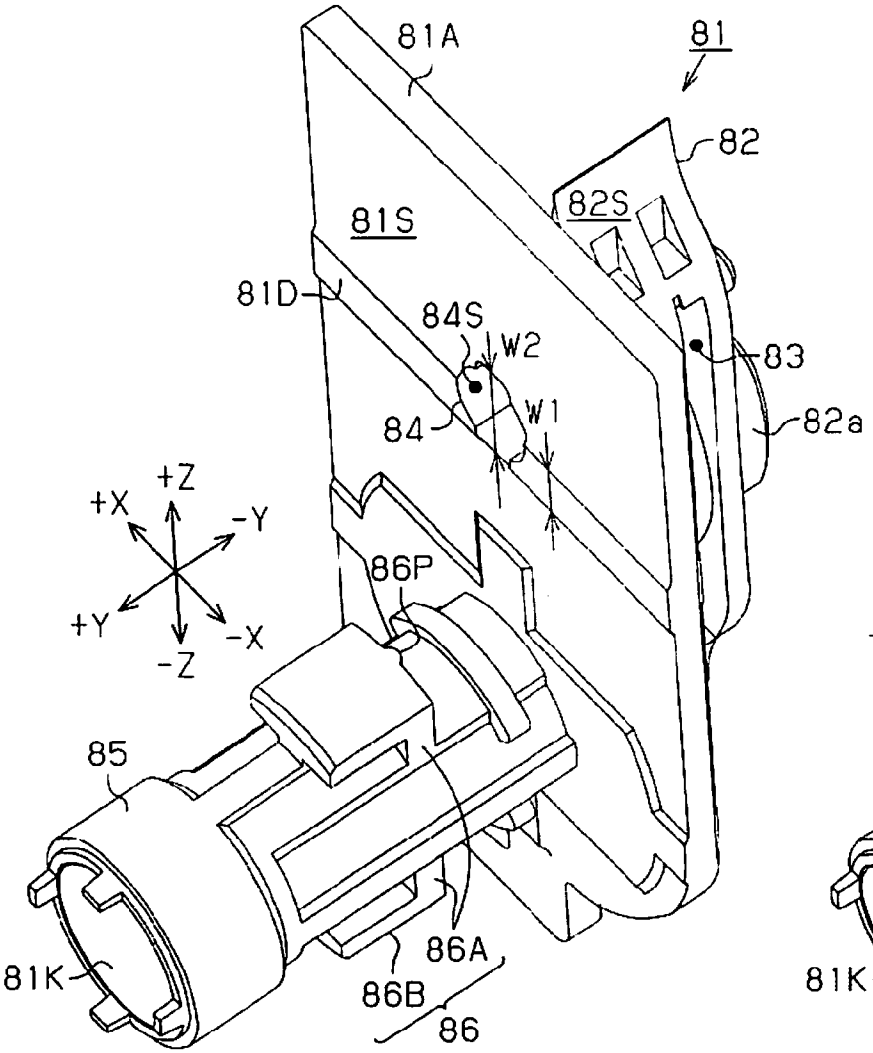

That is, as shown in FIGS. 19A and 19B, in the present embodiment, a space 84S with a cylindrical shape, where a communication opening 84 which communicates with air is formed, is provided in the first supply member 81 in the base section 81A in a member surface 81S with a plate shape on the opposite side to the joining section 82, and the space 84S with the cylindrical shape communicates with the space 83. Accordingly, the space 83 is formed as a space where the communication opening 84 communicates with air through the space 84S with the cylindrical shape.

In addition, in the present embodiment, a side wall groove 84M with a designated width and depth is formed on the communication opening 84 side of the cylindrical side surface in the space 84S with the cylindrical shape on both sides along the longitudinal direction of the base 81A. As a result, the shape of the communication opening 84 is a polygon shape which changes shape from a circular shape as an arc in an opposing portion bulges to the outside. Furthermore, a stepped section 81D, where at least a portion forms the edge of the communication opening 84, is provided in the member surface 81S in the first supply member 81. In the present embodiment, the stepped section 81D protrudes outwards from the member surface 81S to the opposite side to the joining section 82 and is formed in a direction along a latitudinal portion of the base section 81A.

In addition, the stepped section 81D is positioned on the gravity direction side of the communication opening 84 and is formed in a direction along the ±X direction in a state where the ink cartridge 70 (70W) is mounted, that is, in a state where the ink vessel 80 is mounted, in the mounting section 20 of the printer 11. Then, the width of the stepped section 81D along the vertical direction, that is, a width W1 of a convex section is formed as a width which is narrower than a width W2 of the communication opening 84 along the vertical direction.

In the same manner, the communication opening 84 is positioned more to the +Z direction side than the liquid supply opening 81K in a state where the ink cartridge 70 (70W) is mounted, that is, in a state where the ink vessel 80 is mounted, in the mounting section 20 of the printer 11. In addition, the communication opening 84, which is formed in the base section 81A on the opposite side to the joining section 82, is positioned in the first supply member 81 on the +Y direction side toward the mounting section 20.

Next, actions according to the configuration of the present invention will be described in order of actions of the ink vessel 80, actions of assembling the ink cartridges 70 and 70W, and actions of mounting the ink cartridges 70 and 70W in the mounting section 20.

<Actions of Ink Vessel>

Due to the space 83, which communicates with air which is an example of a space (other than in the ink chamber IS) where ink is not contained, being provided in the joining section 82 of the first supply member 81 as shown in FIG. 19A, it is possible for air to escape from the space 83 so that air is not trapped in a fusing surface when the pack body 91 is fused.

In addition, due to the shape of the communication opening 84 being a polygon shape and not circular, blocking off of the communication opening 84 due to, for example, a circular rod is easily suppressed. In addition, due to the stepped section 81D with a narrow width which is provided in the member surface 81S of the base section 81A where the communication opening 84 is formed, at least one step is formed in the communication opening 84. Accordingly, blocking off of the communication opening 84 is suppressed using the step which is formed even in a case where, for example, the communication opening 84 is covered by a sheet member. Furthermore, since the communication opening 84 is positioned more to the +Z direction side than the liquid supply opening 81K, there is a low probability that ink which leaks out from the liquid supply opening 81K will flow into the communication opening 84. In addition, since the communication opening 84 is positioned in the first supply member 81 on the +Y direction side toward the mounting section 20, there is a low probability that the communication opening 84 will be blocked off due to foreign matter which enters from the outside of the printer 11 in a state where the ink vessel 80 (the ink cartridge 70 (70W)) is mounted in the printer 11.

Figure 20B:
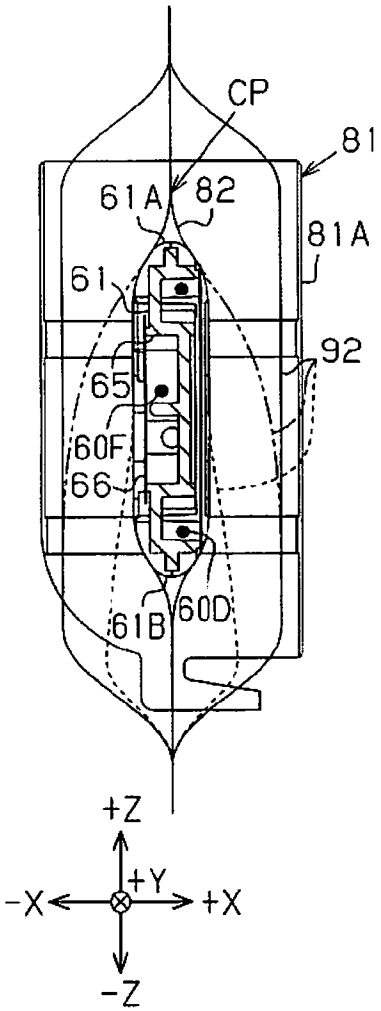
FIG. 20A is a side surface diagram illustrating an ink vessel and FIG. 20B is a cross sectional diagram along a line F-F in FIG. 20A.
Figure 20A:
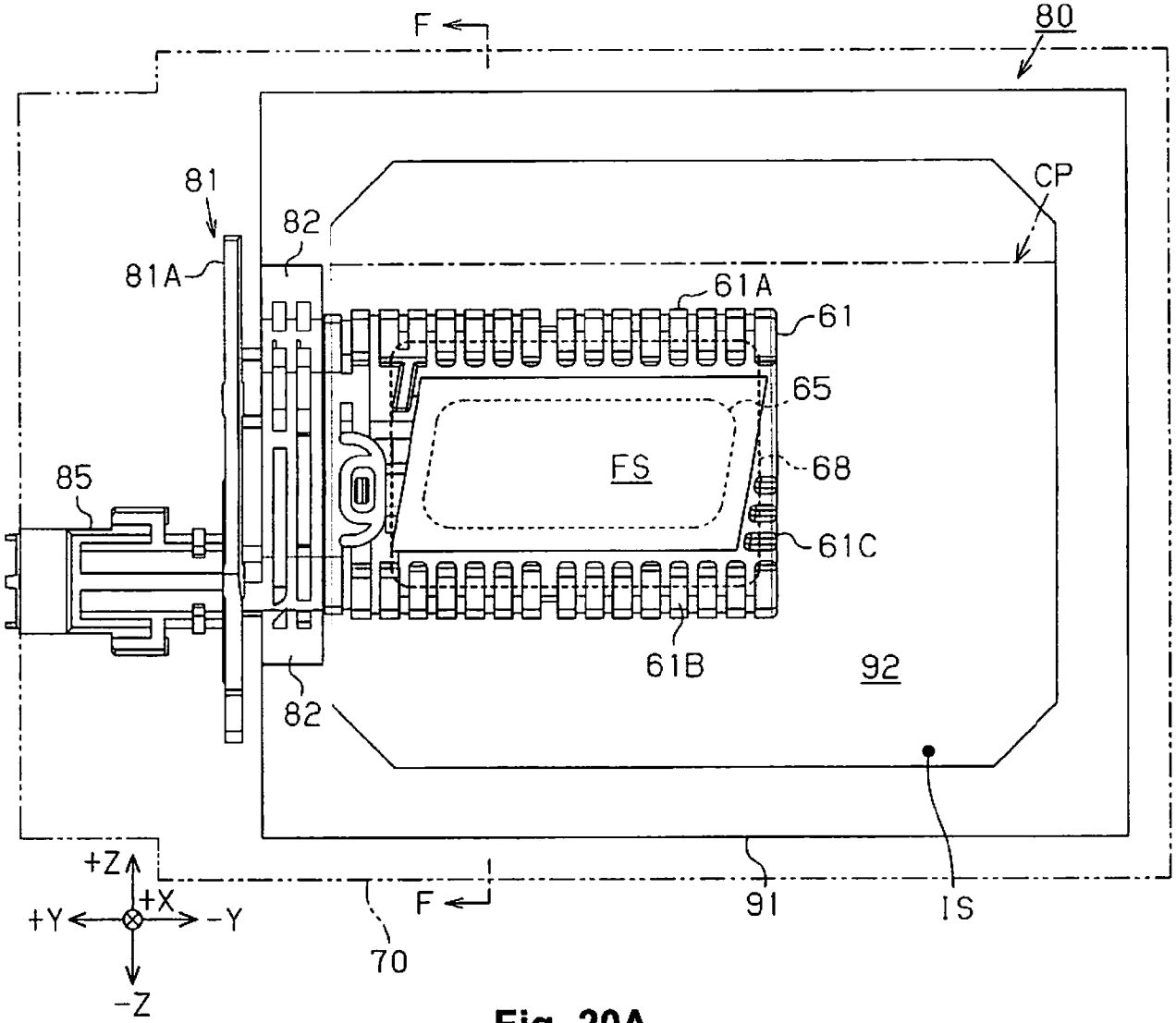

In addition, as shown in FIGS. 20A and 20B, the ink vessel 80 is such that the perpendicular direction of the first flat surface FS (and the second flat surface DS) in the second supply member 61 is in a direction (the ±X direction) which intersects with the vertical direction in a state where the ink cartridge 70 (70W) is mounted in the mounting section 20. Then, the shape of the opening in the filter chamber 60F with substantially a parallelogram shape, where the filter 66 is adhered, is arranged in the ink chamber IS in a state of being longer in the +Y direction and shorter in the vertical direction which is a direction which intersects with the +Y direction as shown by the fine dashed line in FIG. 20A. Here, in order for description to be easier, only the outer contours of the pack body 91 (the pack members 92) are shown in FIGS. 20A and 20B.

Accordingly, when the amount of ink is reduced according to ink in the ink chamber IS flowing out from the liquid supply opening 81K, the pack body 91 changes shape in a state where most of the ink remains on the gravity direction side in the ink chamber IS due to the gap between the pack members 92 narrowing as shown by the two-dot chain line in FIG. 20B. That is, a contact position CP, where the pack members 92 come into contact with each other, gradually moves from the +Z direction side to the −Z direction side (the gravity direction side) as shown by the one-dot chain line in FIG. 20A.

The first opening section 65 which is the inflow region of ink into the filter chamber 60F is longer on the +Y direction side which intersects with the vertical direction than in the vertical direction. Accordingly, it is possible for a large amount of ink to flow out until the first opening section 65 is covered by the pack body 91 (the pack members 92) which changes shape (so that the contact position CP moves in the gravity direction) to accompany the reduction in the amount of ink compared to a case where the first opening section 65 is longer in the vertical direction. In addition, it is possible for ink in the ink chamber IS to flow in from the low pressure chamber 60D side to the filter chamber 60F side through the gap which is provided between the convex sections 61A in a case where the pack members 92 come into contact with a plurality of the convex sections 61A at the contact position CP.

In addition, in the present embodiment, since the second supply member 61 is formed to be longer in a direction which intersects with the vertical direction according to the shape of the first opening section 65, it is possible for the second supply member 61 to be arranged toward the gravity direction side in the ink chamber IS although description of this is omitted in the drawings. As a result, it is possible for a large amount of ink to flow out until first opening section 65 is covered by the pack body 91 (the pack members 92) which changes shape along with ink flowing out from the ink chamber IS.

In addition, the pack body 91, which changes shape as more ink flows out so that the gap between the pack members 92 further narrows as shown by the dashed line in FIG. 20B, comes into contact with the first flat surface FS of the second supply member 61. In this contacting state, it is possible for ink which is positioned in the ink chamber IS on the gravity direction side to flow into the filter chamber 60F through the gap which is provided between the convex sections 61B and 61C in a case where the pack members 92 come into contact with the convex sections 61B and 61C in addition to the plurality of convex sections 61A.

In addition, as shown by a thick dashed line and a thin dashed line in FIG. 20A, the first opening section 65 in the filter chamber 60F is arranged so as to overlap to be inside the second opening section 68 in the low pressure chamber 60D when viewed from the +X direction side. As a result, in a case where gas is dissolved in ink which flows in the filter chamber 60F, it is easy for the dissolved gas to move to the low pressure chamber 60D through a member portion of the second supply member 61 which exists between the filter chamber 60F and the low pressure chamber 60D, that is, the shared member portion which forms the filter chamber 60F and the low pressure chamber 60D. It is obvious that, in this case, the second supply member 61 is formed so that at least the shared member portion is a resin material where gas permeability is high.

<Actions of Assembling Ink Cartridges>

As shown in FIGS. 21A, 21B, and 21C and FIGS. 22A, 22B, and 22C, the ink cartridge 70 (70W) is supported in a state where the ink vessel 80 is positionally aligned by being attached with regard to the first casing member 71 before the ink cartridge 70 (70W) is assembled by combining the first casing member 71 and the second casing member 72.

Figure 21C:
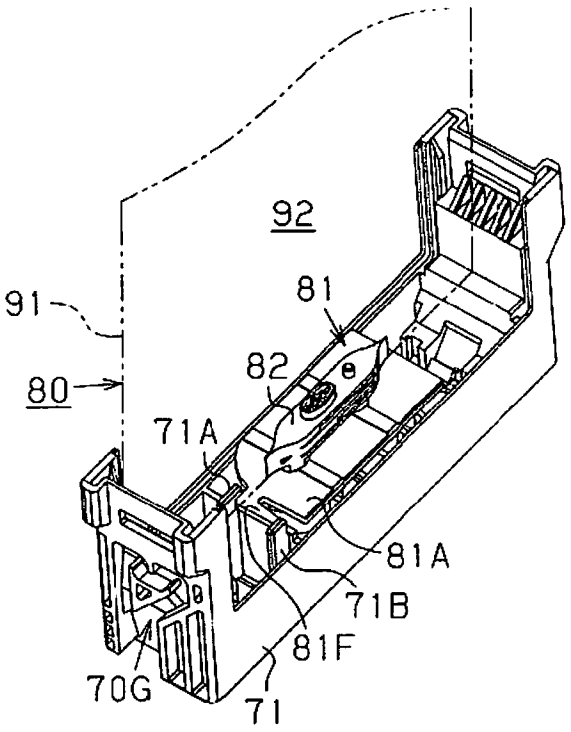
FIGS. 21A to 21C are perspective diagrams illustrating a supply member which is supported by a casing member of an ink cartridge.
Figure 21B:
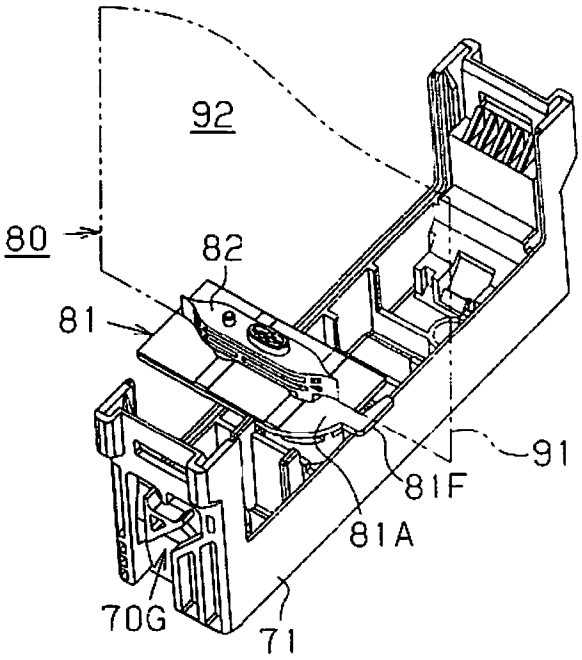
Figure 21A:
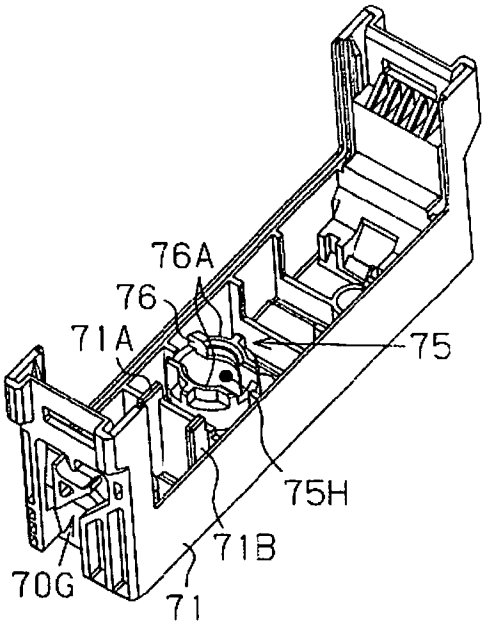
Figure 22C:
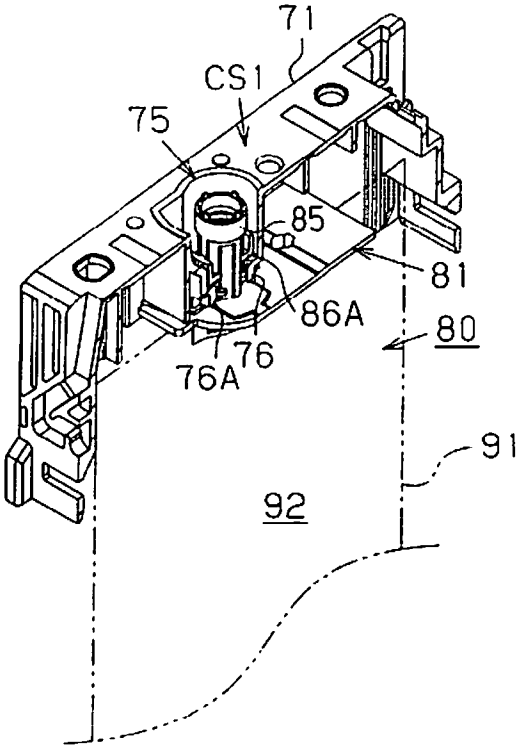
FIG. 22C is a diagram of a state where a supply member is rotated after insertion.
Figure 22B:
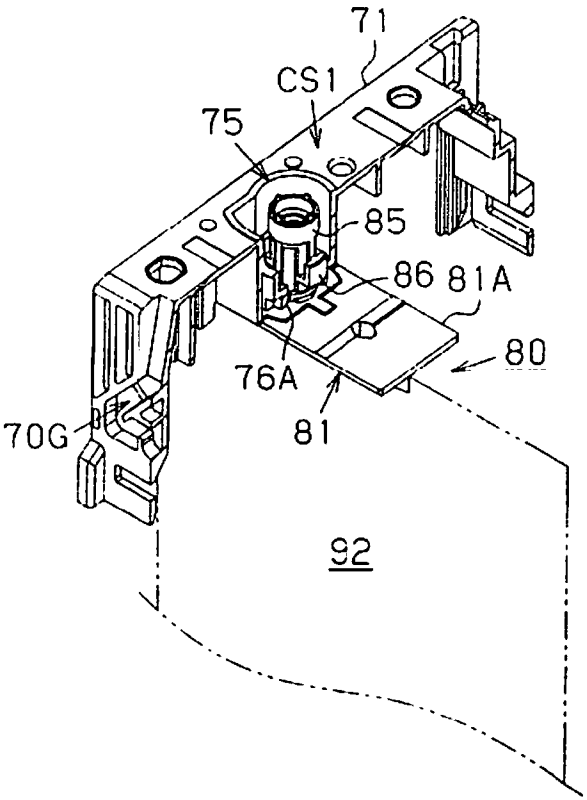
Figure 22A:
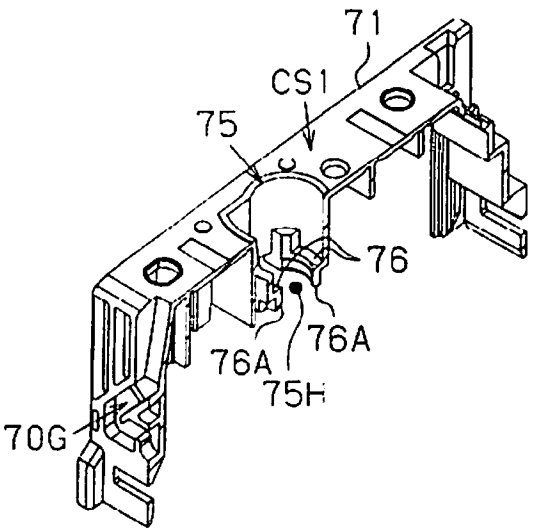

First, as shown in FIG. 21A and FIG. 22A, the through hole forming section 75, which is formed with the through hole 75H where inserting of the cylindrical flow path section 85, which is provided in the first supply member 81, along with the engaged section 86 is possible, are provided in the first casing member 71. The through hole forming section 75 has a concave section which is recessed from the first surface CS1 with substantially a keyhole shape, and the through hole 75H is formed in the concave section in a wall surface which is formed in a direction which is substantially parallel with the first surface CS1. Then, a support section 76 is provided at a bottom wall around the through hole 75H which is formed, and an abutting section 76A, which abuts with the base section 81A of the first supply member 81 which is inserted, is provided in the support section 76 on the opposite side to the first surface CS1 side which is the side where the first supply member 81 (the cylindrical flow path section 85) is inserted.

Next, as shown in FIG. 21B and FIG. 22B, the cylindrical flow path section 85, which is provided in the first supply member 81, is inserted along with the engaged section 86 with regard to the through hole forming section 75 of the first casing member 71 through the through hole 75H. That is, the through hole 75 is an opening with a shape where it is possible for the cylindrical flow path section 85 and the engaged section 86 to pass through. During inserting, the insertion posturing of the ink vessel 80 is so that a direction which intersects with regard to the longitudinal direction of the first casing member 71 is the longitudinal direction of the joining section 82. That is, in the present embodiment, this direction is at 90 degrees with regard to the longitudinal direction of the first casing member 71. Then, at this time, it is possible for the user to easily identify the insertion posturing using the base section 81A which is formed in an asymmetrical manner.

In addition, the first engaged section 86A in the engaged section 86 and a support member 76 in the through hole forming section 75 are provided at positions which do not overlap when viewed from a direction which intersects (here, is orthogonal) with the insertion direction in a state where the first supply member 81 is inserted until the base section 81A abuts with the abutting section 76A in the first casing member 71.

Next, as shown in FIG. 21C and FIG. 22C, in a state of abutting with the abutting section 76A, the first supply member 81, where the cylindrical flow path section 85 is inserted with regard to the through hole 75H in the first casing member 71 (the through hole forming section 75), is rotated centered on the cylindrical flow path section 85 with the insertion direction as the axis direction. In the present embodiment, the first supply member 81 is rotated by 90 degrees in the clockwise direction when viewed from the front side in the insertion direction for the cylindrical flow path section 85. Due to the rotating, the longitudinal direction of the base section 81A in the first supply member 81 is a direction along the longitudinal direction of the first casing member 71, and the first engaged section 86A is moved to an engaging position which overlaps with the support section 76 when viewed from the insertion direction. As a result, the ink vessel 80 is supported by being attached to the first casing member 71 in a positionally aligned state where movement of the ink vessel 80 along the insertion direction is restricted due to movement of the cylindrical flow path section 85 in the insertion direction and the opposite direction to the insertion direction in the through hole forming section 75 being regulated due to engaging of the first engaged section 86A and the support section 76. Here, in the present embodiment, in a state where the ink vessel 80 is supported in the first casing member 71 in the positionally aligned state, the first engaged section 86A in the cylindrical flow path section 85 is engaged with the support section 76 in the through hole forming section 75 in a state where there are no gaps in the insertion direction using the circular pillar 86P which protrudes to the base section 81A side. With this point, the support section 76 functions as an engaging section which engages with regard to the first supply member 81 so that movement of the first supply member 81 in the opposite direction to the insertion direction is regulated.

Furthermore, as shown in FIG. 21C, a fastening section, which regulates rotating of the cylindrical flow path section 85 in a state where the first engaged section 86A in the cylindrical flow path section 85 is engaged with the support section 76, is provided due to being fastened with the first supply member 81 in a state where the ink vessel 80 is attached to the first casing member 71. In detail, a first protuberance section 71A and a second protuberance section 71B, which protrude to the first supply member 81 side which is attached, are provided in the first casing member 71 as the fastening section in the rotation trajectory of the L shape section 81F which is provided in the first supply member 81 which is rotated in a clockwise direction.

The first protuberance section 71A functions as the fastening section which fastens with the first supply member 81 on the rotation direction side by abutting with the rotation direction side of the L shape section 81F which is rotated and moved in the rotation direction side when the ink vessel 80 is attached to the first casing member 71. On the other hand, the second protuberance section 71B functions as the fastening section which fastens with the first supply member 81 on the opposite side to the rotation direction by abutting with the L shape section 81F in the rotation direction which is opposite to the rotation direction side when the ink vessel 80 is attached to the first casing member 71. In addition, the L shape section 81F functions as a fastened section.

Figure 23:
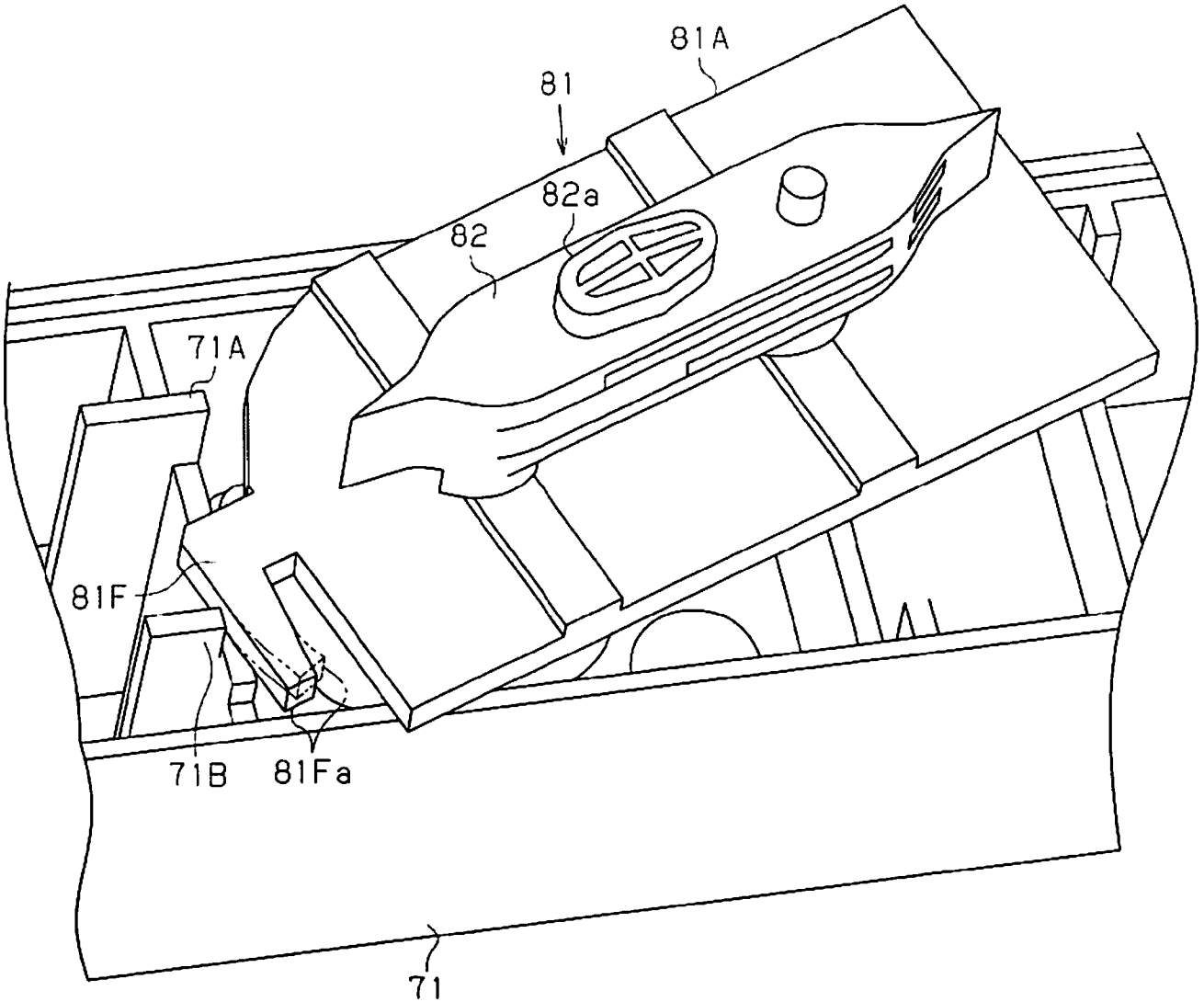
FIG. 23 is an explanatory diagram illustrating shape changing of an L shape section which is provided in a supply member.

As a result, as shown in FIG. 23, the L shape section 81F is formed so as to change shape as shown by the two-dot chain line in FIG. 23 while being rotated when the ink vessel 80 (the first supply member 81) is attached to the first casing member 71 by being rotated in a clockwise direction. That is, the L shape section 81F is formed so that a claw section 81Fa, which is formed on the rotation direction side of the L shape section 81F, engages with the second protuberance section 71B while being rotated and so that the claw section 81Fa is fastened to the second protuberance section 71B by the change in shape reverting back at a point in time when engaging with the second protuberance section 71B is terminated after the claw section 81Fa temporarily changes shape to accompany the rotating. Accordingly, when a user attaches the ink vessel 80 to the first casing member 71 by the ink vessel 80 being rotated in a clockwise direction, it is possible to easily recognize a state where the attachment position is rotated due to the change in rotational force which is generated when the shape of the claw section 81Fa changes reverts back. Here, it is preferable that the changing of shape by the claw section 81Fa be changing of shape in an elastic manner.

Accordingly, in the present embodiment, it is possible for the ink vessel 80 to be removed from the first casing member 71. That is, it is possible for the ink vessel 80 to be removed from the first casing member 71 due to terminating of the state of the claw section 81Fa, which is in a state of being fastened with the second protuberance section 71B, being fastened with the second protuberance section 71B by changing shape as shown by the two-dot chain line in FIG. 23 and the ink vessel 80 (the first supply member 81) being rotated in a counterclockwise direction.

<Actions of Mounting of Ink Cartridge in Mounting Section>

Next, a case will be described where, out of the four ink cartridges 70 which are inserted in the cartridge holding body 22 in the mounting section 20, the ink cartridge 70W with a larger width is inserted in the cartridge holding body 22 at a position which is farthest to the minus side in the ±X direction. Here, the actions of mounting the ink cartridge 70, which is inserted in the cartridge holding body 22 at a position which is farthest to the minus side in the ±X direction, in the mounting section 20 are the same with regard to the other three ink cartridges 70.

Figure 24:
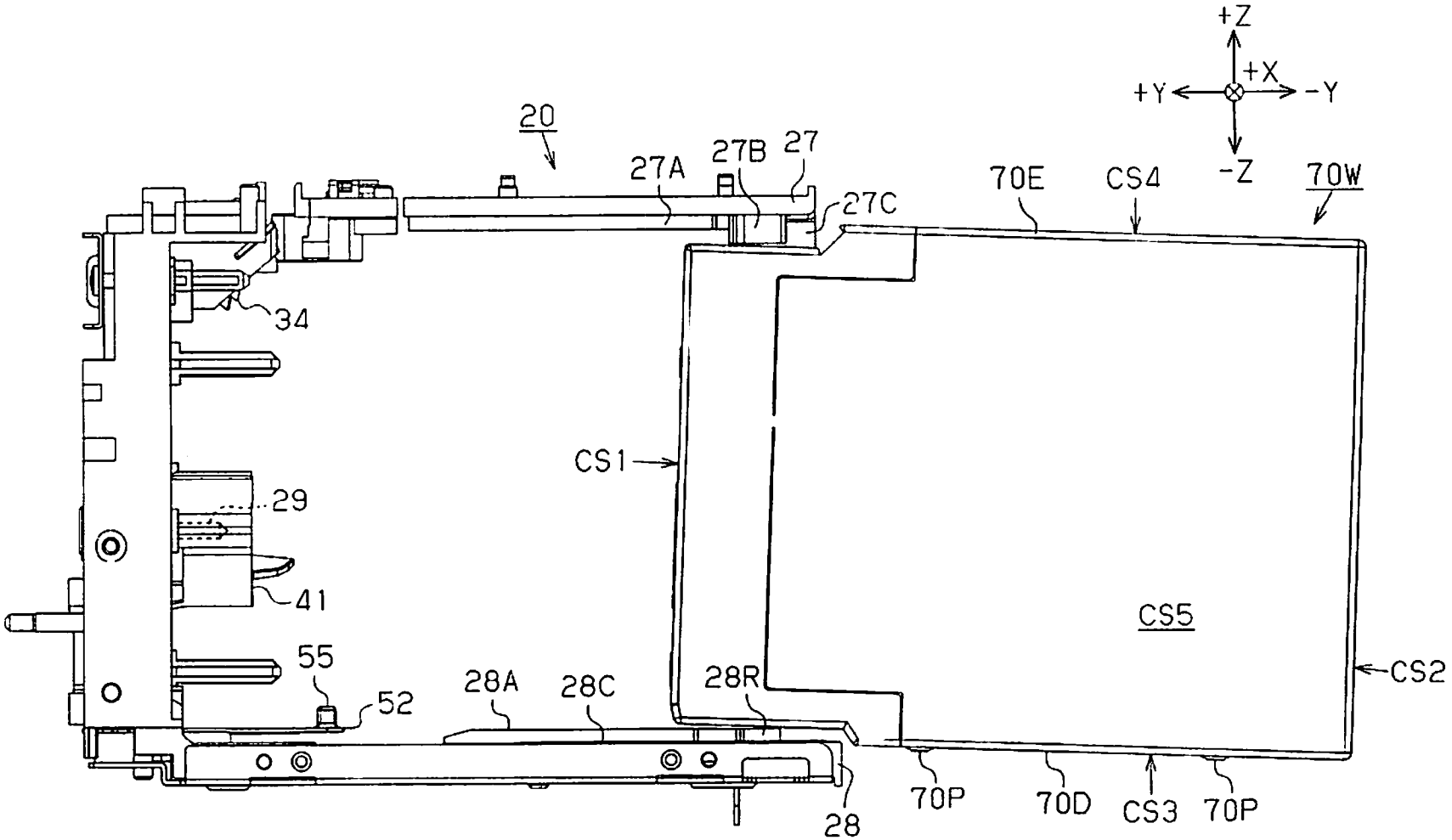
FIG. 24 is a side surface diagram illustrating a state before starting insertion of an ink cartridge in a mounting section.

As shown in FIG. 24, the ink cartridge 70W is in a state where the +Y direction side which is the third surface CS3 (the bottom surface) is placed on the lower guide ribs 28A (the arc shaped ribs 28R) of the bottom member 28 due to the ink cartridge 70W being inserted from the opening side of the cartridge holding body 22 to between the insertion guiding sections 27C which are provided to protrude on the top member 27 of the cartridge holding body 22. Accordingly, in a state of starting to be inserted, the fifth surface CS5 and the sixth surface CS6 of the ink cartridge 70W are provided as guiding wall sections which are guided by the insertion guiding section 27C of the cartridge holding body 22 and the positions thereof in the ±X direction are generally set. Here, in order for it to be easy to insert the ink cartridge 70 (70W), a gap is provided between the insertion guiding section 27C and the fifth surface CS5 of the ink cartridge 70W which is being inserted or a gap is provided between the insertion guiding section 27C and the sixth surface CS6 of the ink cartridge 70W which is being inserted.

In addition, in the state of starting to be inserted, the upper side convex sections 70E and the lower side convex sections 70D of the ink cartridge 70W are at positions which do not yet respectively oppose the upper guide ribs 27A and the upper guide ribs 28A of the cartridge holding body 22 in the ±X direction. In addition, four of the protuberance sections 70P which are provided in the third surface are in a state of not yet being inserted in the cartridge holding body 22. Accordingly, the ink cartridge 70W is in a state where an operation of appropriate position aligning in the mounting section 20 is not yet performed and the positioning of the ink cartridge 70W is unstable. Here, there is a high probability that the ink cartridge 70W will be in an inclined state where the opposite direction (−Y direction) side to the +Y direction which is the insertion direction is lower in the gravity direction due to the weight of ink which is contained in the ink vessel 80 and the like, and for this reason, this inclined state is shown in FIG. 24.

Figure 25:
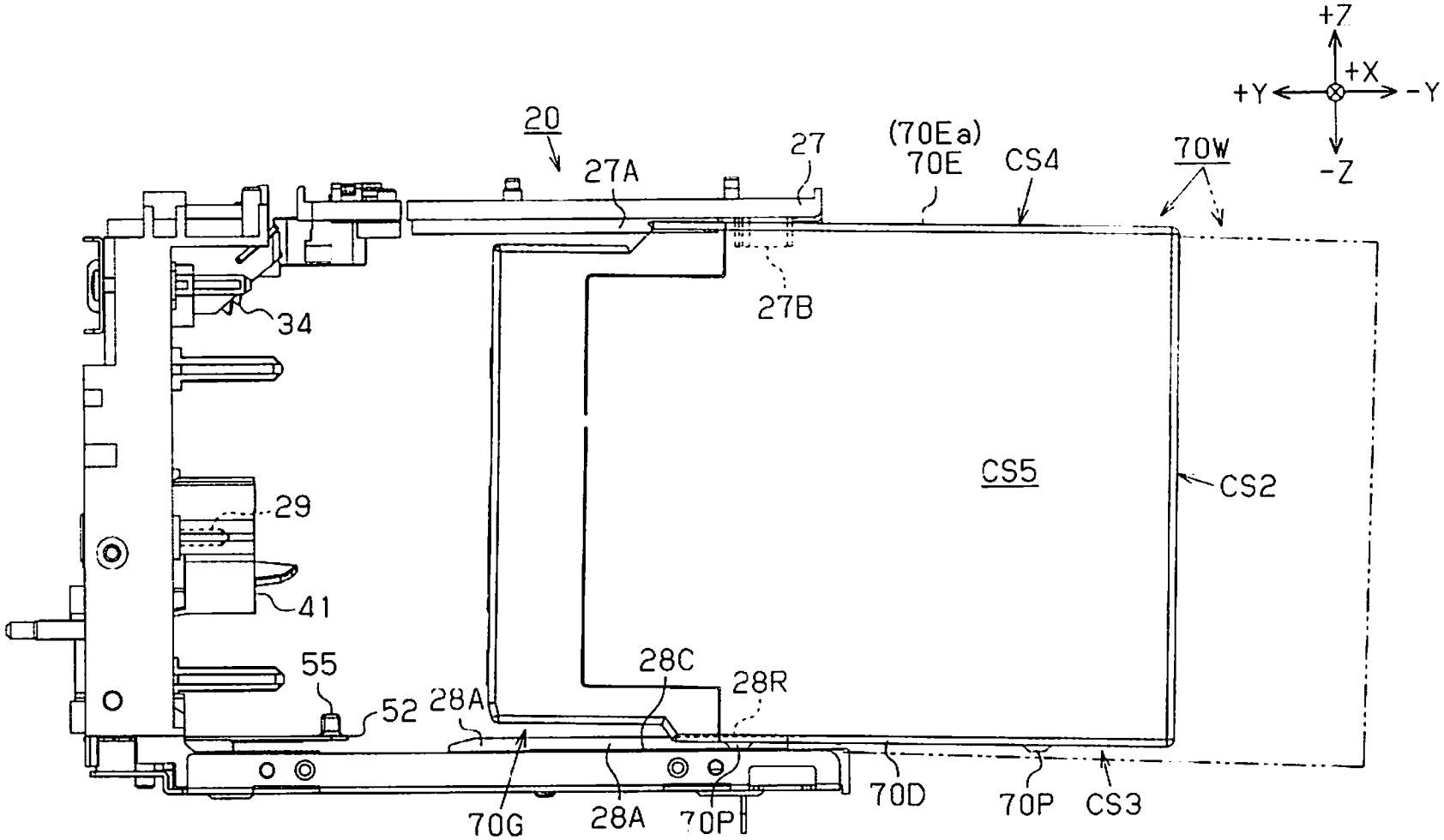
FIG. 25 is a side surface diagram illustrating a state where an ink cartridge is in the process of being inserted in a mounting section.

Next, as shown in FIG. 25, the ink cartridge 70W is positionally aligned by being guided by the arc shaped ribs 28R of the lower guide ribs 28A in a state of being in the process of being inserted, where the ink cartridge 70W is further pushed from the state of starting to be inserted, which is shown by the two-dot chain line in FIG. 25. That is, the arc shaped ribs 28R of the lower guide ribs 28A enter between the lower side convex sections 70D which are formed in the third surface CS3 (the bottom surface) to accompany the ink cartridge 70W being pushed further. Due to the entering of the arc shaped ribs 28R, the +Y direction side of the third surface CS3 side which is the bottom surface of the ink cartridge 70W is in the state of opposing the lower guide ribs 28A in the bottom member 28 in the ±X direction. In addition, the upper side convex sections 70E (the inner side convex section 70Ea) are also at a position which opposes the upper guide ribs 27A, and the positions of both the third surface CS3 which is the bottom surface and the fourth surface CS4 which is the upper surface in the ink cartridge 70W are regulated in the ±X direction. As a result, the ink cartridge 70W is in a state of being generally positionally aligned in the mounting section 20 in the ±X direction.

Here, in the state of being in the process of being inserted, impeding of the ink cartridge 70W being mounted in the mounting section 20 is avoided (refer to FIG. 28C) due to the guide sections 27B in the cartridge holding body 22 being inserted in the concave grooves 70H which are provided in the ink cartridge 70W. In addition, since the linking rib 70R, which is provided on the second surface CS2 side of the third surface CS3 of the ink cartridge 70W, is separated in the +Y direction without abutting with the arc shaped ribs 28R of the lower guide ribs 28A of the cartridge holding body 22, there is no impeding of the ink cartridge 70W being mounted in the mounting section 20 (refer to FIG. 28B and FIG. 29B).

Figure 26:
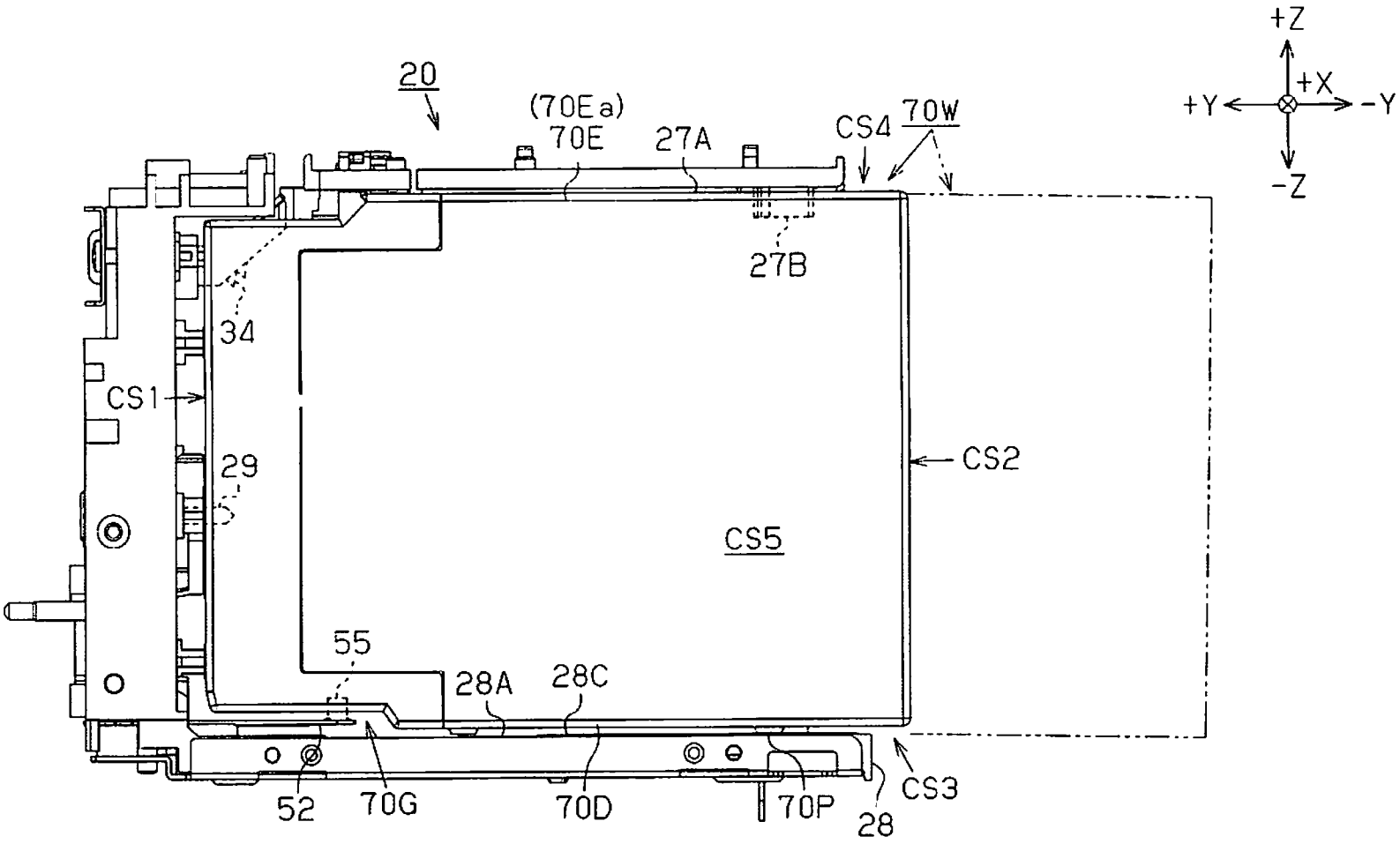
FIG. 26 is a side surface diagram illustrating a mounting state of an ink cartridge in a mounting section.

Next, as shown in FIG. 26, the supply needle 29 is inserted in the liquid supply opening 81K (refer to FIG. 9A) by the moving body 41 being moved in the +Y direction due to the ink cartridge 70W being pushed from the state of being in the process of being inserted which is shown by the two-dot chain line in FIG. 26. In addition, the ink cartridge 70W is in a mounting state where the second electrode 34 on the mounting section 20 side and the first electrode 35 on the ink cartridge 70W side (refer to FIG. 9A) abut and are electrically connected.

Figure 27:
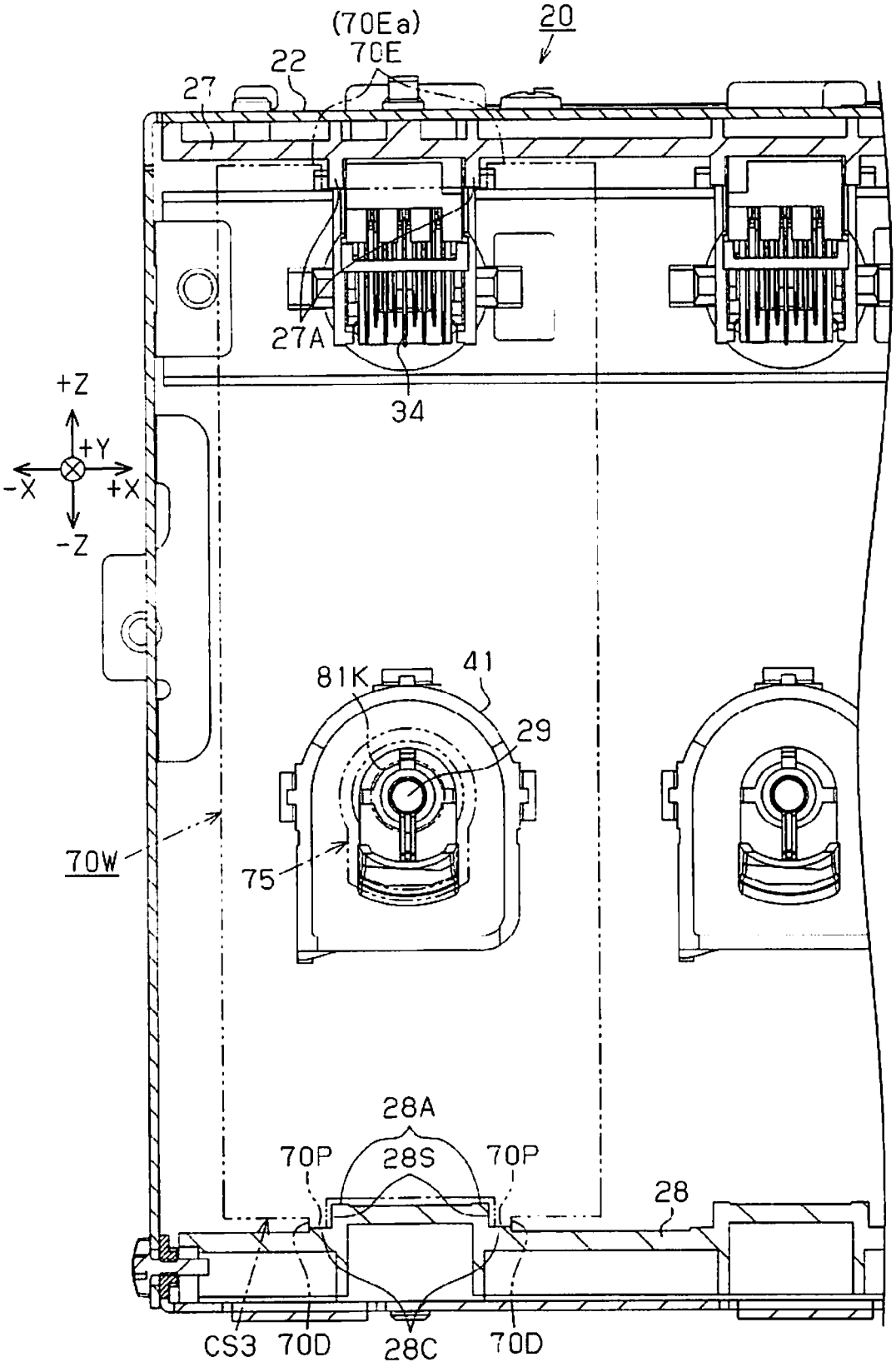
FIG. 27 is a partial exploded diagram illustrating a state viewed from an insertion direction for an ink cartridge in a mounting section.

As shown in FIG. 27, the ink cartridge 70W which is moved in the +Y direction when reaching the mounting state is moved so as to maintain a state of being positionally aligned in the mounting section 20 in the ±X direction due to the lower side convex sections 70D and the lower guide ribs 28A which oppose each other in the ±X direction and the upper side convex sections 70E and the upper guide ribs 27A which oppose each other in the ±X direction. In addition, when being moved in the state of being in the process of being inserted, two of the protuberance sections 70P, which are positioned on the +Y direction side out of the four protuberance sections 70P which are provided in the third surface CS3 of the ink cartridge 70W, are in a state of sliding by coming into contact with the stripe shaped rail surfaces 28C. Furthermore, in the mounting state or moving to the mounting state, two of the protuberance sections 70P, which are positioned on the opposite side to the +Y direction side out of the four protuberance sections 70P which are provided in the third surface CS3 of the ink cartridge 70W, are in a state of being in contact with or a state of sliding by coming into contact with the stripe shaped rail surfaces 28C as shown in FIG. 27.

As a result, the ink cartridge 70W moves to a stable state where rotating with the ±X direction as the axis in addition to rotating with the +Y direction as the axis is suppressed due to at least two of the protuberance sections 70P sliding while coming into contact with the stripe shaped rail surfaces 28C. In addition, in the mounting state, the ink cartridge 70W is in a stable state where rotating with the +Y direction as the axis is suppressed due to contact between the stripe shaped rail surfaces 28C and two of the protuberance sections 70P which are provided to be spaced from each other with an interval in the ±X direction.

In addition, as shown in FIG. 26, when the ink cartridge 70W is in the mounting state, the groove section 70G which is provided in the third surface CS3 is positionally aligned in the +Y direction by engaging with the lever member 52. When positionally aligned, pressing force from the lever member 52 to the +Z direction (opposite to the gravity direction) side, that is, to the upper side, is received. As a result, there are cases where the +Y direction side of the ink cartridge 70W is in a state of being lifted upward due to the pressing force from the lever member 52.

In this case, the ink cartridge 70W is maintained in a stable state where rotating with the ±X direction as the axis is suppressed due to two of the protuberance sections 70P which are in contact with the stripe shaped rail surfaces 28C on the opposite direction side to the +Y direction as shown in FIG. 27 even in a case where two of the protuberance sections 70P which are positioned on the +Y direction side are in a state of being separated from the stripe shaped rail surfaces 28C. Due to this, since positional deviation of the liquid supply opening 81K, which is provided in the first surface CS1, with regard to the supply needle 29 is suppressed, the supply needle 29 is stably inserted with regard to the liquid supply opening 81K.

Furthermore, in the present embodiment, when the ink cartridge 70W is fastened in the mounting section 20 due to engaging of the groove section 70G and the lever member 52, the ink cartridge 70W is positionally aligned in a state where there are no gaps which restricts movement in the ±X direction.

Figure 28A:
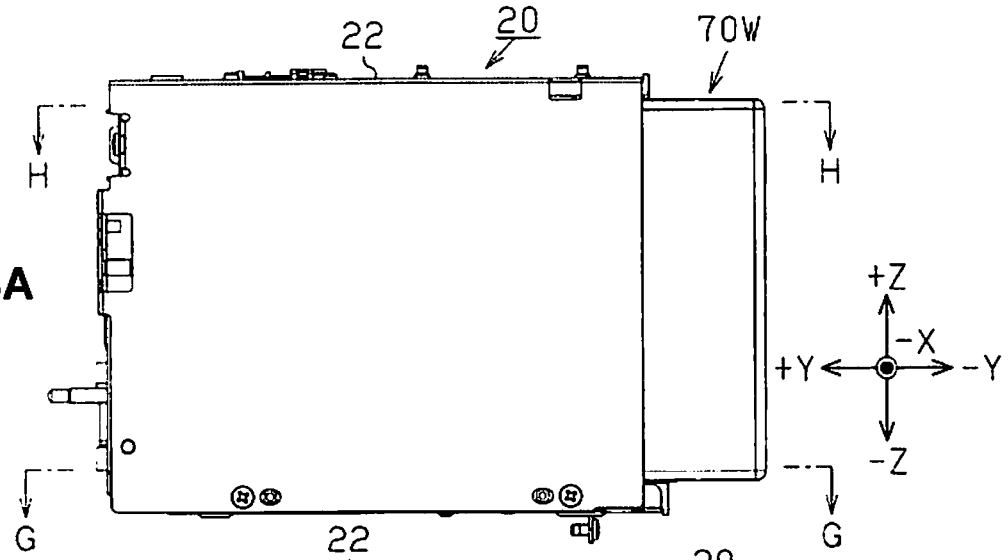
FIGS. 28A to 28C are diagrams illustrating a state where a lever member of a mounting section starts to engage with a groove section of an ink cartridge.
Figure 28B:
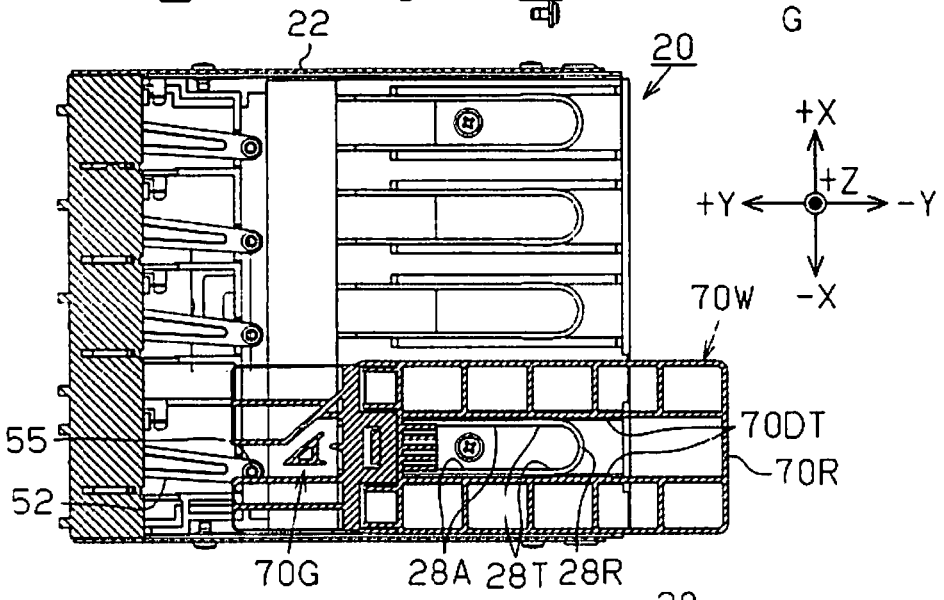
Figure 28C:
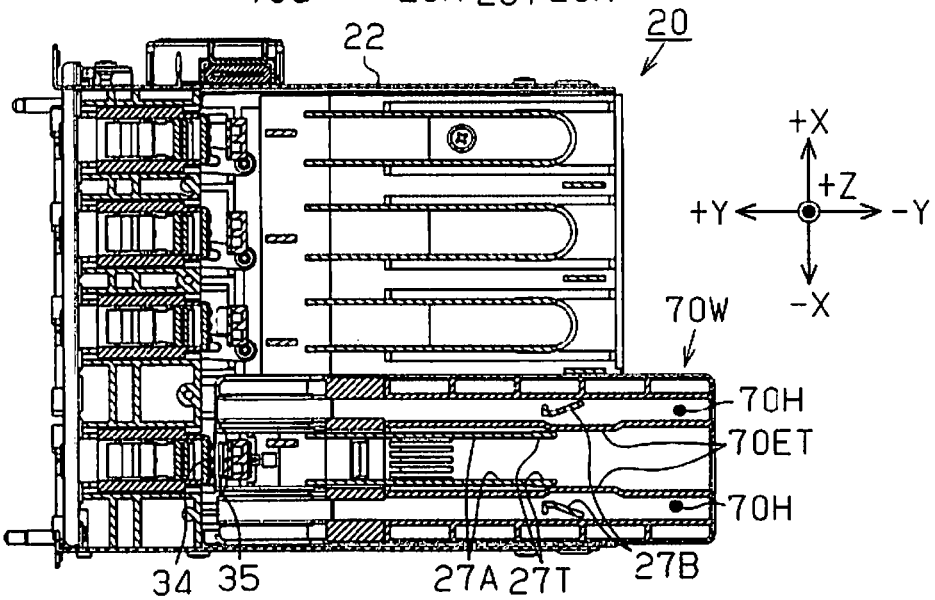

That is, as shown in FIGS. 28A, 28B, and 28C, first, the rib sections 28T of the lower guide ribs 28A start to engage with the lower convex wall sections 70DT which are formed in the lower side inner walls 70B of the ink cartridge 70W in a state where the ink cartridge 70W is pushed to a position where the pin 55 of the lever member 52 starts to engage with regard to the groove section 70G. In addition, the rib sections 27T of the upper guide ribs 27A start to engage with the upper convex wall sections 70ET which are formed in the upper side inner walls 70A of the ink cartridge 70W. In other words, the rib sections 28T of the lower guide ribs 28A and the lower convex wall sections 70DT are formed in positions which are in a state so as to respectively start engaging in this manner.

Due to the start of engaging, the ink cartridge 70W is a state where there are not any gaps between the rib sections 28T of the lower guide ribs 28A and the lower convex wall sections DT in the ±X direction (provisionally referred to as lower side gaps) and not any gaps between the rib sections 27T of the upper guide ribs 27A and the upper convex wall sections 70ET in the ±X direction (provisionally referred to as upper side gaps). Alternatively, the lower side gaps and the upper side gaps may be gaps which are respectively smaller than the gaps between the lower guide ribs 28A and the lower side inner walls 70B and the gaps between the upper guide ribs 27A and the upper side inner walls 70A. In addition, in a state where there are not any gaps, it is permissible for there to be engaging between the rib sections 28T of the lower guide ribs 28A and the lower convex wall sections DT and between the rib sections 27T of the upper guide ribs 27A and the upper convex wall sections 70ET in a state where a pushing force is generated therebetween.

In this manner, due to the ink cartridge 70W which is inserted in the mounting section 20 being in a state where there are not any gaps in the ±X direction, the groove section 70G engages with regard to the lever member 52 which is the moveable fastening section without any positional deviation. Accordingly, the lever member 52 moves smoothly along the cam shape which is formed in the groove section 70G. Here, in the state which is shown in FIGS. 28A, 28B, and 28C, inserting of the supply needle 29 in the liquid supply opening and electrical connecting of the first electrode 35 and the second electrode 34 have not yet been performed.

Figure 29A:
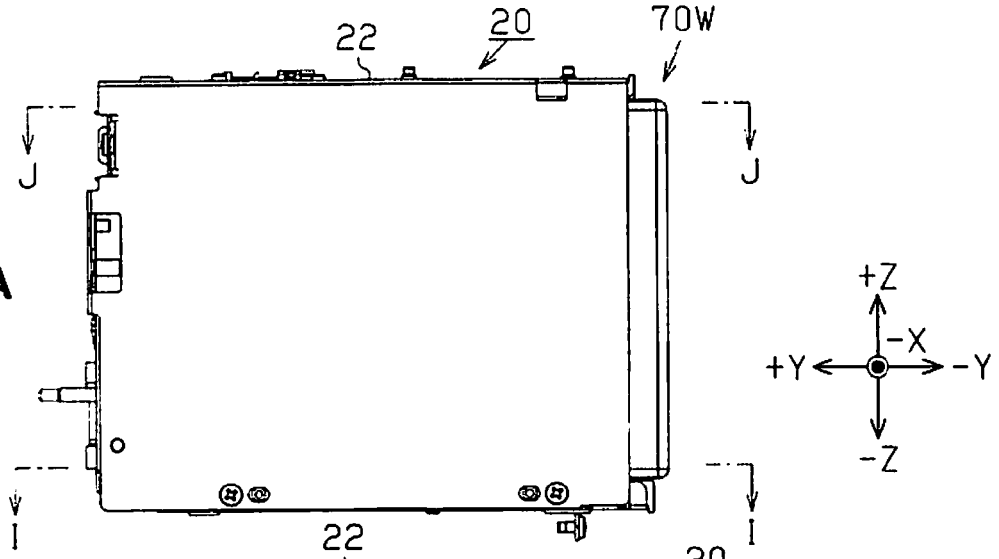
FIGS. 29A to 29C are diagrams illustrating a state where an ink cartridge is at the deepest position in a mounting section.
Figure 29B:
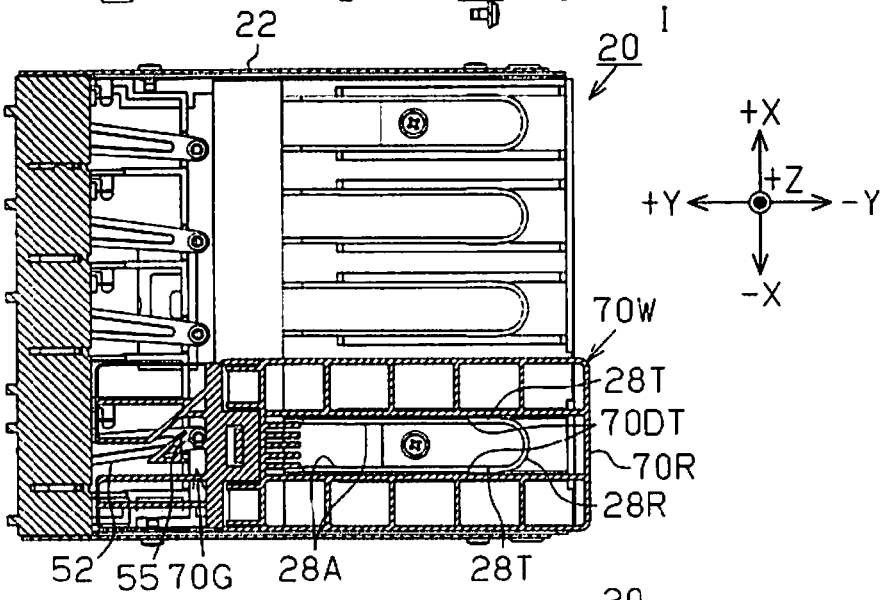
Figure 29C:
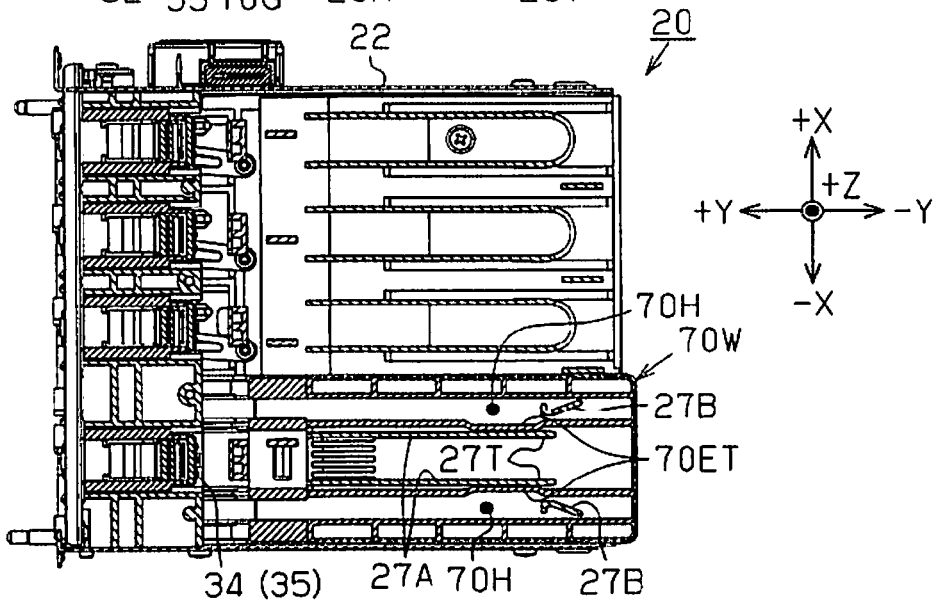

Next, as shown in FIGS. 29A, 29B, and 29C, the ink cartridge 70W which is being inserted is pushed in to the deepest position which is at the far back with regard to the mounting section 20 in the +Y direction. That is, the position of the pin 55 of the lever member 52 with regard to the groove section 70G is pushed to the position with the reference numeral 55 in FIG. 11A. In the state where there is pushing in this manner, the lower convex wall sections 70DT which are moved in the +Y direction are maintained in a state of being engaged with regard to the rib sections 28T of the lower guide ribs 28A in the present embodiment. That is, the lower convex wall sections 70DT are relatively moved in the +Y direction within a range where engaging with the rib sections 28T is maintained. In addition, engaging of the rib sections 27T of the upper guide ribs 27A with the upper convex wall sections 70ET which are formed in the upper side inner walls 70A in the ink cartridge 70W is also maintained. In other words, the rib sections 28T of the lower guide ribs 28A, the lower convex wall sections 70DT, the rib sections 27T of the upper guide ribs 27A, and the upper convex wall sections 70ET are formed with specific lengths so respective engaging is maintained in this manner.

Due to engaging being maintained in this manner, the lever member 52 engages with the groove section 70G which suppresses positional deviation in the ±X direction which accompanies insertion since the ink cartridge 70W moves in the +Y direction with a state being maintained so that there are not any gaps in the ±X direction. Then, at this time, the supply needle 29 is inserted with positional deviation of the liquid supply opening 81K being suppressed and the first electrode 35 is connected with regard to the second electrode 34 with positional deviation being suppressed.

In addition, due to the moving body 41 being pushed in the +Y direction to accompany the movement of the ink cartridge 70W when the supply needle 29 is inserted in the liquid supply opening 81K, the first pressing member 48 (refer to FIG. 10B) is compressed and a pressing force is generated from the first pressing member 48 with regard to the ink cartridge 70. Accordingly, due to a user pushing the second surface CS2 of the ink cartridge 70W at the mark MK (refer to FIG. 8E) which indicates a pushing position which is displayed on the label 74 on the second surface CS2, it is possible to suppress rotating, with the bottom surface side as a pivot against the pressing force of the first pressing member 48, from being generated and to stably push the ink cartridge 70W in the +Y direction.

Figure 30A:
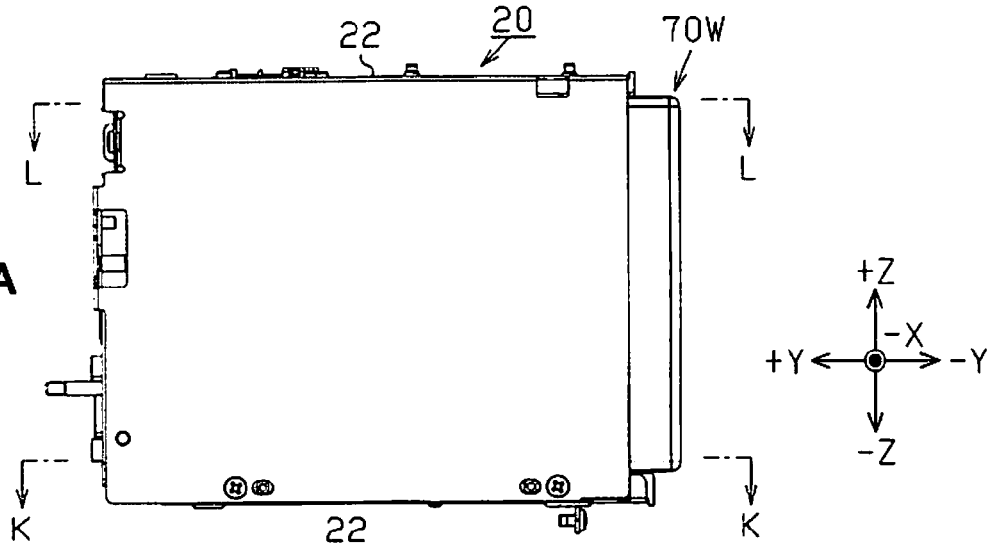
FIGS. 30A to 30C are diagrams illustrating a state where an ink cartridge is at a position of being mounted in a mounting section.
Figure 30B:
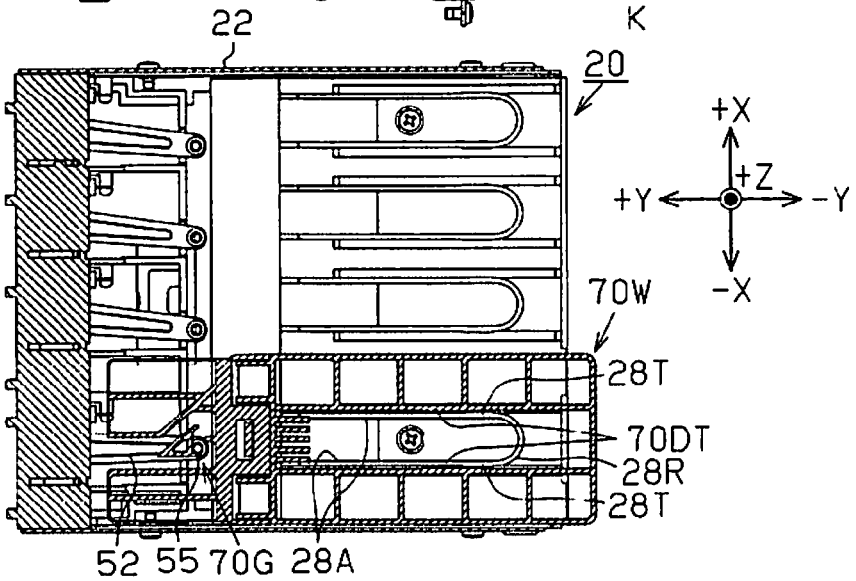
Figure 30C:
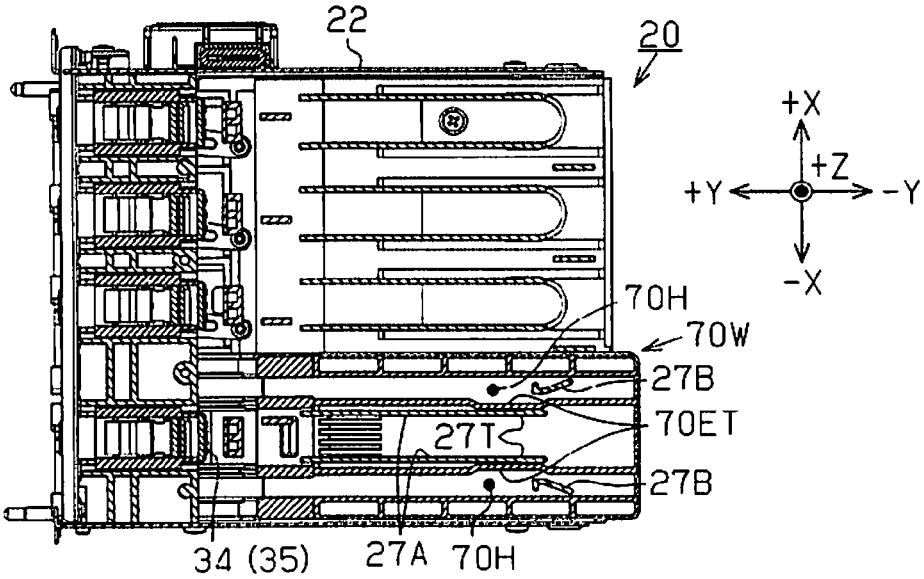

Next, as shown in FIGS. 30A, 30B, and 30C, the ink cartridge 70W is pressed back in the extraction direction due to the pressing force of the first pressing member 48 by the pushing with regard to the ink cartridge 70W, which is moved to the deepest position, in the +Y direction being terminated. Due to this, the ink cartridge 70W is at the mounting position of being fastened using the lever member 52 so as to not fall out from the cartridge holding body 22 due to the pin 55 of the lever member 52 being moved to the restricting position (refer to reference numeral 55C in FIG. 11A) in the groove section 70G. Accordingly, even if a pushing force is generated between the rib sections 28T of the lower guide ribs 28A and the lower convex wall sections 70DT or a pushing force is generated between the rib sections 27T of the upper guide ribs 27A and the upper convex wall sections 70ET, the pressing force of the first pressing member 48 is set so that the ink cartridge 70W is moved against the pushing forces.

With movement of the ink cartridge 70W from the deepest position to the mounting position, the lower convex wall sections 70DT which are moved in the extraction direction are maintained in the state of engaging with regard to the rib sections 28T of the lower guide ribs 28A. In addition, the rib sections 27T of the upper guide ribs 27A are maintained in the state of engaging with the upper convex wall sections 70ET which are formed in the upper side inner walls 70A of the ink cartridge 70W. It is obvious that the state of abutting between the first electrode 35 and the second electrode 34 is maintained. In addition, the state where the supply needle 29 is inserted with regard to the liquid supply opening 81K is maintained at the mounting position of the ink cartridge 70W.

In this manner, the upper convex wall sections 70ET and the lower convex wall sections 70DT of the ink cartridge 70W function as position aligning sections which positionally aligned respectively using the rib sections 27T of the upper guide ribs 27A and the rib sections 28T of the lower guide ribs 28A in the mounting section 20 when fastened due to engaging of the groove section 70G with the lever member 52 which is the moveable fastening member. Then, in the present embodiment, the upper convex wall sections 70ET and the lower convex wall sections 70DT which function as the position aligning sections are provided to be arranged to be positioned on both sides to respectively interpose the upper guide ribs 27A and the lower guide ribs 28A when the ink cartridge 70W is inserted in the mounting section 20 and positionally align the ink cartridge 70W in a direction which intersects with the +Y direction which is the insertion direction.

Here, the ink cartridge 70W which is at the mounting position is moved again to the deepest position which is shown in FIGS. 29A, 29B, and 29C due to the ink cartridge 70W being again pushed to the +Y direction side against the pressing force of the first pressing member 48. Due to being moved to the deepest position, the state of fastening of the groove section 70G and the pin 55 in the level member 52 is terminated at this time and the ink cartridge 70W is pushed back to a position where extraction by a user is possible through the moving member 41 using the pressing force of the first pressing member 48.

According to the embodiment described above, it is possible for the following effects to be obtained.

(1) Since the filter chamber 60F and the low pressure chamber 60D are both provided in the ink chamber IS, it is possible to suppress ink which includes bubbles (gas) or foreign matter other than bubbles (dirt, dust, or the like) from flowing out from the ink chamber IS through the liquid supply opening 81K.

(2) Since at least a portion of the filter chamber 60F and the low pressure chamber 60D is formed as the shared member, it is possible for the filter chamber 60F and the low pressure chamber 60D to be formed in adjacent positions. Accordingly, there is a high probably that gas will be removed from ink which flows into the filter chamber 60F using the low pressure chamber 60D which is adjacent to the filter chamber 60F. In addition, since it is possible to form the filter chamber 60F and the low pressure chamber 60D with an overall volume which is smaller due to the filter chamber 60F and the low pressure chamber 60D being formed using the shared member, it is possible to suppress a reduction in the amount of ink which is able to be contained in the ink chamber IS.

(3) Due to the filter chamber 60F overlapping with the low pressure chamber 60D in a direction which maximizes the projection area of the filter chamber 60F, it is possible for bubbles (gas) in the filter chamber 60F to easily and effectively flow to the low pressure chamber 60D.

(4) It is possible for the first opening section 65 to be positioned in the ink chamber IS on the gravity direction side in the vertical direction. Accordingly, it is possible for the ink in the ink vessel 80, which is reduced due to flowing out from the liquid supply opening 81K, to easily flow into the filter chamber 60F through the first opening section 65 which is positioned on the gravity direction side due to the ink physically remaining on the gravity direction side.

(5) It is possible to replace the members which configure the filter chamber 60F and the low pressure chamber 60D. It is possible to, for example, replace the filter chamber 60F and the low pressure chamber 60D in a case when it is necessary during manufacturing of the ink vessel 80. Accordingly, it is also possible to, for example, change the filter chamber 60F and the low pressure chamber 60D.

(6) It is possible for ink to be led to the filter chamber 60F by flowing in a gap which is formed by the convex sections 61A, 61B, and 61C so as not to remain in the ink chamber IS.

(7) Since the changing of shape of the filter 66 in the filter chamber 60F is regulated by the rib 64*b*, it is possible to suppress a reduction in the filter chamber 60F and to suppress damage to the filter 66 due to the filter 66 changing shape.

(8) Since the flow speed of ink which flows out to the first supply member 81 side is slower in the filter chamber 60F, it is possible for ink to easily flow to the liquid supply opening 81K.

(9) Since gas is removed from ink in the filter chamber 60F using the low pressure chamber 60D which is configured using the second supply member 61, it is possible to suppress ink which includes dirt or bubbles (gas) from flowing out from the ink chamber IS.

(10) Since air escapes in the space 83 at the joining of the pack body 91 and the first supply member 81 and expansion of air in the space 83 to accompany changes in temperature is suppressed using the communication opening 84, it is possible to suppress joining of the pack body 91 and the first supply member 81 from peeling.

(11) Since blocking off of the communication opening 84 due to a circular rod or the like is easily suppressed, it is possible to suppress the joining (fusing) of the pack body 91 and the first supply member 81 (the joining section 82) from peeling by suppressing the expansion of air in the space 83 to accompany changes in temperature using the communication opening 84.

(12) Since blocking off of the communication opening 84 due to a sheet or the like is suppressed, it is possible for air to escape in the space 83 at the joining of the pack body 91 and the first supply member 81 and it is possible to suppress the joining of the pack body 91 and the first supply member 81 from peeling by suppressing the expansion of air in the space 83 to accompany changes in temperature using the communication opening 84.

(13) Blocking off of the communication opening 84 is suppressed since foreign matter and the like which is attached to the stepped section 81D is positioned more to the gravity direction side than the communication opening 84. As a result, it is possible to suppress the joining of the pack body 91 and the first supply member 81 from peeling by suppressing the expansion of air in the space 83 to accompany changes in temperature using the communication opening 84.

(14) Since it is possible to suppress blocking off of the communication opening 84 using the steps of the stepped section 81D with a high probability, it is possible to suppress the joining of the pack body 91 and the first supply member 81 from peeling by suppressing the expansion of air in the space 83 to accompany changes in temperature using the communication opening 84.

(15) Since blocking off of the communication opening 84, which is positioned on the +Z direction side of the liquid supply opening 81K, due to ink, which leaks out from the liquid supply opening 81K, is suppressed, it is possible to suppress the joining of the pack body 91 and the first supply member 81 from peeling by suppressing the expansion of air in the space 83 to accompany changes in temperature using the communication opening 84.

(16) Blocking off of the communication opening 84 is suppressed since the communication opening 84 is concealed in a state of being mounted in the printer 11. As a result, it is possible to suppress the joining of the pack body 91 and the first supply member 81 from peeling by suppressing the expansion of air in the space 83 to accompany changes in temperature using the communication opening 84.

(17) It is possible for the ink cartridge 70 (70W) to be provided with the ink vessel 80 where the joining of the pack body 91 and the first supply member 81 is suppressed from peeling.

(18) The ink vessel 80 is positionally aligned by the cylindrical flow path section 85 of the first supply member 81 being engaged with the first casing member 71 by being rotated with the +Y direction which is the insertion direction as an axis in a state of being inserted in the through hole 75H of the first casing member 71. Accordingly, it is possible for the first supply member 81 of the ink vessel 80 to be supported with regard to the first casing member 71 in a state of being positionally aligned using a simple configuration (and with fewer processes). As a result, it is possible to obtain the ink cartridge 70 (70W) where movement of the ink vessel 80 is suppressed even when a shock is applied due to being dropped or the like.

(19) Since the first supply member 81 is fastened using the first protuberance section 71A and the second protuberance section 71B which regulates rotating in a state of engaging so that movement of the cylindrical flow path section 85 in the opposite direction to the insertion direction into the through hole forming section 75 is regulated, it is possible to maintain a state where the first supply member 81 is supported in a state of being positionally aligned with regard to the first casing member 71.

(20) Since it is possible to recognize a state where the L shape section 81F of the first supply member 81 is fastened to the first protuberance section 71A and the second protuberance section 71B of the first casing member 71 due to the claw section 81Fa changing shape, it is possible for the first supply member 81 to reliably be in a state of being supported by the first casing member 71.

(21) When the first supply member 81 is attached to the first casing member 71, it is easy for a rotation angle of 90 degree to be a guide and assembly is easy.

(22) Since the first supply member 81 falling out in the opposite direction to the insertion direction in a state of being supported by the first casing member 71 is suppressed due to the state of fastening of the fastened section 86 of the cylindrical flow path section 85 with regard to the support section 76 of the through hole forming section 75, a state where the first support member 81 is firmly positionally aligned and supported in the first casing member 71 is possible.

(23) Due to the first supply member 81 being rotated in a state where movement of the cylindrical flow path section 85 in the +Y direction is restricted, it is possible for the first supply member 81 to be easily and reliably supported by the first casing member 71.

(24) It is possible to suppress mistakes with the insertion posturing of the first supply member 81 when the cylindrical flow path section 85 is inserted in the through hole 75H when the first supply member 81 is supported by the first casing member 71.

(25) Since the ink cartridge 70 (70W) is positionally aligned at a plurality of locations due to the convex sections 70C which are provided at the respective surface sides which oppose each other in a direction which intersects with the +Y direction in a state of being mounted in the mounting section 20, it is possible for the ink cartridge 70 (70W) to be mounted in the mounting section 20 in a stable state.

(26) It is possible for the ink cartridge 70 (70W) which is pressed upward in the vertical direction to be positionally aligned in the mounting section 20 while suppressing inclining of the ink cartridge 70 (70W).

(27) Since rotating of the ink cartridge 70 (70W) with the +Y direction as an axis is suppressed during mounting in the mounting section 20, the ink cartridge 70 (70W) is mounted in a stable state where positional deviation of the liquid supply opening 81K is suppressed.

(28) Since inclining of the first electrode 35 of the circuit board 30 is suppressed during mounting in the mounting section 20, positional deviation of the first electrode 35 with regard to the mounting section 20 is suppressed. Accordingly, it is possible for information relating to ink which is sent from the printer 11 to be stably stored.

(29) Since a pressing force is generated in the extraction direction due to inclining during mounting in the mounting section 20 in a case where a pressing force is applied in order to perform an electrical connection with regard to the first electrode 35, it is possible to stably extract the ink cartridge 70 (70W) from the mounting section 20.

(30) Due to suppressing of rotating with the bottom surface (the third surface CS3) side of the ink cartridge 70 (70W) as a pivot due to a pressing force in the extraction direction during mounting in the mounting section 20, it is possible to mount the ink cartridge 70 (70W) in the mounting section 20 in a stable state.

(31) The lower side convex sections 70D of the convex sections 70C generally positionally align the ink cartridge 70 (70W) when the ink cartridge 70 (70W) is inserted in the mounting section 20, and the ink cartridge 70 (70W) which is mounted in the mounting section 20 is accurately positionally aligned due to the protuberance sections 70P of the convex sections 70C. Accordingly, it is possible to mount the ink cartridge 70 (70W) with regard to the mounting section 20 in a stable state.

(32) In a case where the ink cartridge 70 (70W) is inserted in the mounting section 20 in a reverse manner with the second surface CS2 as the inserting side, the linking rib 70R enters deep in the mounting section 20 compared to a case where the ink cartridge 70 (70W) is inserted in the mounting section 20 in the correct manner with the first surface CS1 side as the inserting side. Accordingly, it is possible to suppress the ink cartridge 70 (70W) from being erroneously inserted in the mounting section 20 by providing the arc shaped ribs 28R, which engage with the linking rib 70R in a case where the ink cartridge 70 (70W) is inserted in the mounting section 20 in a reverse manner.

(33) Since the ink cartridge 70 (70W) is positionally aligned when being inserted in the mounting section 20 due to the groove section 70G being fastened with the lever member 52, the operation of mounting the ink cartridge 70 (70W) in the mounting section 20 is smoothly performed and the ink cartridge 70 (70W) is reliably fastened in the mounting section 20 when mounting is completed.

(34) Since rotating of the ink cartridge 70 (70W) in a direction which intersects with the +Y direction is regulated when the ink cartridge 70 (70W) is mounted by being inserted in the mounting section 20, the groove section 70G reliably engages with regard to the lever member 52 when the ink cartridge 70 (70W) is being mounted.

(35) The ink cartridge 70 (70W) is guided due to the lower side inner walls 70B of the lower side convex sections 70D opposing the rib side surfaces 28S of the lower guide ribs 28A and is reliably fastened using the lever member 52 while the groove section 70G reliably engages with the lever member 52 due to the lower convex wall sections 70DT which are provided in the lower side convex sections 70D.

(36) Since the upper convex wall sections 70ET and the lower convex wall sections 70D of the ink cartridge 70 (70W) are respectively positioned on both sides of the upper guide ribs 27A and the lower guide ribs 28A, it is possible for the ink cartridge 70 (70W) to be more reliably positionally aligned in the mounting section 20.

(37) Since positional deviation between the groove section 70G and the lever member 52 is suppressed, it is possible to more reliably perform fastening of the groove section 70G and the lever member 52.

(38) Since the electrical connection section of the ink cartridge 70 (70W) is provided in the extending region R4 which is a surface which is interposed by the pair of upper convex wall sections 70ET, electrical connection with the electrical connection section on the printer 11 side is reliably performed due to the positional aligning by the upper convex wall sections 70ET.

(39) Since the liquid supply opening 81K is also positionally aligned in a state where positional deviation is suppressed due to the upper convex wall sections 70ET and the lower convex wall sections 70DT, the liquid supply opening 81K is reliably connected with the supply needle 29 of the mounting section 20 of the printer 11.

(40) Since it is possible to insert the ink cartridge 70 (70W) to be guided by the insertion guiding section 27C when the ink cartridge 70 (70W) is being inserted in the mounting section 20, it is possible for the ink cartridge 70 (70W) to be mounted in an appropriate position with regard to the mounting section 20.

(41) Since the upper side convex sections 70E and the lower side convex sections 70D are respectively guided by the upper guide ribs 27A and the lower guide ribs 28A and the guide sections 27B are inserted in the convex grooves 70H, it is possible for the ink cartridge 70W with a larger width to be easily mounted in an appropriate position when inserted in the mounting section 20.

(42) Erroneous inserting of the ink cartridge 70W in the mounting section 20 is suppressed since it is difficult for the side surface, which is opposite to the one of the side surfaces (the fourth surface CS4) where the upper side convex sections 70E and the concave grooves 70H are provided, to be inserted on the side of the upper guide rail 27A and the guide sections 27B when inserting the ink cartridge 70W with a larger width.

Here, the embodiment described above may be modified to other embodiments as follows.

In the ink vessel 80 of the embodiment described above, the inclined surface 64*a*, where the cross sectional area of the flow path at the first position which is close to the ink outflow opening 64H is larger than the cross sectional area of the flow path at the second position which is further from the ink outflow opening 64H than the first position, need not necessarily be provided in the filter chamber 60F. For example, the filter chamber 60F may substantially be a rectangular cube shape with no inclined surface in a case where it is not necessary for the flow of ink which flows out from the filter chamber 60F to be slower.

In the ink vessel 80 of the embodiment described above, the rib 64*b* which is the abutting section with the filter 66 which changes shape need not necessarily be provided in the filter chamber 60F. For example, the rib 64*b* is unnecessary in a case where the filter 66 hardly changes shape or in a case where the function of the filter chamber 60F is maintained without the first opening section 65 being opened up due to the filter 66 peeling from the second supply member 61 even when the filter 66 changes shape.

In the ink vessel 80 of the embodiment described above, at least one of the convex sections out of the convex sections 61A, 61B, and 61C may be provided in the second supply member 61. In addition, the one convex section which is provided may be a convex section where a single protuberance is formed instead of a plurality of protuberances. Alternatively, the convex sections 61A, 61B, and 61C need not necessarily be provided in a case where, for example, the pack body 91 does not change shape or the change in shape is small due to a reduction in the amount of ink in the ink chamber IS since there is a low probability that the pack members 92 will abut with the second supply member 61.

In the ink vessel 80 of the embodiment described above, there need not necessarily be a configuration where the filter chamber 60F and the low pressure chamber 60D are connected so as to be able to be attached and detached with regard to the first supply member 81 due to the second supply member 61 being formed integrally with the first supply member 81 (the joining section 82) in a case where, for example, it is not necessary to replace the second supply member 61.

In the ink vessel 80 of the embodiment described above, the first opening section 65 where it is possible for ink to flow into the filter chamber 60F through the filter 66 need not necessarily have a length in the vertical direction which is shorter than the length in a direction which intersects with the vertical direction. For example, the first opening section 65 may be a square or a rectangle which is long in the vertical direction according to the shape of the pack body 91.

In the ink vessel 80 of the embodiment described above, the low pressure chamber 60D need not be formed in a state where at least a portion overlaps with the filter chamber 60F in the projection direction where the projection area of the filter chamber 60F is maximized.

In the ink vessel 80 of the embodiment described above, the filter chamber 60F and the low pressure chamber 60D need not necessarily be formed using the shared member. For example, the second supply member 61 may be formed as two members which are divided in the thickness direction which is the scanning direction, the filter chamber 60F may be formed from one of the two members of the second supply member 61 which is divided, and the low pressure chamber 60D may be formed from the other member.

In the ink vessel 80 of the embodiment described above, the second supply member 61 where the low pressure chamber 60D is formed need not necessarily be formed in a position where it is possible to reduce the proportion of gas which is dissolved in ink in the filter chamber 60F. This is permissible in a case where, for example, there is a low probability that gas will be dissolved in ink which flows into the filter chamber 60F in the ink chamber IS.

In the ink vessel 80 of the embodiment described above, the filter chamber 60F and the low pressure chamber 60D need not necessarily be provided in a case where, for example, ink which is contained in the ink chamber is ink with hardly any dirt or dissolved gas. One modified example of this will be described below with reference to the drawings.

Figure 31A:
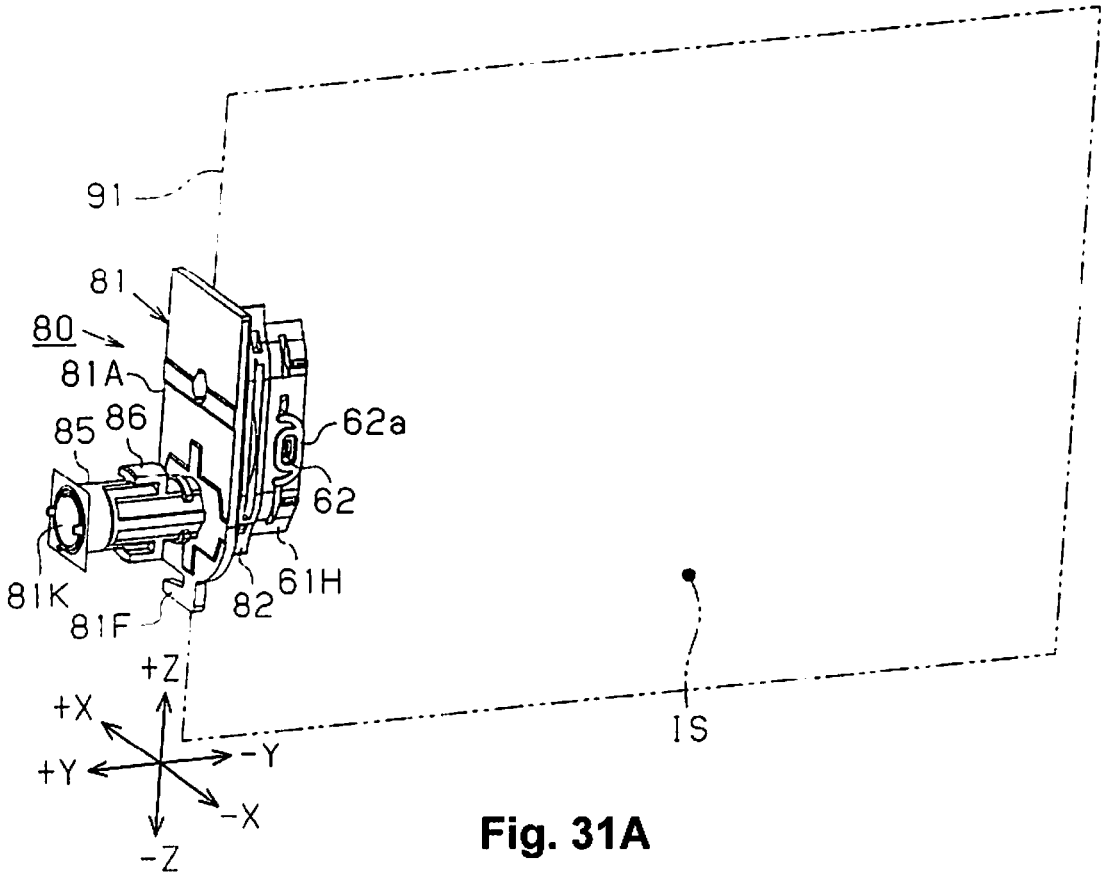
FIGS. 31A and 31B are diagrams illustrating a supply member which is a modified example where a filter chamber and a low pressure chamber are not provided and FIGS. 31A and 31B are perspective diagrams of a supply member viewed from the opposite side to each other.
Figure 31B:
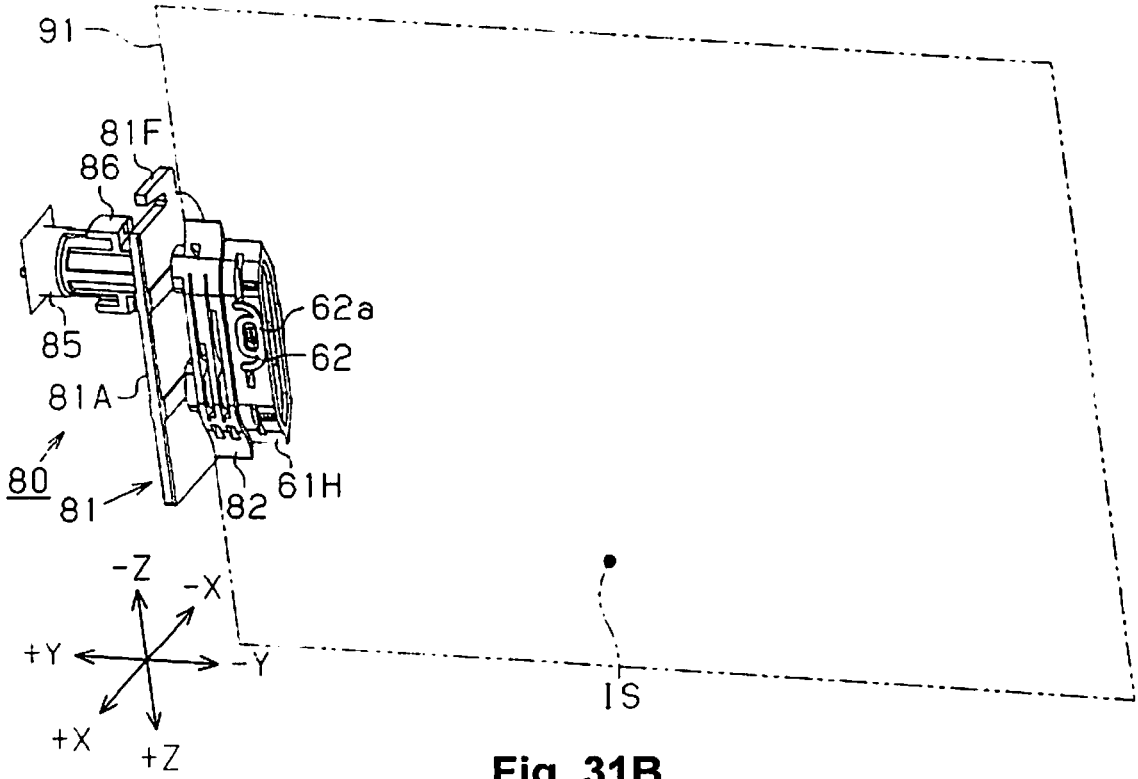

As shown in FIGS. 31A and 31B, the first supply member 81 where the liquid supply opening 81K is formed and the ink chamber IS, which is an ink containing space using the pack body 91 which is joined with the first supply member 81, are formed in the ink vessel 80 of the present modified example. Then, the injection opening 62 is provided in the joining section 82 on the ink chamber IS side when ink is injected in the ink chamber IS and a second supply member 61H, where the valve 93 which is a check valve is provided inside, is connected. Accordingly, the second supply member 61H has generally a shape where a forming member portion for the filter chamber 60F and the low pressure chamber 60D is cut away from the second supply member 61 of the embodiment. Due to this shape, it is not necessary to change the shape of the first supply member 81 and it is possible to easily form the ink vessel 80 without the filter chamber 60F and the low pressure chamber 60D. In other words, it is possible to easily manufacture the ink vessel 80 which is provided with the filter chamber 60F and the low pressure chamber 60D and the ink vessel 80 which is not provided with the filter chamber 60F and the low pressure chamber 60D with the same shape according to the type of ink which is contained.

In the ink vessel 80 of the embodiment described above, the communication opening 84 need not necessarily be positioned in the first supply member 81 on the +Y direction side toward the mounting section 20 of the printer 11 if it is a location where the communication opening 84 is open to air and there is a low probability that the communication opening 84 will be covered by a sheet or the like. For example, the communication opening 84 may be an opening on the side surface of the base section 81A.

In the ink vessel 80 of the embodiment described above, the communication opening 84 need not necessarily be positioned more in the opposite direction to the gravity direction side (the +Z direction side) in the vertical direction than the liquid supply opening 81K in a state of being mounted in the mounting section 20. The communication opening 84 may be provided at any position in the member surface 81S of the base section 81A in a case such as where ink does not flow on the base section 81A in a case where, for example, ink leaks out from the liquid supply opening 81K.

In the ink vessel 80 of the embodiment described above, the width W1 of the stepped section 81D along the vertical direction may be the same as or may be wider than the width W2 of the communication opening 84 along the vertical direction. Due to, for example, a stepped section on the opposite direction to the gravity direction side (the +Z direction side) of the stepped section 81D being formed in the stepped section 81D so as to be positioned within the width W2 of the communication opening 84, it is possible to suppress the communication opening 84 from being blocked off since it is possible for steps to be formed in at least two locations in the communication opening 84.

In the ink vessel 80 of the embodiment described above, the stepped section 81D need not necessarily be positioned on the gravity direction side of the communication opening 84 in the vertical direction in a state of being mounted in the mounting section 20. The stepped section 81D may be positioned in the opposite direction to the gravity direction side (the +Z direction side) of the communication opening 84 in a case where, for example, there is a low probability that foreign matter or the like will be attached to the stepped section 81D.

In the ink vessel 80 of the embodiment described above, the stepped section 81D, where steps in the perpendicular direction to the member surface 81S are formed in at least a portion of the communication opening 84, need not be provided in the first supply member 81 in the member surface 81S where the communication opening 84 is formed. The stepped section 81D need not be provided in this manner in a case where, for example, there is a low probability that the communication opening 84 will be blocked off.

In the ink vessel 80 of the embodiment described above, the stepped section 81D of the first supply member 81 may be a groove which is provided in the member surface 81S.

Figure 32B:
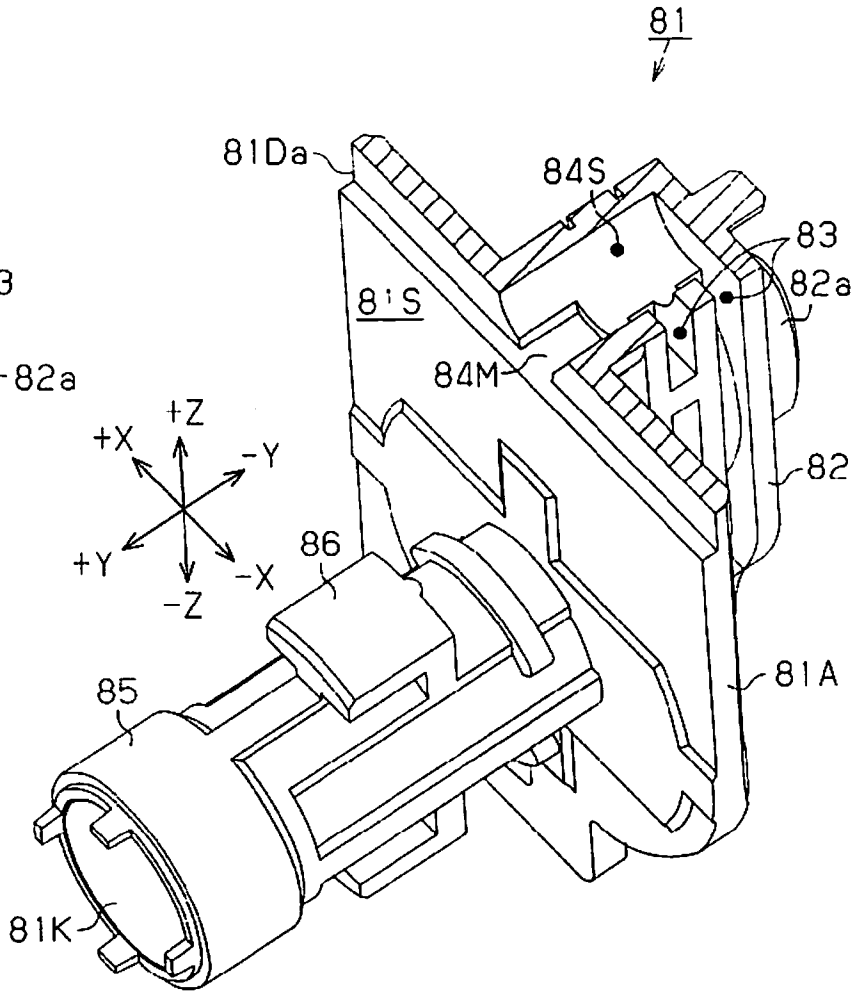
FIG. 32A is a perspective diagram illustrating a supply member which is a modified example where a groove which intersects with a communication opening is formed and FIG. 32B is a perspective diagram where a supply member which is a modified example is cut along a groove.
Figure 32A:
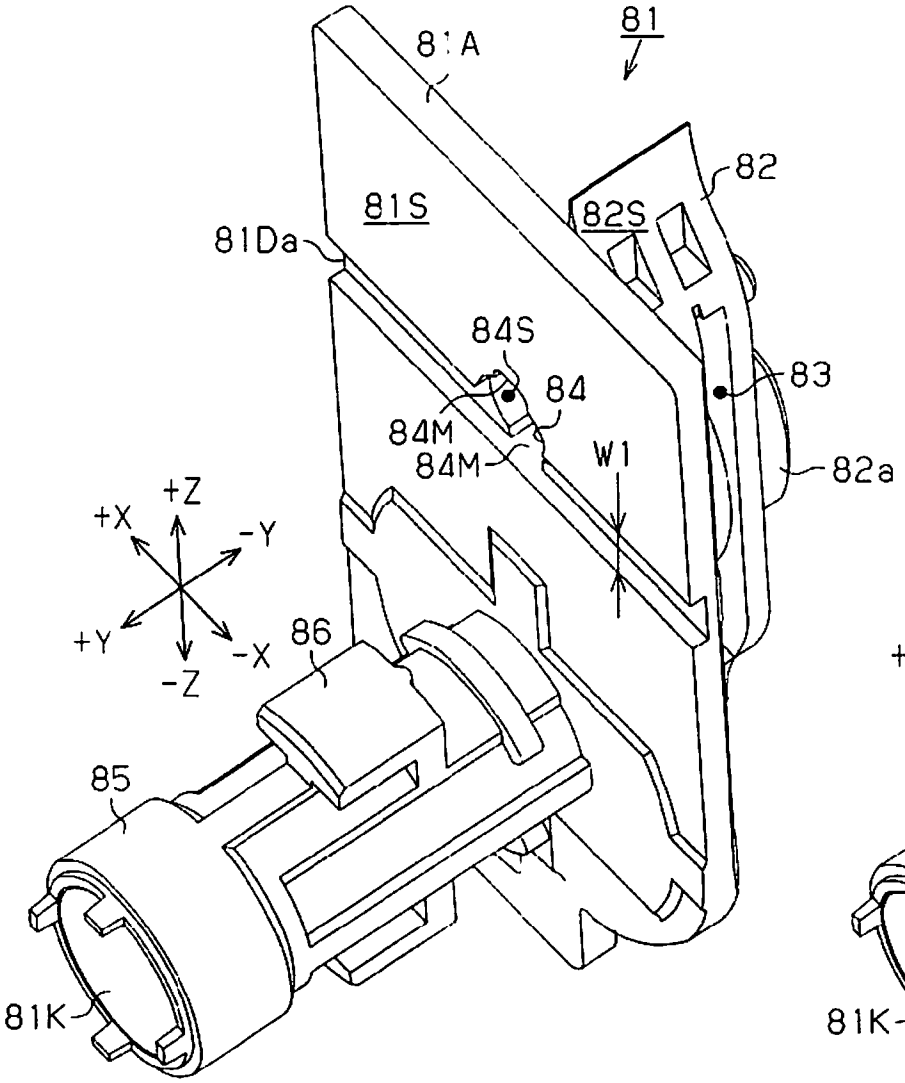

For example, as shown in FIGS. 32A and 32B, a concave groove is formed in the present modified example as a stepped section 81Da in the first supply member 81 in the member surface 81S of the base section 81A so as to cut across the communication opening 84 which communicates with air. Accordingly, the stepped section 81Da communicates with the space 84S with a cylindrical shape. In addition, in the present modified example, the concave groove of the stepped section 81Da is provided to extend to both end sections of the base section 81A in the latitudinal direction and it is possible to maintain the communication opening 84 so as to be open to air due to the side end of the base section 81A being open even if the member surface 81S where the communication opening 84 is provided is covered.

In the ink vessel 80 of the embodiment described above, the shape of the communication opening 84 is not necessarily limited to a polygon shape. For example, the shape of the communication opening 84 may be a circle or may be an ellipse. Alternatively, the shape of the communication opening 84 may be a boat shape which is the same as the joining section 82. It is possible for any shape to be adopted as the shape of the communication opening 84 if it is a shape where it is possible for the possibility that the communication opening 84 is blocked off is reduced.

In the ink cartridge 70 (70W) of the embodiment described above, the first supply member 81 of the ink vessel 80 need not necessarily be formed in an asymmetrical manner when viewed from the insertion direction into the first casing member 71. In a case where, for example, the cylindrical flow path section 85 is formed in the center of the base section 81A, it is permissible for the base section 81*a* to be formed in a symmetrical manner since it is not necessary to identify the insertion posturing of the first supply member 81 when the cylindrical flow path section 85 is inserted in the through hole 75H. In addition, the base section 81A may be symmetrical in a case where, for example, a shape or a display such as a gate during molding or a colored section, where it is possible to identify the insertion posturing of the first supply member 81 when the cylindrical flow path section 85 is inserted in the through hole 75H, is provided in the first supply member 81 or the base section 81A.

In the ink cartridge 70 (70W) of the embodiment described above, the abutting section 76A which is able to abut with the base section 81A in the insertion direction for the cylindrical flow path section 85 need not necessarily be provided in the through path forming section 75. It is possible for the first supply member 81 to be supported by the first casing member 71 due to, for example, a marking which indicates the insertion amount for the cylindrical flow path section 85 being provided in the cylindrical flow path section 85 and the first supply member 81 being rotated in a state where the cylindrical flow path section 85 is inserted up to the marking.

In the ink cartridge 70 (70W) of the embodiment described above, the engaged section 86 which regulates movement of the first supply member 81 in the opposite direction to the insertion direction into the through hole 75H need not necessarily be provided in the cylindrical flow path section 85. It is not necessary to provide the engaged section 86 in the cylindrical flow path section 85 in a case of the first supply member 81 being supported with regard to the first casing member 71 so that movement of the first supply member 81 in the opposite direction to the insertion direction in the through hole 75H is suppressed due to, for example, a portion of the first supply member 81 other than the cylindrical flow path section 85 in a state where the cylindrical flow path section 85 is rotated after being inserted in the through hole 75H. Here, in this case, it is preferable that the engaging section which engages the engaged section 86 which is provided in the through hole forming section 75 be formed in the first casing member 71 at a portion other than the support section 76.

In the ink cartridge 70 (70W) of the embodiment described above, the positions of the first protuberance section 71A and the second protuberance section 71B which are the fastening sections, which are rotated by 90 degree from the position where the cylindrical flow path section 85 is inserted in the through hole 75H, need not necessarily be positions where the first supply member 81 is fastened with the fastening section. The angle of rotation may be, for example, 30 degrees, 45 degrees, or 60 degrees as long as the angle when the first supply member 81 is attached to the first casing member 71 is used as a guide.

In the ink cartridge 70 (70W) of the embodiment described above, the first supply member 81 need not necessarily be provided with the L shape section 81F where the claw section 81Fa which is able to change shape is formed when fastening with the first protuberance section 71A and the second protuberance section 71B. For example, the second protuberance section 71B may change shape (elastically change shape) so as to escape from within the rotation trajectory of the L shape section 81F without the L shape section 81F changing shape.

In the ink cartridge 70 (70W) of the embodiment described above, the first protuberance section 71A and the second protuberance section 71B, which regulate rotating of the cylindrical flow path section 85 in a state of being engaged with the cylindrical flow path section 85 due to being fastened with the first supply member 81, need not be provided in the first casing member 71. It is possible for the state where the first supply member 81 is supported by the first casing member 71 to be maintained using a configuration where, for example, rotating of the cylindrical flow path section 85 is regulated due to engaging of the second engaged section 86B of the engaged section 86 and the through hole forming section 75.

In the ink cartridge 70 (70W) of the embodiment described above, the linking rib 70R as the second convex section which is provided in the third surface CS3 need not necessarily be provided so as to configure a portion of the second surface CS2. This modified example will be described with reference to the drawings.

Figure 33B:
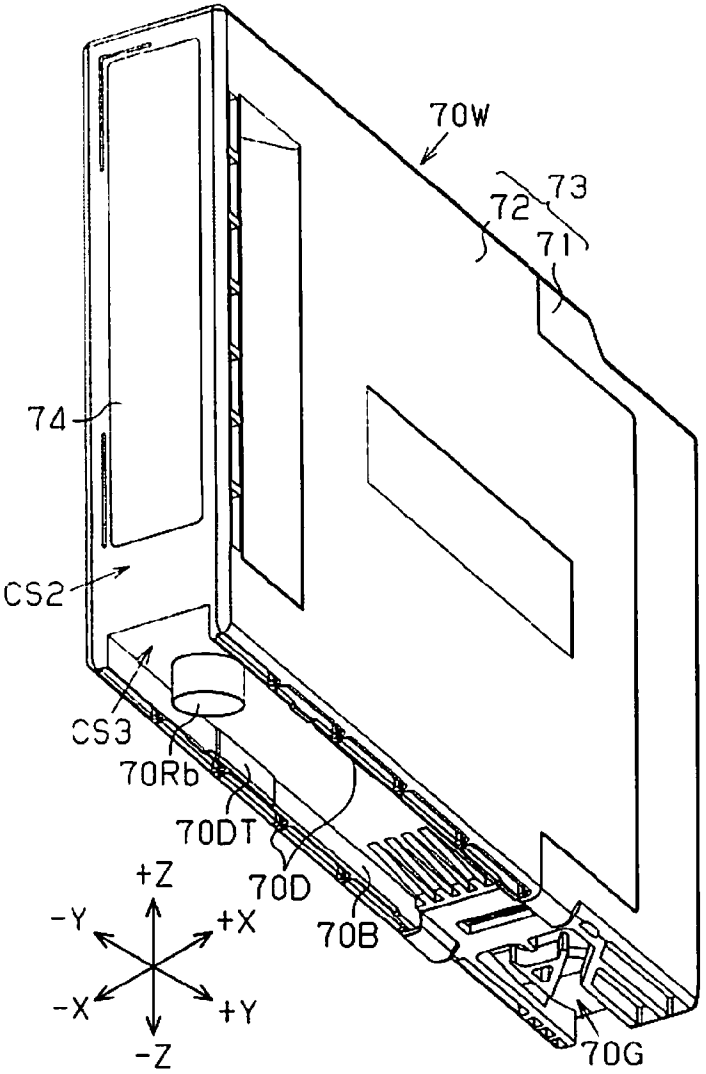
FIGS. 33A and 33B are perspective diagrams illustrating a modified example of a convex section which suppresses erroneous insertion of an ink cartridge in a mounting section.
Figure 33A:
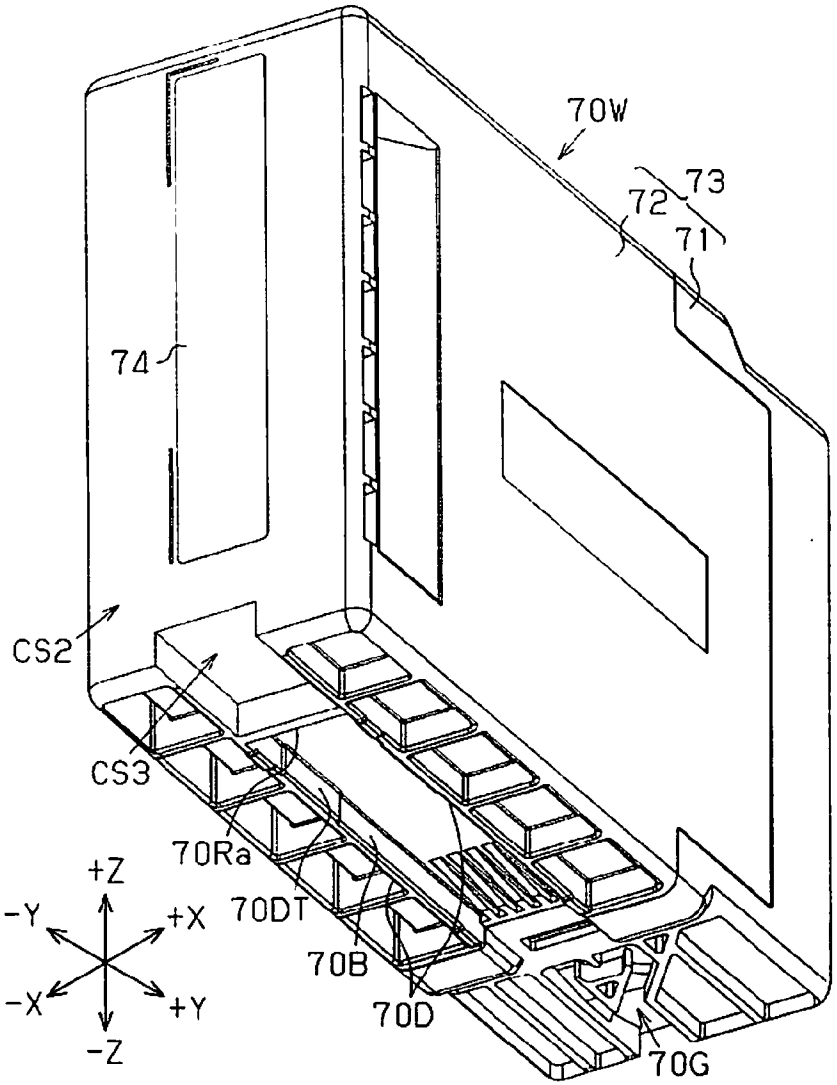

As shown in FIG. 33A, a linking rib 70Ra which links the pair of lower side convex sections 70D may be formed as the second convex section in the third surface CS3 of the ink cartridge 70W (70) at a position on the second surface CS2 side. According to this configuration, a rectangular cut away section is formed in the ink cartridge 70W (70) on the bottom surface side of the second surface CS2 when viewed from the second surface CS2 side. Accordingly, erroneous inserting of the ink cartridge 70W (70) in the mounting section 20 is suppressed since it is possible for a user to easily recognize the bottom surface and the upper surface due to the cut away section.

Alternatively, as shown in FIG. 33B, a circular boss 70Rb which protrudes with a circular pillar shape may be formed instead of a linking rib as the second convex section in the third surface CS3 of the ink cartridge 70W (70) at a position on the second surface CS2 side. According to this configuration, a rectangular cut away section is formed in the ink cartridge 70 (70W) on the bottom surface side of the second surface CS2 when viewed from the second surface CS2 side. Accordingly, erroneous inserting of the ink cartridge 70 (70W) in the mounting section 20 is suppressed since it is possible for a user to easily recognize the bottom surface and the upper surface due to the cut away section.

In the ink cartridge 70 (70W) of the embodiment described above, the convex sections 70C need not necessarily be configured by the pair of lower side convex sections 70D which are provided to extend in the +Y direction and the protuberance sections 70P which are provided in the lower side convex sections 70D. For example, the lower side convex sections 70D may function as the convex section due to being formed with the length in the +Y direction being shorter.

In the ink cartridge 70 (70W) of the embodiment described above, the first surface pressed section need not be in the first surface CS1 at a position which is closer to the third surface CS3 than the fourth surface CS4. Conversely, the first surface pressed section may be at a position which is closer to the fourth surface CS4 or may be at a position which is equal distances from the third surface CS3 and the fourth surface CS4.

In the ink cartridge 70 (70W) of the embodiment described above, the circuit board 30 need not be necessarily inclined with regard to the +Y direction toward the mounting section 20. For example, the circuit board 30 may be inclined in a direction which intersects with the +Y direction.

In the ink cartridge 70 (70W) of the embodiment described above, the first electrode 35 which is the electrical connection section which is provided in the circuit board 30 need not necessarily be positioned between the convex sections 70C when viewed in the +Y direction toward the mounting section 20. It is preferable that the first electrode 35 be arranged according to the position of the second electrode 34 in the mounting section 20.

In the ink cartridge 70 (70W) of the embodiment described above, the liquid supply opening 81K need not necessarily be positioned between the convex sections 70C when viewed in the +Y direction toward the mounting section 20. It is preferable that the liquid supply opening 81K be arranged according to the position of the supply needle 29 in the mounting section 20.

In the ink cartridge 70 (70W) of the embodiment described above, the convex sections 70C which are provided in the third surface CS3 need not necessarily be positioned more to the second surface CS2 side than the groove section 70G which is the third surface pressed section. It is preferable that the convex section 70C be provided on the first surface CS1 side in a case where, for example, the position of the groove section 70G is provided in the third surface CS3 on the second surface CS2 side.

In the ink cartridge 70 (70W) of the embodiment described above, the convex sections 70C need not necessarily be provided on the third surface CS3. For example, the convex sections 70C may be provided on the fourth surface CS4 or may be provided on both the third surface CS3 and the fourth surface CS4. In short, it is sufficient if the convex sections 70C are provided according to the direction in which the ink cartridge 70 (70W) is pressed in the mounting section 20.

In the ink cartridge 70 (70W) of the embodiment described above, two of the protuberance sections 70P need not necessarily be provided in each of the lower side convex sections 70D to be spaced with an interval in the +Y direction. For example, one of the protuberance sections 70P may be provided or three or more of the protuberance sections 70P may be provided to be spaced in the +Y direction. Here, in a case where one of the protuberance sections 70P is provided, it is preferable that the protuberance section 70P be provided in the lower side convex sections 70D to be closer to the second surface CS2 on the opposite side to the +Y direction.

In the ink cartridge 70 of the embodiment described above, the inner side convex sections 70Ea and the concave grooves 70H need not necessarily be provided in the fourth surface CS4 which is one of the side surfaces. For example, there may be a configuration where the inner side convex section 70Ea is provided on the fourth surface CS4 and the concave grooves 70H are provided on the third surface CS3 side. In this case, the guide sections 27B are provided in the bottom member 28 of the mounting section 20.

In the ink cartridge 70 (70W) of the embodiment described above, the concave grooves 70H need not necessarily be provided so that it is possible for the guide sections 27B which are provided in the mounting section 20 to be inserted. The guide sections 27B are unnecessary if there is a configuration where, for example, the ink cartridge 70 is not inserted at the position of the ink cartridge 70W in the mounting section 20. In this case, the concave grooves 70H are unnecessary.

In the ink cartridge 70 (70W) of the embodiment described above, the fifth surface CS5 and the sixth surface CS6 need not necessarily be provided as the guide wall sections which are guided by the insertion guiding sections 27C which are provided in the mounting section 20. It is not necessary to use the fifth surface CS5 and the sixth surface CS6 as the guide wall sections which are guided by the insertion guiding sections 27C in a case where, for example, the insertion guiding sections 27C are not necessary when the ink cartridge 70 (70W) is inserted in the mounting section 20.

In the ink cartridge 70 (70W) of the embodiment described above, the liquid supply opening 81K need not be provided to be arranged in the surface region R1 where the extending surface R3 of the third surface CS3 and the extending surface R4 of the fourth surface CS4 intersect. It is preferable that the liquid supply opening 81K be arranged according to the position of the supply needle 29 in the mounting section 20.

In the ink cartridge 70 (70W) of the embodiment described above, the first electrode 35 need not necessarily be provided on the extending region R4 toward the +Y direction which is a surface region which is interposed by the upper convex wall sections 70ET which are the position aligning sections. It is preferable that the first electrode 35 be arranged according to the position of the second electrode 34 which is the electrical connection section which is provided in the mounting section 20 of the printer 11.

In the ink cartridge 70 (70W) of the embodiment described above, the groove section 70G need not necessarily be provided on the extending region R3 toward the +Y direction which is a surface region which is interposed by the lower convex wall sections 70DT which is the position aligning section. It is preferable that the groove section 70G be arranged according to the position of the lever member 52 which is the moveable fastening section which is provided in the mounting section 20 of the printer 11.

In the ink cartridge 70 (70W) of the embodiment described above, the upper convex wall sections 70ET and the lower convex wall sections 70DT need not necessarily be positioned at both sides to interpose the upper guide ribs 27A or the lower guide ribs 28A when the ink cartridge 70 (70W) is mounted in the mounting section 20. The upper convex wall sections 70ET or the lower convex wall sections 70DT may be respectively positioned, for example, on one side of the upper guide ribs 27A or on one side of the lower guide ribs 28A as long as positional aligning is possible.

In the ink cartridge 70 (70W) of the embodiment described above, the upper convex wall sections 70ET or the lower convex wall sections 70DT need not necessarily be provided in the lower side convex sections 70E (the inner side convex sections 70Ea) or the lower side convex sections 70D. For example, the upper convex wall sections 70ET and the lower convex wall sections 70DT may be provided on the fourth surface CS4 or the third surface CS3 as portions which are different to the lower side convex sections 70E (the inner side convex sections 70Ea) and the lower side convex sections 70D.

In the ink cartridge 70 (70W) of the embodiment described above, the upper convex wall sections 70ET or the lower convex wall sections 70DT need not necessarily positionally align the ink cartridge 70 (70W) in a direction which intersects with the +Y direction. For example, the upper convex wall sections 70ET or the lower convex wall sections 70DT may positionally align the ink cartridge 70 (70W) in the +Y direction. By doing this, the ink cartridge 70 (70W) is stably positionally aligned with regard to the mounting section 20 in the +Y direction using the upper convex wall sections 70ET or the lower convex wall sections 70DT even if there is variation in the +Y direction in the positioning of the ink cartridge 70 (70W) which is fastened using the movable fastening section (the lever member 52).

In the ink cartridge 70 (70W) of the embodiment described above, it is permissible that there be a configuration where at least either of the upper convex wall sections 70ET or the lower convex wall sections 70DT be provided as the positional aligning section in the mounting section 20.

In the embodiment described above, the rib sections 27T or the rib sections 28T need not necessarily be provided in the upper guide ribs 27A or the lower guide ribs 28A. In addition, the stripe shaped rail surfaces 28C need not be provided in the bottom member 28 of the mounting section 20.

In the embodiment described above, the lower convex wall section 70DT need not be in a state of engaging with regard to the rib sections 28T of the lower guide ribs 28A in a state where the ink cartridge 70 (70W) is pushed in the deepest position in the mounting section 20. Alternatively, the rib sections 27T of the upper guide ribs 27A need not be in a state of engaging with regard to upper convex wall sections 70ET. There may be a configuration where these state of engaging are maintained at least in the mounting state.

In the embodiment described above, the first electrode 35 need not necessarily be provided in the ink cartridge 70 at the inclined surface 71K which is inclined in a direction which intersects with the +Y direction toward the cartridge holding body 22. The first electrode 35 may be provided, for example, at a side surface where the +Y direction is a perpendicular direction (that is, along a direction which is perpendicular to the +Y direction).

In the embodiment described above, the first pressing member 48 need not necessarily be provided to be arranged in the surroundings of the supply needle 29 and may be provided to be arranged, for example, more to the opposite direction to the gravity direction side (+Z direction side) than the supply needle 29 or more to the gravity direction side (−Z direction side) than the supply needle 29.

In the embodiment described above, for example, the first pressing member 48 which presses the moving body 41 or the second pressing member 38 which presses the moveable member 31 may be members other than a coil spring such as a U shape plate spring.

In the embodiment described above, the number of the ink cartridges 70 which are held in the cartridge holding bodies 22 is not necessarily limited to four. In addition, the position where the ink cartridge 70W with a larger width is held is not necessarily limited to the position farthest to the left side out of the cartridge holding bodies 22.

In the embodiment described above, there may be a configuration where the mounting section 20 is provided on the outer side of the casing 11*a* of the printer 11. In a case where ink is supplied from the mounting section 20 which is provided on the outside of the casing 11*a* to the ink ejecting head 18 which is inside the casing 11*a*, it is necessary for the ink supply tube TB for supplying ink to be led from the outside to the inside of the casing 11*a*. As such, in this case, it is preferable that a hole or a cutting where it is possible for the ink supply tube TB to pass through be provided in the casing 11*a*. Alternatively, the ink supply tube TB may be led from the outside to the inside of the casing 11*a* through a gap which is provided in the casing 11*a*. By doing this, it is possible to easily perform supplying of ink with regard to the liquid ejecting head 18 which uses an ink flow path with the ink supply tube TB.

The liquid ejecting head 18 is not limited to a so-called series head type which ejects ink by moving back and forth along with the carriage 16 in a direction which intersects with the transport direction of the sheet P. That is, the liquid ejecting head 18 may be so-called a line head type which ejects ink from a plurality of nozzles, which are provided to span across substantially the entire width of the medium in the longitudinal direction, toward the medium, in a state of being arranged to be fixed so that the longitudinal direction is along the width direction which intersects with the transport direction of the sheet P, with an overall shape where the length size corresponds to the width size of the sheet P.

In the embodiment described above, the printer 11 may be a liquid consumption apparatus which ejects or discharges liquids other than ink. Here, as the state of liquid which is discharged from the liquid consumption apparatus as liquid droplets in minute amounts, liquid droplets which have a granular shape, a tear shape, and a trailing shape are included. In addition, it is sufficient if the liquid referred to here is a material which is able to be ejected by the liquid consumption apparatus. For example, it is sufficient if the liquid is in a state where a substance is in a liquid phase, and the substance includes a liquid with high or low viscosity and a body with a fluid form such as a sol, a gel water, another inorganic solvent, an organic solvent, a solution, a liquid resin, or a liquid metal (a metal melt). In addition, not only liquid bodies with substance in one state are included but particles of a functional material formed of solid matter such as pigments and metal particles being dissolved, dispersed, or mixed into a solvent and the like are also included. Typical examples of the liquids include inks, liquid crystals, and the like as described in the embodiment described above. Here, the inks encompass various types of liquid compositions such as typical water-based inks and oil-based inks, gel inks, and hot melt inks. Specific examples of liquid consumption apparatuses may include, for example, liquid consumption apparatuses which eject liquids which include materials in a dispersed or dissolved form such as electrode materials or coloring materials which are used in the manufacturing or the like of liquid crystal displays, electroluminescence (EL) displays, surface-emitting displays, and color filters. In addition, there may also be liquid consumption apparatuses which eject bio-organic material which is used in biochip manufacturing, liquid consumption apparatuses which are used as precision pipettes and which eject liquids which are samples, textile printing apparatuses, micro dispensers, and the like. Furthermore, there may also be liquid consumption apparatuses which eject a lubricant in a pin point manner in precision machines such as watches or cameras and liquid consumption apparatuses which eject a transparent resin liquid such as an ultraviolet curable liquid onto a substrate in order to form minute hemispherical lenses (optical lenses) which are used in optical communication elements or the like. There may also be liquid consumption apparatuses which eject an etching liquid such as an acid or an alkali in order to etch a substrate or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid containing body comprising:

a liquid containing vessel configured to contain a liquid, and including a supply member with a liquid supply opening that is configured to supply the liquid contained to a liquid consumption apparatus; and a casing member supporting at least the supply member of the liquid containing vessel, the supply member having a cylindrical flow path section that defines the liquid supply opening, the casing member having a through hole forming section with a through hole, the cylindrical flow path section of the supply member being insertable in the through hole, and the casing member further having an engaging section provided at a bottom wall around the through hole, the engaging section being configured to engage with the supply member by inserting the cylindrical flow path section in the through hole and rotating with an insertion direction as an axial line, the engaging section being further configured to regulate movement of the cylindrical flow path section in an opposite direction to the insertion direction.

2. The liquid containing body according to claim 1, wherein the casing member further has a fastening section that regulates rotating of the cylindrical flow path section by fastening the supply member in a state where the cylindrical flow path section is inserted.

3. The liquid containing body according to claim 2, wherein the supply member further has a fastened section that is fastened by the fastening section, and the fastened member further has a claw section that is deformable while the fastened member is fastened by the fastening section.

4. The liquid containing body according to claim 2, wherein the fastening section is arranged such that a position, where the cylindrical flow path section is rotated by 90 degrees about the axial line from a position of being inserted in the through hole, is a position where the supply member is fastened by the fastening section.

5. The liquid containing body according to claim 1, wherein the engaging section is provided in the through hole forming section of the casing member, and the cylindrical flow path section of the supply member further has an engaged section that is engageable with the engaging section of the through hole forming section and whose movement in the opposite direction to the insertion direction is regulated while engaging with the engaging section.

6. The liquid containing body according to claim 1, wherein the through hole forming section further has an abutting section that is abuttable with the cylindrical flow path section in the insertion direction.

7. The liquid containing body according to claim 1, wherein the supply member is formed in an asymmetrical manner when viewed from the insertion direction.

* * * * *